US009202339B2

(12) United States Patent
Ching et al.

(10) Patent No.: US 9,202,339 B2
(45) Date of Patent: Dec. 1, 2015

(54) GAMING SYSTEM, GAMING DEVICE, AND GAMING METHOD FOR SHIFTING SYMBOLS FROM A STAGING AREA TO A SYMBOL MATRIX

(71) Applicant: IGT, Reno, NV (US)

(72) Inventors: Erick T. Ching, Reno, NV (US); Benjamin D. Menesini, Reno, NV (US)

(73) Assignee: IGT, Las Vegas, NV (US)

( * ) Notice: Subject to any disclaimer, the term of this patent is extended or adjusted under 35 U.S.C. 154(b) by 278 days.

(21) Appl. No.: 13/892,965

(22) Filed: May 13, 2013

(65) Prior Publication Data

US 2013/0267299 A1 Oct. 10, 2013

Related U.S. Application Data

(63) Continuation of application No. 12/549,082, filed on Aug. 27, 2009, now Pat. No. 8,444,473, which is a continuation-in-part of application No. 11/937,770, filed on Nov. 9, 2007, now Pat. No. 8,162,741.

(51) Int. Cl.
*G07F 17/32* (2006.01)
*G07F 17/34* (2006.01)

(52) U.S. Cl.
CPC ..... *G07F 17/326* (2013.01); *G07F 17/3267* (2013.01); *G07F 17/34* (2013.01)

(58) Field of Classification Search
CPC ..... G07F 17/32; G07F 17/3267; G07F 17/34; G07F 17/326
See application file for complete search history.

(56) References Cited

U.S. PATENT DOCUMENTS 1,564,746 A 12/1925 Barnard
1,978,395 A 10/1934 Groetchen
(Continued)

FOREIGN PATENT DOCUMENTS

AU 710015 9/1997
AU 722969 6/1998
(Continued)

OTHER PUBLICATIONS

50 Lions, written by videoslotmachines.com, published prior to 2007.
(Continued)

*Primary Examiner* — Paul D'Agostino
*Assistant Examiner* — David Duffy
(74) *Attorney, Agent, or Firm* — Neal, Gerber & Eisenberg LLP

(57) ABSTRACT

A gaming device displays a symbol matrix including a plurality of symbol positions and at least two symbol staging areas, each symbol staging area including at least one supplemental symbol potentially shiftable into the symbol matrix. The gaming device displays a symbol staging area indicator. For a play of a game, the gaming device generates a symbol in each symbol position of the symbol matrix. Upon an occurrence of a triggering condition, the gaming device indicates one of the symbol staging areas using the symbol staging area indicator and removes at least one symbol from at least one symbol position of the symbol matrix. The gaming device re-populates the empty symbol positions by shifting any appropriate symbols of the symbol matrix any appropriate empty symbol positions, and thereafter shifting at least one supplemental symbol from the indicated symbol staging area into at least one remaining empty symbol position.

20 Claims, 42 Drawing Sheets

(56) References Cited

U.S. PATENT DOCUMENTS 3,420,525 A 1/1969 Waders
3,642,287 A 2/1972 Lally et al.
3,735,987 A 5/1973 Ohki
3,977,681 A 8/1976 Deitrich
4,099,722 A 7/1978 Rodesch et al.
4,114,890 A 9/1978 Yamamoto et al.
4,171,814 A 10/1979 Tamano
4,198,052 A 4/1980 Gauselmann
4,200,291 A 4/1980 Hooker
4,326,351 A 4/1982 Heywood et al.
4,357,567 A 11/1982 Rock
4,448,419 A 5/1984 Telnaes
4,573,681 A 3/1986 Okada
4,636,951 A 1/1987 Harlick
4,695,053 A 9/1987 Vazquez, Jr. et al.
4,790,537 A 12/1988 Smyth et al.
4,826,169 A 5/1989 Bessho et al.
4,838,552 A 6/1989 Hagiwara
4,874,173 A 10/1989 Kishishita
5,019,973 A 5/1991 Wilcox et al.
5,152,529 A 10/1992 Okada
5,205,555 A 4/1993 Hamano
RE34,244 E 5/1993 Hagiwara
5,308,065 A 5/1994 Bridgeman et al.
5,332,228 A 7/1994 Schultz
5,364,100 A 11/1994 Ludlow et al.
5,393,061 A 2/1995 Manship et al.
5,395,111 A 3/1995 Inoue
5,423,539 A 6/1995 Nagao
5,431,408 A 7/1995 Adams
5,449,173 A 9/1995 Thomas et al.
5,564,700 A 10/1996 Celona
5,580,053 A 12/1996 Crouch
5,584,764 A 12/1996 Inoue
5,609,524 A 3/1997 Inoue
5,611,535 A 3/1997 Tiberio
5,624,119 A 4/1997 Leake
5,664,998 A 9/1997 Seelig et al.
5,704,835 A 1/1998 Dietz
5,720,662 A 2/1998 Holmes et al.
5,722,891 A 3/1998 Inoue
5,752,881 A 5/1998 Inoue
5,766,074 A 6/1998 Cannon et al.
5,769,716 A 6/1998 Saffari et al.
5,772,506 A 6/1998 Marks et al.
5,807,172 A 9/1998 Piechowiak
5,813,911 A 9/1998 Margolin
5,823,873 A 10/1998 Moody
5,833,238 A 11/1998 Watanabe
5,833,536 A 11/1998 Davids et al.
5,833,537 A 11/1998 Barrie
5,863,249 A 1/1999 Inoue
5,882,260 A 3/1999 Marks et al.
5,927,714 A 7/1999 Kaplan
5,934,672 A 8/1999 Sines et al.
5,935,002 A 8/1999 Falciglia
5,951,397 A 9/1999 Dickinson
5,980,384 A 11/1999 Barrie
5,984,782 A 11/1999 Inoue
5,997,400 A 12/1999 Seelig et al.
5,997,401 A 12/1999 Crawford
6,027,115 A 2/2000 Griswold et al.
6,033,307 A 3/2000 Vancura
6,056,642 A 5/2000 Bennett
6,059,289 A 5/2000 Vancura
6,059,658 A 5/2000 Mangano et al.
6,086,066 A 7/2000 Takeuchi et al.
6,089,976 A 7/2000 Schneider et al.
6,089,977 A 7/2000 Bennett
6,093,102 A 7/2000 Bennett
6,095,921 A 8/2000 Walker et al.
6,117,013 A 9/2000 Eiba
6,120,031 A 9/2000 Adams
6,120,376 A 9/2000 Cherry
6,120,377 A 9/2000 McGinnis et al.
6,142,875 A 11/2000 Kodachi et al.
6,149,521 A 11/2000 Sanduski
6,159,095 A 12/2000 Frohm et al.
6,159,096 A 12/2000 Yoseloff
6,174,235 B1 1/2001 Walker et al.
6,190,254 B1 2/2001 Bennett
6,203,009 B1 3/2001 Sines et al.
6,220,959 B1 4/2001 Holmes, Jr. et al.
6,224,484 B1 5/2001 Okuda et al.
6,227,971 B1 * 5/2001 Weiss ..... 463/20
6,241,607 B1 6/2001 Payne et al.
6,251,013 B1 6/2001 Bennett
6,254,481 B1 7/2001 Jaffe
6,261,178 B1 7/2001 Bennett
6,270,411 B1 8/2001 Gura et al.
6,270,412 B1 8/2001 Crawford et al.
6,290,600 B1 9/2001 Glasson
6,299,165 B1 10/2001 Nagano
6,299,170 B1 10/2001 Yoseloff
6,302,398 B1 10/2001 Vecchio
6,302,429 B1 10/2001 Friedrich
6,305,686 B1 10/2001 Perrie et al.
6,311,976 B1 11/2001 Yoseloff et al.
6,315,289 B1 11/2001 Sakamoto
6,315,660 B1 11/2001 DeMar et al.
6,315,663 B1 11/2001 Sakamoto
6,318,721 B1 11/2001 Randall et al.
6,319,124 B1 11/2001 Baerlocher et al.
6,322,078 B1 11/2001 Adams
6,347,996 B1 2/2002 Gilmore et al.
6,358,144 B1 3/2002 Kaddlic et al.
6,364,766 B1 4/2002 Anderson et al.
6,375,570 B1 4/2002 Poole
6,394,902 B1 5/2002 Glavich et al.
6,398,644 B1 6/2002 Perrie et al.
6,409,602 B1 6/2002 Wiltshire et al.
6,413,161 B1 7/2002 Baerlocher et al.
6,413,162 B1 7/2002 Baerlocher et al.
6,416,408 B2 7/2002 Tracy et al.
6,419,579 B1 7/2002 Bennett
6,428,412 B1 8/2002 Anderson et al.
6,439,993 B1 8/2002 O'Halloran
6,439,995 B1 8/2002 Hughs-Baird et al.
6,443,840 B2 9/2002 Von Kohorn
6,454,266 B1 9/2002 Breeding et al.
6,464,581 B1 10/2002 Yoseloff et al.
6,481,713 B2 11/2002 Perrie et al.
6,494,454 B2 12/2002 Adams
6,506,114 B1 1/2003 Estes et al.
6,514,141 B1 2/2003 Kaminkow et al.
6,517,432 B1 2/2003 Jaffe
6,517,433 B2 2/2003 Loose et al.
6,551,187 B1 4/2003 Jaffe
6,558,254 B2 5/2003 Baelocher et al.
6,561,900 B1 5/2003 Baerlocher et al.
6,561,904 B2 5/2003 Locke et al.
6,565,433 B1 5/2003 Baerlocher et al.
6,575,830 B2 6/2003 Baerlocher et al.
6,585,591 B1 7/2003 Baerlocher et al.
6,589,114 B2 7/2003 Rose
6,602,136 B1 8/2003 Baerlocher et al.
6,602,137 B2 8/2003 Kaminkow et al.
6,604,740 B1 8/2003 Singer et al.
6,616,142 B2 9/2003 Adams
6,632,139 B1 10/2003 Baerlocher
6,632,140 B2 10/2003 Berman et al.
6,634,945 B2 10/2003 Glavich et al.
6,641,477 B1 11/2003 Dietz
6,643,943 B2 11/2003 Dall'Aglio et al.
6,644,663 B2 11/2003 Seelig et al.
6,659,864 B2 12/2003 McGahn et al.
6,666,767 B1 12/2003 Dayan
6,672,960 B1 1/2004 B-Jensen
6,676,511 B2 1/2004 Payne et al.
6,676,512 B2 1/2004 Fong et al.
6,695,696 B1 2/2004 Kaminkow
6,702,671 B2 3/2004 Tarantino
6,702,675 B2 3/2004 Poole et al.
6,712,693 B1 3/2004 Hettinger

(56) References Cited

U.S. PATENT DOCUMENTS 6,719,630 B1 4/2004 Seelig et al.
6,726,204 B2 4/2004 Inoue
6,731,313 B1 5/2004 Kaminkow
6,733,386 B2 5/2004 Cuddy et al.
6,758,747 B2 7/2004 Baerlocher
6,780,109 B2 8/2004 Kaminkow
6,786,820 B2 9/2004 Gerrard et al.
6,802,775 B2 10/2004 Baerlocher et al.
6,805,349 B2 10/2004 Baerlocher et al.
6,808,454 B2 10/2004 Gerrard et al.
6,817,944 B2 11/2004 Kaminkow et al.
6,832,957 B2 12/2004 Falconer
6,835,133 B2 12/2004 Baerlocher et al.
6,837,788 B2 1/2005 Cannon
6,855,054 B2 2/2005 White et al.
6,866,583 B2 3/2005 Glavich et al.
6,875,106 B2 4/2005 Weiss et al.
6,880,826 B2 4/2005 Inoue
6,896,615 B2 5/2005 Berman
6,896,617 B2 5/2005 Daly
6,905,405 B2 6/2005 McClintic
6,905,406 B2 6/2005 Kaminkow et al.
6,908,383 B2 6/2005 Baerlocher et al.
6,910,962 B2 6/2005 Marks et al.
6,913,533 B2 7/2005 Cuddy et al.
6,918,832 B2 7/2005 Baerlocher et al.
6,921,335 B2 7/2005 Rodgers et al.
6,923,441 B2 8/2005 Inoue
6,929,952 B2 8/2005 Baerlocher
6,932,700 B2 8/2005 Bennett et al.
6,939,223 B1 9/2005 Jones
6,942,571 B1 9/2005 McAllister et al.
6,942,572 B2 9/2005 Inoue
6,958,013 B2 10/2005 Miereau et al.
6,960,133 B1 11/2005 Marks et al.
6,971,955 B2 12/2005 Baerlocher et al.
6,976,915 B2 12/2005 Baker et al.
6,979,263 B2 12/2005 Baerlocher et al.
6,981,635 B1 1/2006 Hughs-Baird et al.
6,986,710 B2 1/2006 Baerlocher et al.
6,988,947 B2 1/2006 Baerlocher et al.
6,991,538 B2 1/2006 Cannon
6,997,804 B2 2/2006 Berman
6,997,808 B2 2/2006 Rodgers et al.
7,001,274 B2 2/2006 Baerlocher et al.
7,014,559 B1 3/2006 Fong
7,014,560 B2 3/2006 Glavich et al.
7,018,293 B2 3/2006 Brown et al.
7,040,985 B2 5/2006 Vancura
7,048,275 B2 5/2006 Adams
7,052,395 B2 5/2006 Glavich et al.
7,056,213 B2 6/2006 Ching et al.
7,070,502 B1 7/2006 Bussick et al.
7,074,127 B2 7/2006 Cuddy et al.
7,077,744 B2 7/2006 Cannon
7,077,745 B2 7/2006 Gomez et al.
7,090,580 B2 8/2006 Rodgers et al.
7,094,148 B2 8/2006 Baerlocher et al.
7,104,886 B2 9/2006 Baerlocher et al.
7,104,888 B2 9/2006 Miereau et al.
7,108,602 B2 9/2006 Daly
7,137,888 B2 11/2006 Glavich et al.
7,144,322 B2 12/2006 Gomez et al.
7,153,205 B2 12/2006 Baerlocher
7,160,186 B2 1/2007 Cuddy et al.
7,160,187 B2 1/2007 Loose et al.
7,168,704 B1 1/2007 Lawless
7,169,042 B2 1/2007 Muir et al.
7,192,345 B2 3/2007 Muir et al.
7,192,347 B1 3/2007 Marks et al.
7,195,559 B2 3/2007 Gilmore et al.
7,204,753 B2 4/2007 Ozaki et al.
7,226,359 B2 6/2007 Bussick et al.
7,236,113 B1 6/2007 Wang
7,252,591 B2 8/2007 Van Asdale
7,252,592 B2 8/2007 Rodgers et al.
7,275,988 B2 10/2007 Aida et al.
7,294,058 B1 11/2007 Slomiany et al.
7,309,281 B2 12/2007 Baerlocher et al.
7,309,282 B2 12/2007 Baerlocher et al.
7,311,607 B2 12/2007 Tedsen et al.
7,314,409 B2 1/2008 Maya et al.
7,318,773 B2 1/2008 Baerlocher et al.
7,331,862 B2 2/2008 Rodgers et al.
7,331,866 B2 2/2008 Rodgers et al.
7,335,102 B2 2/2008 Baerlocher et al.
7,338,367 B2 3/2008 Kaminkow et al.
7,351,141 B2 4/2008 Rodgers et al.
7,354,344 B2 4/2008 Paulsen et al.
7,357,713 B2 4/2008 Marks et al.
7,371,168 B2 5/2008 Bilyeu et al.
7,371,169 B2 5/2008 Baerlocher
7,371,170 B2 5/2008 Cregan et al.
7,396,279 B2 7/2008 Berman et al.
7,399,225 B2 7/2008 Kaminkow
7,402,102 B2 7/2008 Marks et al.
7,419,431 B2 9/2008 Gauselmann et al.
7,442,123 B2 10/2008 Brill et al.
7,448,948 B2 11/2008 Hughs-Baird et al.
7,611,406 B2 11/2009 Fuller
7,699,698 B2 4/2010 Randall
7,887,407 B1 * 2/2011 Singer et al. ..... 463/19
8,192,275 B2 * 6/2012 Aoki et al. ..... 463/20
2002/0010017 A1 1/2002 Bennett
2002/0052233 A1 5/2002 Gauselmann
2002/0068623 A1 6/2002 Gauselmann
2002/0077165 A1 6/2002 Bansemer et al.
2002/0094857 A1 * 7/2002 Meyer ..... 463/16
2002/0160836 A1 10/2002 Watanabe et al.
2003/0013518 A1 1/2003 Graham
2003/0036422 A1 2/2003 Baerlocher et al.
2003/0045345 A1 3/2003 Berman
2003/0054874 A1 3/2003 Kaminkow
2003/0057645 A1 3/2003 Baerlocher et al.
2003/0060267 A1 3/2003 Glavich et al.
2003/0092480 A1 5/2003 White et al.
2003/0100356 A1 5/2003 Brown et al.
2003/0125100 A1 7/2003 Cannon
2003/0153382 A1 8/2003 Vancura
2003/0157981 A1 8/2003 Marks et al.
2003/0203752 A1 10/2003 Kaminkow et al.
2003/0203753 A1 10/2003 Muir et al.
2003/0207710 A1 11/2003 Rodgers et al.
2004/0012145 A1 1/2004 Inoue
2004/0014516 A1 1/2004 Inoue
2004/0014517 A1 1/2004 Inoue
2004/0018866 A1 1/2004 Inoue
2004/0023714 A1 * 2/2004 Asdale ..... 463/22
2004/0026854 A1 2/2004 Inoue
2004/0033827 A1 2/2004 Gilmore et al.
2004/0033829 A1 2/2004 Pacey et al.
2004/0036218 A1 2/2004 Inoue
2004/0038726 A1 2/2004 Inoue
2004/0043809 A1 3/2004 Gomez et al.
2004/0048650 A1 3/2004 Mierau et al.
2004/0048651 A1 3/2004 Vorias et al.
2004/0053669 A1 3/2004 Gerrard et al.
2004/0053672 A1 3/2004 Baerlocher
2004/0053676 A1 3/2004 Rodgers
2004/0053677 A1 3/2004 Hughs-Baird
2004/0067790 A1 4/2004 Peterson et al.
2004/0072612 A1 4/2004 Rodgers et al.
2004/0092302 A1 5/2004 Gauselmann
2004/0097280 A1 5/2004 Gauselmann
2004/0102236 A1 5/2004 Suda et al.
2004/0137981 A1 7/2004 Gauselmann et al.
2004/0137982 A1 7/2004 Cuddy et al.
2004/0147306 A1 7/2004 Randall et al.
2004/0180714 A1 * 9/2004 Ward ..... 463/20
2004/0242313 A1 12/2004 Munoz
2005/0020344 A1 1/2005 Kaminkow
2005/0049035 A1 3/2005 Baerlocher et al.
2005/0054405 A1 3/2005 Baerlocher et al.
2005/0054418 A1 3/2005 Baerlocher

(56) References Cited

U.S. PATENT DOCUMENTS

| | | | |
|---|---|---|---|
| 2005/0054429 | A1 | 3/2005 | Baerlocher et al. |
| 2005/0059446 | A1 | 3/2005 | Kaminkow |
| 2005/0059474 | A1 | 3/2005 | O'Halloran |
| 2005/0059477 | A1 | 3/2005 | Baerlocher |
| 2005/0059478 | A1 | 3/2005 | Peterson et al. |
| 2005/0064924 | A1 | 3/2005 | Glavich et al. |
| 2005/0070354 | A1 | 3/2005 | Baerlocher et al. |
| 2005/0071023 | A1 | 3/2005 | Gilliland et al. |
| 2005/0096121 | A1 | 5/2005 | Gilliland et al. |
| 2005/0101372 | A1 | 5/2005 | Mierau et al. |
| 2005/0101380 | A1 | 5/2005 | Glavich et al. |
| 2005/0119403 | A1 | 6/2005 | St. Clair |
| 2005/0148381 | A1 | 7/2005 | Marks et al. |
| 2005/0148384 | A1 | 7/2005 | Marks et al. |
| 2005/0164774 | A1 | 7/2005 | Gauselmann |
| 2005/0187004 | A1 | 8/2005 | Vancura |
| 2005/0192081 | A1 | 9/2005 | Marks et al. |
| 2005/0208994 | A1 | 9/2005 | Berman |
| 2005/0227754 | A1 | 10/2005 | Kaminkow et al. |
| 2005/0282620 | A1 | 12/2005 | Marks et al. |
| 2005/0288094 | A1 | 12/2005 | Marks et al. |
| 2006/0019738 | A1 | 1/2006 | Baerlocher et al. |
| 2006/0030387 | A1 | 2/2006 | Jackson |
| 2006/0030392 | A1 | 2/2006 | Rodgers et al. |
| 2006/0040728 | A1 | 2/2006 | Fuller |
| 2006/0046830 | A1 | 3/2006 | Webb |
| 2006/0058095 | A1 | 3/2006 | Berman et al. |
| 2006/0058097 | A1 | 3/2006 | Berman et al. |
| 2006/0063584 | A1 | 3/2006 | Brill et al. |
| 2006/0068875 | A1 | 3/2006 | Cregan et al. |
| 2006/0068882 | A1 | 3/2006 | Baerlocher et al. |
| 2006/0068883 | A1 | 3/2006 | Randall et al. |
| 2006/0068884 | A1 | 3/2006 | Baerlocher et al. |
| 2006/0068885 | A1 | 3/2006 | Cregan et al. |
| 2006/0073872 | A1 | 4/2006 | B-Jensen et al. |
| 2006/0073876 | A1 | 4/2006 | Cuddy |
| 2006/0073879 | A1 | 4/2006 | Baerlocher |
| 2006/0084492 | A1 | 4/2006 | Baerlocher et al. |
| 2006/0084493 | A1 | 4/2006 | Pederson et al. |
| 2006/0084494 | A1 | 4/2006 | Belger et al. |
| 2006/0084498 | A1 | 4/2006 | Baerlocher et al. |
| 2006/0089191 | A1 | 4/2006 | Singer et al. |
| 2006/0116195 | A1 | 6/2006 | Baerlocher et al. |
| 2006/0135247 | A1 | 6/2006 | Baerlocher et al. |
| 2006/0154714 | A1 | 7/2006 | Montross et al. |
| 2006/0172795 | A1 | 8/2006 | Bussick et al. |
| 2006/0172796 | A1 | 8/2006 | Vancura et al. |
| 2006/0199636 | A1 | 9/2006 | Ching et al. |
| 2006/0199637 | A1 | 9/2006 | Ching et al. |
| 2006/0264254 | A1 | 11/2006 | Aoki |
| 2007/0004489 | A1 | 1/2007 | Rodgers et al. |
| 2007/0010316 | A1 | 1/2007 | Baerlocher et al. |
| 2007/0021175 | A1 | 1/2007 | Rodgers et al. |
| 2007/0021187 | A1 | 1/2007 | Gauselmann |
| 2007/0021188 | A1 | 1/2007 | Rodgers et al. |
| 2007/0026923 | A1 | 2/2007 | Muir |
| 2007/0060246 | A1 | 3/2007 | Baerlocher et al. |
| 2007/0060248 | A1 | 3/2007 | Rodgers et al. |
| 2007/0060255 | A1 | 3/2007 | Rodgers et al. |
| 2007/0060294 | A1 | 3/2007 | Cuddy et al. |
| 2007/0087812 | A1 | 4/2007 | Glavich et al. |
| 2007/0232382 | A1 | 10/2007 | Berman |
| 2007/0232383 | A1 | 10/2007 | Berman |
| 2007/0287523 | A1 | 12/2007 | Esses et al. |
| 2008/0045303 | A1* | 2/2008 | Dunaevsky et al. ..... 463/20 |
| 2008/0045309 | A1 | 2/2008 | Okada |
| 2008/0045322 | A1 | 2/2008 | Berman |
| 2008/0045323 | A1 | 2/2008 | Berman |
| 2008/0051174 | A1 | 2/2008 | Fiden |
| 2008/0064485 | A1 | 3/2008 | Tedsen et al. |
| 2008/0090655 | A1 | 4/2008 | Marks et al. |
| 2008/0102931 | A1 | 5/2008 | Marks |
| 2008/0108409 | A1 | 5/2008 | Cole et al. |
| 2008/0108411 | A1 | 5/2008 | Jensen et al. |
| 2008/0113735 | A1 | 5/2008 | Maya |
| 2008/0113765 | A1 | 5/2008 | DeWaal |
| 2008/0132320 | A1 | 6/2008 | Rodgers |
| 2008/0139298 | A1 | 6/2008 | Rodgers |
| 2008/0161097 | A1 | 7/2008 | Baerlocheret et al. |
| 2008/0176620 | A1 | 7/2008 | Berman et al. |
| 2008/0176634 | A1 | 7/2008 | Berman et al. |
| 2008/0182644 | A1 | 7/2008 | Lutnick et al. |
| 2008/0188278 | A1 | 8/2008 | Paulsen et al. |
| 2008/0200232 | A1 | 8/2008 | Baerlocher et al. |
| 2008/0207305 | A1 | 8/2008 | Cregan et al. |
| 2008/0214283 | A1 | 9/2008 | Cregan et al. |
| 2008/0227541 | A1 | 9/2008 | Berman et al. |
| 2008/0287178 | A1 | 11/2008 | Berman et al. |
| 2008/0287179 | A1 | 11/2008 | Berman et al. |
| 2009/0124342 | A1 | 5/2009 | Fong |
| 2009/0227337 | A1 | 9/2009 | Langille et al. |
| 2011/0130193 | A1 | 6/2011 | Belger et al. |

FOREIGN PATENT DOCUMENTS

| | | |
|---|---|---|
| AU | 199917318 | 9/1999 |
| AU | 755879 | 2/2001 |
| EP | 1 184 822 | 7/1982 |
| EP | 058488 | 8/1982 |
| EP | 0 060 019 | 9/1982 |
| EP | 0 874 337 | 10/1998 |
| EP | 0 981 119 | 2/2000 |
| EP | 0 984 408 | 3/2000 |
| EP | 1 063 622 | 12/2000 |
| EP | 1 205 894 | 10/2001 |
| EP | 1 422 673 | 5/2004 |
| EP | 1 513 117 | 3/2005 |
| GB | 1 454 046 | 10/1976 |
| GB | 2 062 922 | 5/1981 |
| GB | 2 062 923 | 5/1981 |
| GB | 2 106 293 | 9/1981 |
| GB | 2 081 952 | 2/1982 |
| GB | 2 090 690 | 7/1982 |
| GB | 2 096 376 | 10/1982 |
| GB | 2 097 160 | 10/1982 |
| GB | 2 100 905 | 1/1983 |
| GB | 2 105 891 | 3/1983 |
| GB | 2 106 295 | 4/1983 |
| GB | 2 113 881 | 8/1983 |
| GB | 2 117 155 | 10/1983 |
| GB | 2 137 392 | 10/1984 |
| GB | 2 161 008 | 1/1986 |
| GB | 2 165 385 | 4/1986 |
| GB | 2 170 636 | 8/1986 |
| GB | 2 181 589 | 4/1987 |
| GB | 2 183 882 | 6/1987 |
| GB | 2 191 030 | 12/1987 |
| GB | 2 180 087 | 8/1989 |
| GB | 2 222 712 | 3/1990 |
| GB | 2 243 236 | 4/1990 |
| GB | 2 225 889 | 6/1990 |
| GB | 2 226 436 | 6/1990 |
| GB | 2 242 300 | 9/1991 |
| GB | 2 262 642 | 6/1993 |
| GB | 2 322 217 | 8/1998 |
| GB | 2 335 524 | 9/1999 |
| GB | 2 372 132 | 2/2001 |
| GB | 2 372 617 | 8/2002 |
| GB | 2 393 555 | 3/2004 |
| WO | WO 97/32285 | 9/1997 |
| WO | WO 98/20949 | 5/1998 |
| WO | WO 00/30727 | 6/2000 |
| WO | WO 00/32286 | 6/2000 |
| WO | WO 00/66235 | 11/2000 |
| WO | WO 00/76606 | 12/2000 |
| WO | WO 01/26019 | 4/2001 |
| WO | WO 03/026756 | 4/2003 |
| WO | WO 03/026759 | 4/2003 |
| WO | WO 2004/025584 | 3/2004 |
| WO | WO 2005/028043 | 3/2005 |
| WO | WO 2006/063290 | 6/2006 |
| WO | WO 2006/076294 | 7/2006 |
| WO | WO 2007/002935 | 1/2007 |
| WO | WO 2007/053349 | 5/2007 |

(56) References Cited

FOREIGN PATENT DOCUMENTS

| | | |
|---|---|---|
| WO | WO 2007/084766 | 7/2007 |
| WO | WO 2007/130443 | 11/2007 |
| WO | WO 2007/130444 | 11/2007 |

OTHER PUBLICATIONS

A Study in Slot Machine Research and Development, written by John Brokopp, published at www.casinocitytimes.com on Nov. 30, 2005.
All That Glitters website, written by WMS Gaming, published on or before Nov. 2007.
Barn Yard Article, written by Strictly Slots, Aristocrat Technology, published Mar. 2002.
Bejeweled Web page, written by PopCap Games, http://www.popcap.com, published prior to Sep. 9, 2005.
Black Swan Paytable Display written by IGT, published prior to 2001.
Break the Spell Advertisement written by Atronic Casino Technology, Ltd., published in 1999.
Cash Chameleon Article written by Strictly Slots/Aristocrat Leisure Industries, PTY Ltd., published in Apr. 2001.
Catch a Wave Advertisement written by IGT, published in Dec. 2000.
Cossack Dance Advertisement written by Olympic Video Gaming, published prior to 2002.
Description of Expanding Symbol, written by IGT, published Sep. 1999.
Description of Gaming Machine with Animating Symbols, written by IGT, published Jan. 2000.
Description of Symbol Feature in Australian UFO Gaming Machine, written by Barcrest, Ltd., published 1995.
Description of Traveling Symbols, written by IGT, published Sep. 1999.
Double Diamond Line Advertisement written by Bally Gaming Systems, published in 2000.
Easy Street Advertisements and Articles, written by Casino Data Systems, published in 2000.
Enchanted Forest™ Gaming Description from Aristocrat, available in 1994.
Enchanted Unicorn Advertisement written by IGT, published in 2001.
Fishin' Buddies Article published in Strictly Slots/Anchor Games, published in Apr. 2001.
Ghoulish Gamble Article, written by Strictly Slots, IGT, Sep. 2000.
Gold Fever Advertisement, written by Atronic Casino Technology, Ltd., published 1999.
Gold Fever Atronic Web page, written by Atronic Casino Technology, published Mar. 2002.
Goooaal! pp. 1-2, written by Bally Gaming, Inc., published Dec. 2000.
It's a Blast, written by IGT, published on or before Dec. of 2004.
Jewel in the Crown Advertisements, written by Barcrest Ltd., published 1999.
Joker's Wild Advertisement written by IGT, published prior to 2001.
"Juice Loot" by Bally Technologies, article from Strictly Slots, published Feb. 2008.
Kaboom Web page, written by WMS Gaming, http://www.wmsgaming.com/products/video/kaboom/index.php, published prior to Sep. 9, 2005.
Loco Loot Article written by Strictly Slots/Aristocrat Leisure Industries, PTY Ltd., published in May 2002.
Marshall Fey, Slot Machines a pictorial History of the First 100 Years, Liberty Bell Books, pp. 79, 150, 171, 231, published 1983.
Mountain Money Article written by Strictly Slots/Aristocrat Leisure Industries, PTY Ltd., published in Jun. 2002.
Mystery Mine Advertisement, Konami Australia Pty. Ltd., published Jan. 1999.
On the House Advertisement written by Olympic Video Gaming, published prior to 2002.
Penguin Pays Advertisement written by Aristocrat Incorporated, published in 1998.
Punch-a-Bunch/The Punch Board, [http://gscentral.net/punch.htm], pp. 1-6.
Reel Magic™ Gaming Machine Description written by IGT, available in 1986.
South Park Advertisement, written by IGT, published Sep. 1999.
Wild Bear Salmon Run Advertisement written by IGT, published in 2003.
Wild Streak Advertisement written by WMS Gaming, Inc., published in 2001.
Wolf Run Video Slots Advertisement, written by IGT, published prior in 2006.
Your Real Key to Gaming Success Advertisement (including Roll Over Beethoven and Wild Fortune) written by Olympic Video Gaming, published date unknown.

* cited by examiner

GAMING SYSTEM, GAMING DEVICE, AND GAMING METHOD FOR SHIFTING SYMBOLS FROM A STAGING AREA TO A SYMBOL MATRIX

PRIORITY CLAIM

This application is a continuation of, claims priority to and the benefit of U.S. patent application Ser. No. 12/549,082, filed on Aug. 27, 2009, which is a continuation-in-part application of, claims priority to and the benefit of U.S. patent application Ser. No. 11/937,770, filed on Nov. 9, 2007, now U.S. Pat. No. 8,162,741, the entire contents of which are incorporated herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

In such known gaming machines, the amount of the wager made on the base game by the player may vary. For instance, the gaming machine may enable the player to wager a minimum number of credits, such as one credit (e.g., one cent, nickel, dime, quarter or dollar) up to a maximum number of credits, such as five credits. This wager may be made by the player a single time or multiple times in a single play of the primary game. For instance, a slot game may have one or more paylines and the slot game may enable the player to make a wager on each payline in a single play of the primary game. Thus, it is known that a gaming machine, such as a slot game, may enable players to make wagers of substantially different amounts on each play of the primary or base game ranging, for example, from one credit up to 125 credits (e.g., five credits on each of 25 separate paylines). This is also true for other wagering games, such as video draw poker, where players can wager one or more credits on each hand and where multiple hands can be played simultaneously. Accordingly, it should be appreciated that different players play at substantially different wagering amounts or levels and at substantially different rates of play.

Another known gaming machine includes game elements that are assigned to a single matrix of game element locations. In this gaming machine, play is initiated by evaluating the game elements for predetermined transformative conditions, such as a match of game elements. If a transformative condition is found, the game element(s) are transformed with at least one being removed from the single matrix. The remaining game elements are moved, if permitted, according to a movement methodology. The steps of evaluating, transforming, removing, and moving the remaining game elements are repeated so long as a transformation is subsequently available for continued gameplay. Such games have been relatively popular, though they are hampered by their inherently limited volatility due in part to the limited number of paylines. There is a continuing need to provide new and different gaming machines with such features that increase volatility and therefore increase player excitement.

SUMMARY

The gaming system, gaming device, and gaming method disclosed herein provide a game having the removal and replacement of symbols from a plurality of linked sets of symbols in an integrated manner.

In various embodiments, the gaming device includes a plurality of matrices of symbol positions. In one such embodiment, each matrix of symbol positions is formed from a different set of a plurality of reels. In one embodiment, at least a first reel in a first reel set is associated with or linked to at least a first reel in a second reel set and at least a second reel in the first reel set not associated with or linked to any reel in any second reel set. In a play of the game, symbols are independently generated for each reel set and the symbols displayed for each reel set are independently evaluated to provide any awards for any winning symbols or winning symbol combinations. After the evaluation, the gaming device removes zero, one, or more symbols from reels in the reel sets to leave zero, one, or more empty symbol positions. In one embodiment, if any empty symbol positions are formed on the first reel in the second reel set, the gaming device shifts or transfers one or more symbols from the first reel of the first reel set to the linked first reel of the second reel set to occupy the one or more empty symbol positions. In this embodiment, if there are any empty symbol positions on the second reel of the second reel set, the gaming device does not shift or transfer any symbols from the second reel of the first reel set to the second reel of the second reel set. The gaming device then generates symbols to fill the empty symbol positions in the reel sets and the symbols displayed for each reel set are independently evaluated to provide any awards for any winning symbols or winning symbol combinations. In one embodiment, it should be appreciated that this gaming device utilizes a symbol initially generated from a symbol map of one reel set to determine an award with a plurality of symbols initially generated from another symbol map of another reel set. Such a configuration provides the player with additional opportunities to win awards in association with multiple reel sets.

In one embodiment, the gaming system, gaming device, and gaming method disclosed herein include a plurality of matrices. In one embodiment, each matrix is formed by the reels in a reel set such that the gaming device includes a plurality of reel sets. In one such embodiment, the reel sets are arranged such that at least one reel in each reel set is linked to at least one reel in another reel set. In one example embodiment, a gaming device has two reel sets, wherein a first reel from the first reel set is linked to and displayed as aligned with a first reel from the second reel set. In this example, a second reel in the first reel set is not linked to any second reel in the second reel set.

In operation of one embodiment of the gaming device disclosed herein, for each individual reel set, the gaming device generates and displays a plurality of symbols in a plurality of symbol positions on the reels. The symbols are generated independently for each of the plurality of reel sets. That is, initial generation of symbols in the symbol positions on the reels in each reel set does not depend on the generation of symbols in the symbol positions on reels in any other reel set. In one embodiment, the symbols available differ for each reel set. In operation of one such embodiment, symbols generated in one reel set cannot be part of a winning symbol combination for the reel set in which they are generated, but can be part of a winning symbol combination for another reel set. That is, it is only after certain symbols are shifted from the reel set in which they were generated to another reel set that they can become part of a winning symbol combination. In another embodiment, when certain symbols from one reel set form a winning symbol combination with symbols from another reel set, a greater award is provided than when these symbols form winning symbol combinations with the symbols from the same reel set in which they were generated initially. In another embodiment, the gaming device generates symbols in one reel set that cannot be generated in another reel set.

The gaming device analyzes the symbols generated to determine any winning symbols or winning symbol combinations. For each of any winning symbols or winning symbol combinations generated, the gaming device provides the player an award associated with the generated winning symbol or winning symbol combination. In one embodiment, if there are any winning symbols or winning symbol combinations, the gaming device removes one or more of the symbols from one or more of any determined winning symbol combinations, thus leaving one or more of the reels with at least one empty symbol position.

In one embodiment, for each empty symbol position on a reel that is linked to at least another reel in another reel set, the gaming device shifts or transfers one or more symbols generated on one of the reels to the empty symbol position on the reel linked to the reel with an empty symbol position. In the example embodiment described above, if a symbol is removed from a symbol position on a first reel in the second reel set (and the first reel of the second reel set is linked to the first reel in the first reel set), the gaming device shifts or transfers one or more symbols generated on the first reel of the first reel set and/or one or more symbols generated on the first reel of the second reel set such that one of the transferred symbols fills the empty position. For example, if the gaming device generates a cherry symbol on the first reel in the first reel set and an empty symbol position occurs on the first reel in the second reel set (which is linked to the first reel in the first reel set), the gaming device shifts or transfers the cherry symbol from the first reel in the first reel set to the empty symbol position on the first reel in the second reel set. In one embodiment, the gaming device repeats this shifting or transferring for zero, one, or more symbols for any empty symbol positions on the linked reels in the reel sets.

In one embodiment, for each empty symbol position on a reel in a reel set that is not linked to at least one reel in another reel set, the gaming devices shifts or transfers one or more symbols generated on the non-linked reel to the empty symbol position on the same reel. In the example described above, if a symbol is removed from a second reel in the first reel set (that is not linked to any reel in the second reel set), the gaming device shifts or transfers a symbol generated in a symbol position on the second reel in the first reel set to replace the removed symbol from the second reel in the first reel set. In this embodiment, the gaming device does not shift or transfer symbols from the second, non-linked reel in the first reel set to fill the empty symbol position of the second reel in the second reel set. For example, if the gaming device generates a cherry symbol on the second reel in the first reel set and an empty symbol position occurs on the second reel in the second reel set (which is not linked to the second reel in the first reel set), the gaming device shifts or transfers symbols within the second reel in the second reel set and does not shift or transfer the cherry symbol from the second reel in the first reel set to the second reel in the second reel set.

After shifting or transferring one or more generated symbols to fill any removed symbol positions, the gaming device generates and displays a symbol in each empty symbol position previously occupied by a shifted or transferred symbol. The gaming device proceeds in determining any winning symbols or winning symbol combinations, removing any symbols, and shifting any symbols as described above until no winning symbol or winning symbol combination is displayed. In an alternative embodiment, the gaming device proceeds as described above and analyzes the symbols generated to determine any winning symbols or winning symbol combinations. In this embodiment, rather than removing symbols, the gaming device provides the player an award associated with the generated winning symbol or winning symbol combination and ends the game.

In one such embodiment, for a first reel in the first reel set that is linked to a first reel in the second reel set, the gaming device shifts or transfers each of the symbols on the first reel in the first reel set and each of the symbols on the first reel in the second reel set by one or more symbol positions. In one example embodiment, the gaming device shifts or transfers one or more symbols from the first reel in the first reel set to the first reel in the second reel set, and removes one or more symbols from the first reel of the second reel set. When performing this shift or transfer, the gaming device creates one or more empty symbol positions on the first reel of the first reel set. For example, if the gaming device generates a cherry symbol on the first reel in the first reel set, the gaming device shifts or transfers at least the cherry symbol from the first reel of the first reel set to the first reel of the second reel set (which is linked to the first reel of the first reel set). Moreover, the gaming device shifts or transfers each symbol in the first reel of the first reel set by at least one symbol position within the first reel of the first reel set, creating at least one empty symbol position on the first reel in the first reel set. The gaming device shifts or transfers each symbol on the first reel of the second reel set by at least one symbol position within the first reel of the second reel set. At least one symbol on the first reel in the second reel set is removed from the first reel of the second reel set as a result of the shift or transfer in the above example.

In another embodiment, for each reel in any reel set that is not linked to at least another reel in another reel set, the gaming device does not perform a shift or transfer. In an alternative embodiment, the gaming device performs a shift or transfer within a reel in a reel set that is not linked to another reel in another reel set. In this embodiment, each symbol on a reel in a reel set not linked to another reel in another reel set is shifted or transferred by at least one position in a given direction. Also in this embodiment, at least one symbol is removed from the reel in the reel set not linked to another reel in another reel set. In this embodiment, the gaming device does not shift or transfer any symbols from the reel in the reel set not linked to another reel in another reel set to any other reel in any other reel set.

In one embodiment, after performing a shift or transfer, the gaming device generates and displays a symbol in each empty symbol position previously occupied by any shifted or transferred symbol. In one embodiment, the gaming device proceeds in determining any winning symbols or winning symbol combinations and shifting or transferring as described above until no winning symbol or winning symbol combination as described above.

Accordingly, in one embodiment the gaming device disclosed herein provides for one or more symbols initially generated by a first reel of a first reel set to be utilized in an award determination linked to a different reel of a different reel set. That is, this gaming device utilizes a symbol initially generated from a symbol map of one reel set to determine an award with a plurality of symbols initially generated from another symbol map of another reel set. By shifting or transferring a symbol from one reel set to another reel set, the gaming device disclosed herein provides increased volatility over prior, single reel set gaming devices. Such a configuration provides the player with additional opportunities to win awards in association with multiple reel sets.

In another embodiment, the gaming device disclosed herein displays a matrix of symbol positions, each symbol position configured to display one of a plurality of symbols for one or more plays of a game. In this embodiment, the disclosed gaming device also displays one or more symbol staging areas. Each symbol staging area includes one or more supplemental symbol potentially shiftable into one or more empty symbol positions of the matrix of symbol positions. In one embodiment, the supplemental symbols are relatively more likely to be relatively higher valued symbols (e.g., major symbols) usable to form winning symbol combinations associated with relatively high-valued awards than the symbols generated and displayed in the symbol matrix. In one embodiment, the gaming device randomly determines the supplemental symbols to display in the one or more symbol staging area(s) for each play of the game. In another embodiment, the supplemental symbols displayed in the one or more symbol staging area(s) persist for more than one play of the game.

In one embodiment, the gaming device disclosed herein is configured to shift one or more supplemental symbols into one or more empty symbol positions of a symbol matrix from one or more symbol staging areas. In this embodiment, instead of shifting symbols from a reel in a first reel set to another, associated reel in a second reel set, as discussed above, the gaming device shifts one or more supplemental symbols from one or more symbol staging areas associated with a symbol matrix into any empty symbol positions created in the symbol matrix during a play of a game. In one embodiment, shifting one or more supplemental symbols into the symbol matrix increases the likelihood of forming a winning symbol combination utilizing symbols which are relatively likely to form a winning symbol combination associated with a relatively high-valued award.

In one embodiment, an indicated supplemental symbol is the supplemental symbol currently displayed in a designated location of the staging area such that the indicated supplemental symbol will be the next supplemental symbol to be shifted into an empty symbol position of the symbol matrix. In one embodiment, each symbol staging area includes one indicated supplemental symbol which is potentially shiftable into an empty symbol position regardless of the location of the empty symbol position within the symbol matrix. In another embodiment, each symbol staging area includes a plurality of indicated supplemental symbols. In this embodiment, the gaming device determines which of the plurality of indicated supplemental symbols to shift into the symbol matrix based on the location of any empty symbol positions within the symbol matrix. In one embodiment, wherein the gaming device displays more than one symbol staging area for a play of the game, the gaming device also displays a symbol staging area indicator configured to indicate one or more of the symbol staging areas. In various embodiments, the symbol staging areas enable the gaming device to horizontally shift one or more symbols into one or more empty symbol positions of the symbol matrix, increasing the probability of generating additional winning symbol combinations after an initial generation of symbols for a play of a game.

In operation of one embodiment, for a play of the game, the gaming device generates and displays a symbol in each of the symbol positions of the symbol matrix. The gaming device evaluates the symbols generated and displayed in the symbol matrix to determine whether any winning symbol combinations are displayed. In one embodiment, if any winning symbol combination is displayed, the gaming device provides the player with an award for the play of the game. In this embodiment, the gaming device removes at least one symbol of any displayed winning symbol combination, resulting in at least one empty symbol position in the symbol matrix.

In various embodiments, the gaming device also displays a plurality of supplemental symbols in the one or more symbol staging area(s) for use during the play of the game. In one such embodiment, the gaming device generates at least one supplemental symbol and displays that generated supplemental symbol in the symbol staging area. In another such embodiment, the gaming device utilizes a plurality of supplemental symbols already generated and displayed for a previous play of the game. That is, in one embodiment, at least one supplemental symbol displayed in a symbol staging area persists from a first play of the game to a second, subsequent play of the game. In operation of these embodiments, the gaming device fills any empty symbol positions created by removing symbols from any winning symbol combinations by shifting one or more indicated supplemental symbols from one of the symbol staging areas into one or more empty symbol positions of the symbol matrix. In one such embodiment, the gaming device shifts an indicated supplemental symbol from one of the symbol staging areas directly into the empty symbol position, regardless of a location of the empty symbol position in the symbol matrix. In another embodiment, the gaming device shifts one or more symbols displayed in the symbol matrix into one or more empty symbol positions (resulting in one or more different empty symbol positions of the symbol matrix), and then shifts one or more indicated supplemental symbols from one of the symbol staging areas into the newly-formed empty symbol position of the symbol matrix.

In one embodiment, the gaming device shifts a single supplemental symbol into any empty symbol position of the symbol matrix, regardless of the location of that empty symbol position within the symbol matrix. In another embodiment, a different indicated supplemental symbol is associated with a subset of the symbol positions of the symbol matrix, such as a row of the symbol matrix, and the indicated supplemental symbol associated with a subset is utilized to fill any empty symbol positions in that subset. In one embodiment, wherein the gaming device displays a plurality of symbol staging areas, the gaming device indicates one of the plurality of symbol staging areas for use in filling the empty symbol position(s) prior to shifting any symbols from any symbol staging areas into the symbol matrix.

In one embodiment, after filling any empty symbol positions, the gaming device evaluates the symbols of the symbol matrix to determine whether any winning symbols or winning symbol combinations are displayed. In one embodiment, if any winning symbols or winning symbol combinations are displayed, the gaming device provides the player an additional award and ends the play of the game. In another embodiment, if any winning symbols or winning symbol combinations are displayed, the gaming device removes one or more symbols from the winning symbol or winning symbol combination, and repeats the process described above to fill the empty symbol position(s) utilizing the supplemental symbols. In one embodiment, if a newly-generated winning symbol combination includes one or more supplemental symbols, wherein the supplemental symbols are relatively likely to be high-valued symbols such as major symbols, the gaming device provides a player with a relatively high probability of receiving a relatively high-valued award for play of the game.

Accordingly, in one embodiment, the gaming device enhances the excitement and enjoyment experienced by a player during a play of the game because the symbol staging areas provide symbols which are not evaluated to determine winning symbol combinations, but which are usable to fill empty symbol positions created during plays of the game. In one embodiment, such symbol staging areas enable the gaming device to introduce higher-valued symbols, or symbols which are more likely to form winning symbol combinations, upon an evaluation that a winning symbol or winning symbol combination is displayed in the symbol matrix. In one embodiment, the gaming device is configured to introduce a plurality or block of designated symbols (such as wild symbols) via the symbol staging areas such that the introduction of each designated symbol (i.e., to fill an empty symbol position) increases the likelihood of additional wins or higher-valued wins. In one embodiment, the gaming device enables horizontal shifting to occur based on a plurality of supplemental symbols displayed in a selected one of one or more symbol staging areas, such that the probability of generating additional winning symbols or additional winning symbol combinations is increased or enhanced for each new empty symbol position.

DETAILED DESCRIPTION

The present disclosure may be implemented in various configurations for gaming machines, gaming devices, or gaming systems, including but not limited to: (1) a dedicated gaming machine, gaming device, or gaming systems wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
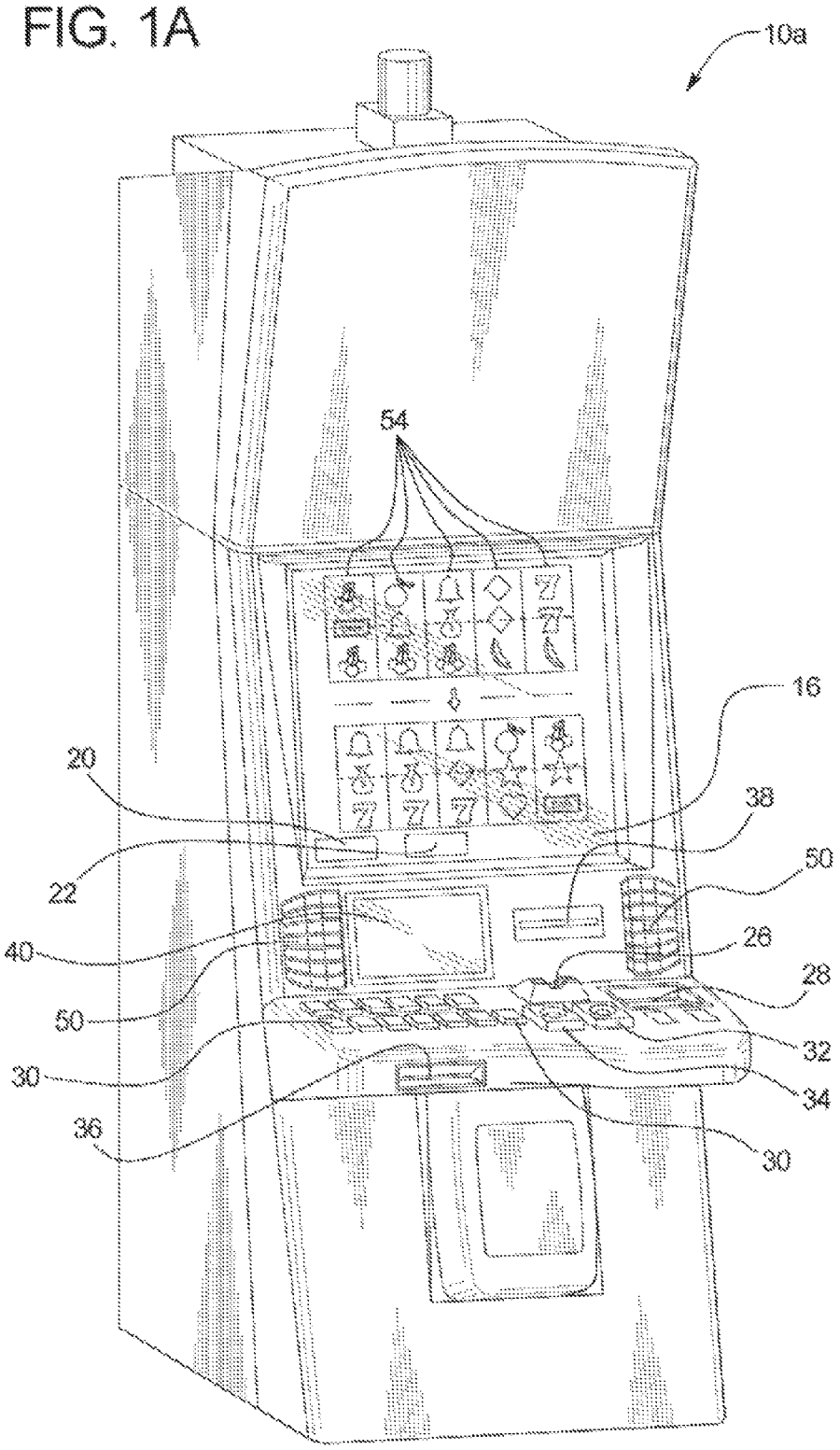
FIGS. 1A, 1B, and 1C are perspective views of alternative embodiments of the gaming device disclosed herein.
Figure 1B:
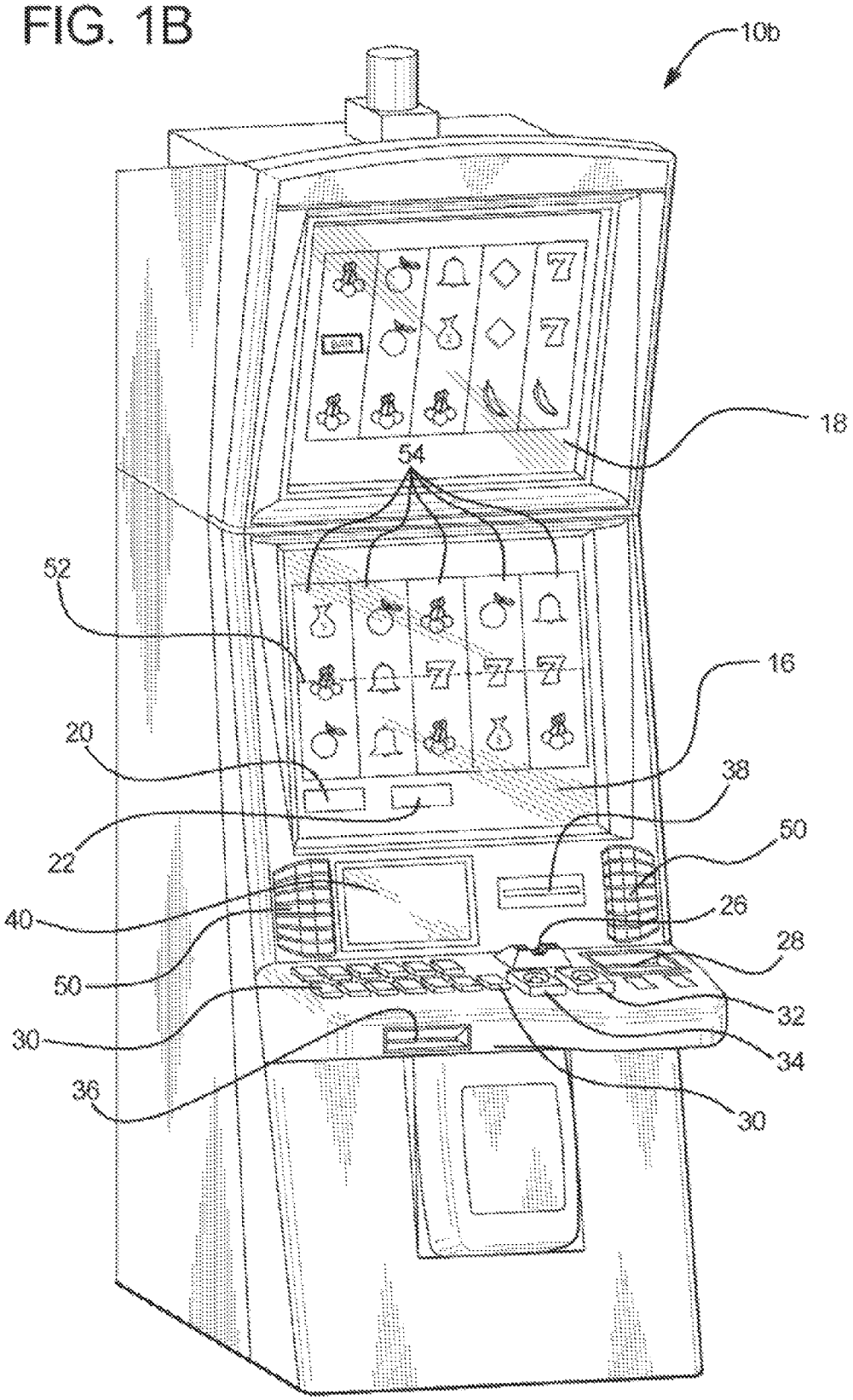

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
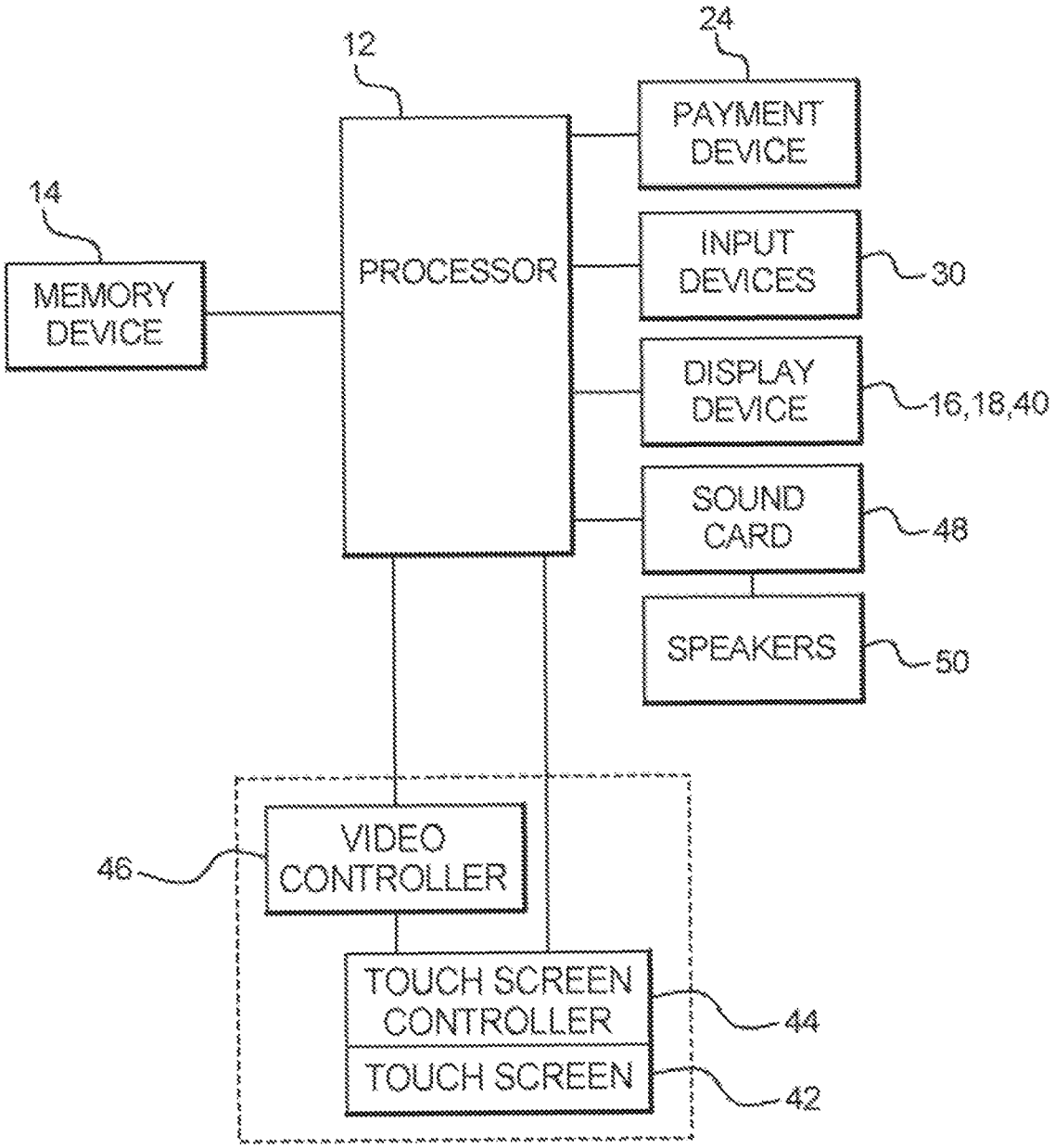
FIG. 2A is a schematic block diagram of the electronic configuration of one embodiment of the gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASICs). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. Moreover, as discussed in more detail below, central display device 16 and upper display device 18 may display one or more of the plurality of reel sets displayed by the gaming device. In one embodiment, the gaming device displays two reel sets, a first reel set displayed on central display device 16 and a second display device displayed on upper display device 18. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

Figure 1C:
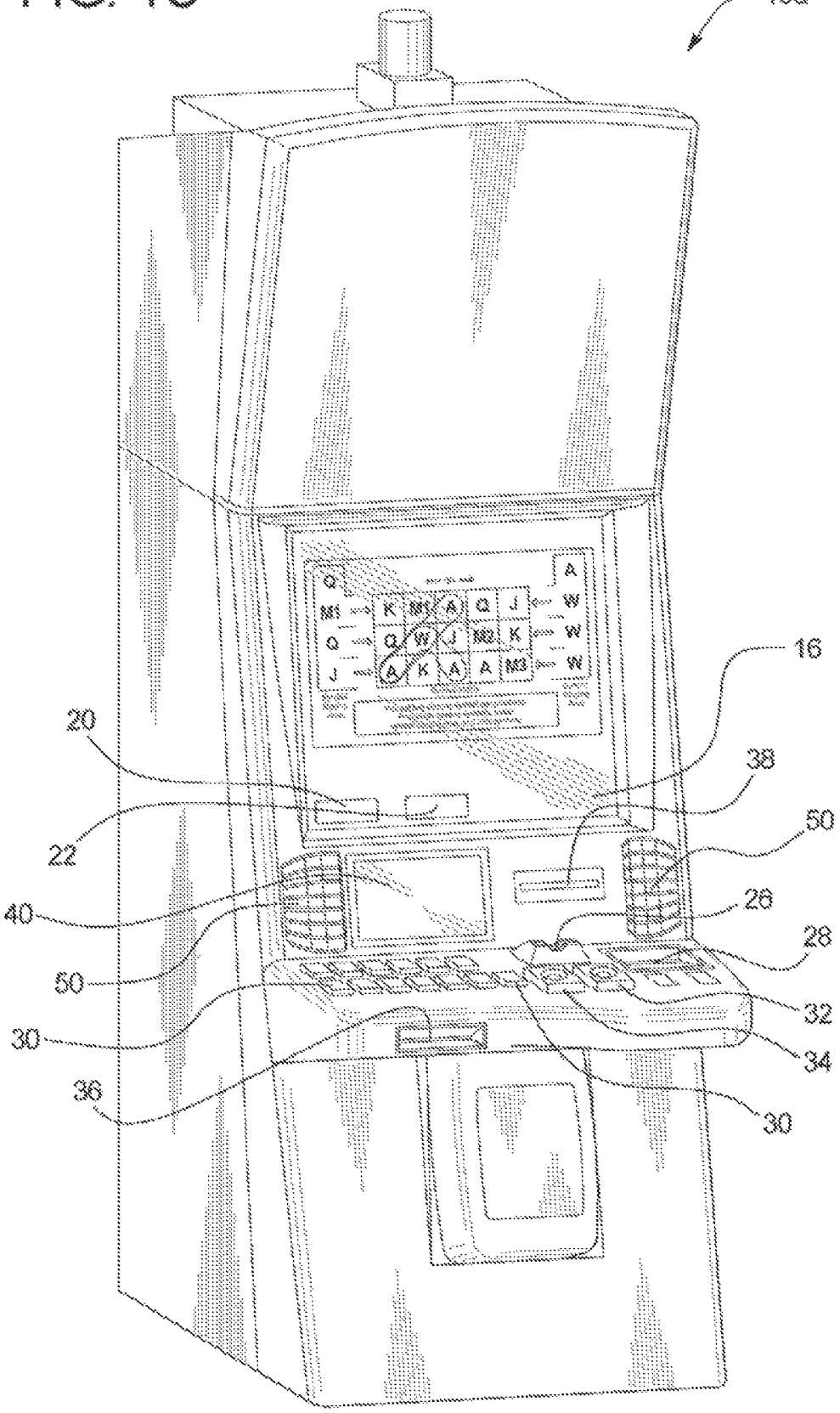

FIG. 1C illustrates another embodiment of the gaming system disclosed herein. Specifically, in the embodiment illustrated in FIG. 1C, the gaming device displays a symbol matrix and a plurality of supplemental symbol staging areas, each of the supplemental symbol staging areas including a plurality of supplemental symbols potentially shiftable into one or more empty symbol positions of the symbol matrix, on display device 16. The embodiment illustrated in FIG. 1C will be discussed in greater detail below.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data), and other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. In one embodiment, if the reel game disclosed herein is a bonus or secondary game, the primary or base game may comprise any suitable reel-type game, card game, cascading or falling symbol game, number game, or other game of chance susceptible to representation in an electronic form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in video form with simulated reels and movement thereof. In one embodiment, the slot game includes a plurality of reel sets, as disclosed herein, with each reel set including a plurality of reels. In this embodiment, the embodiments described below apply to each reel set of the plurality of reel sets.

In one embodiment, if the reels 54 are in video form, one or more of the display devices, as described above, displays the plurality of simulated video reels 54. In another embodiment, as described above, the display devices display the plurality of reel sets. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, when the slot game described herein is provided as a bonus or secondary game, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, when the slot game disclosed herein is provided as a bonus or secondary game, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, when the slot game disclosed herein is provided as a bonus or secondary game, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, when the slot game described herein is the base or primary game, in addition to winning credits or other awards in the slot game disclosed herein, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
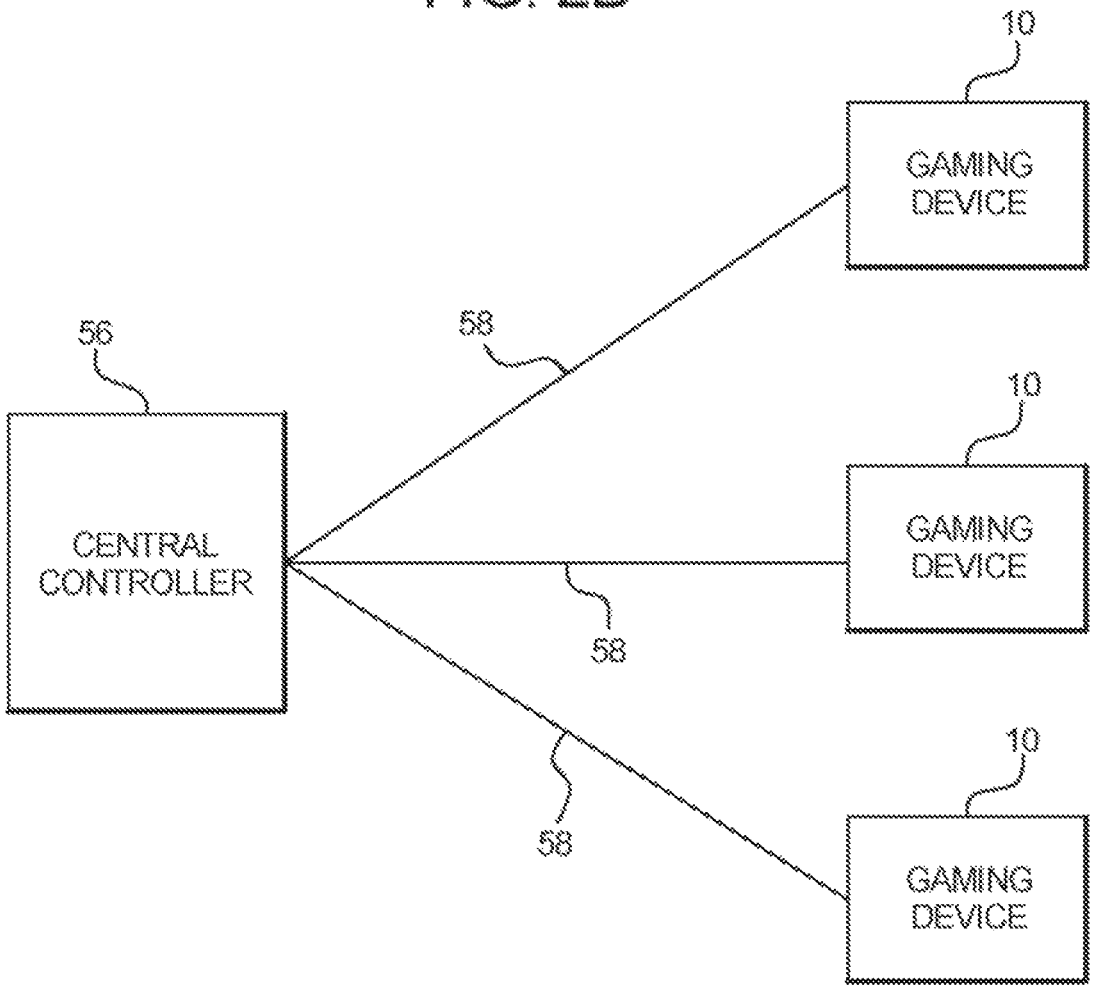
FIG. 2B is a schematic block diagram illustrating a plurality of gaming terminals in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno, or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Transferring Symbols Between Linked Reels in Multiple Reel Sets

Figure 3A:
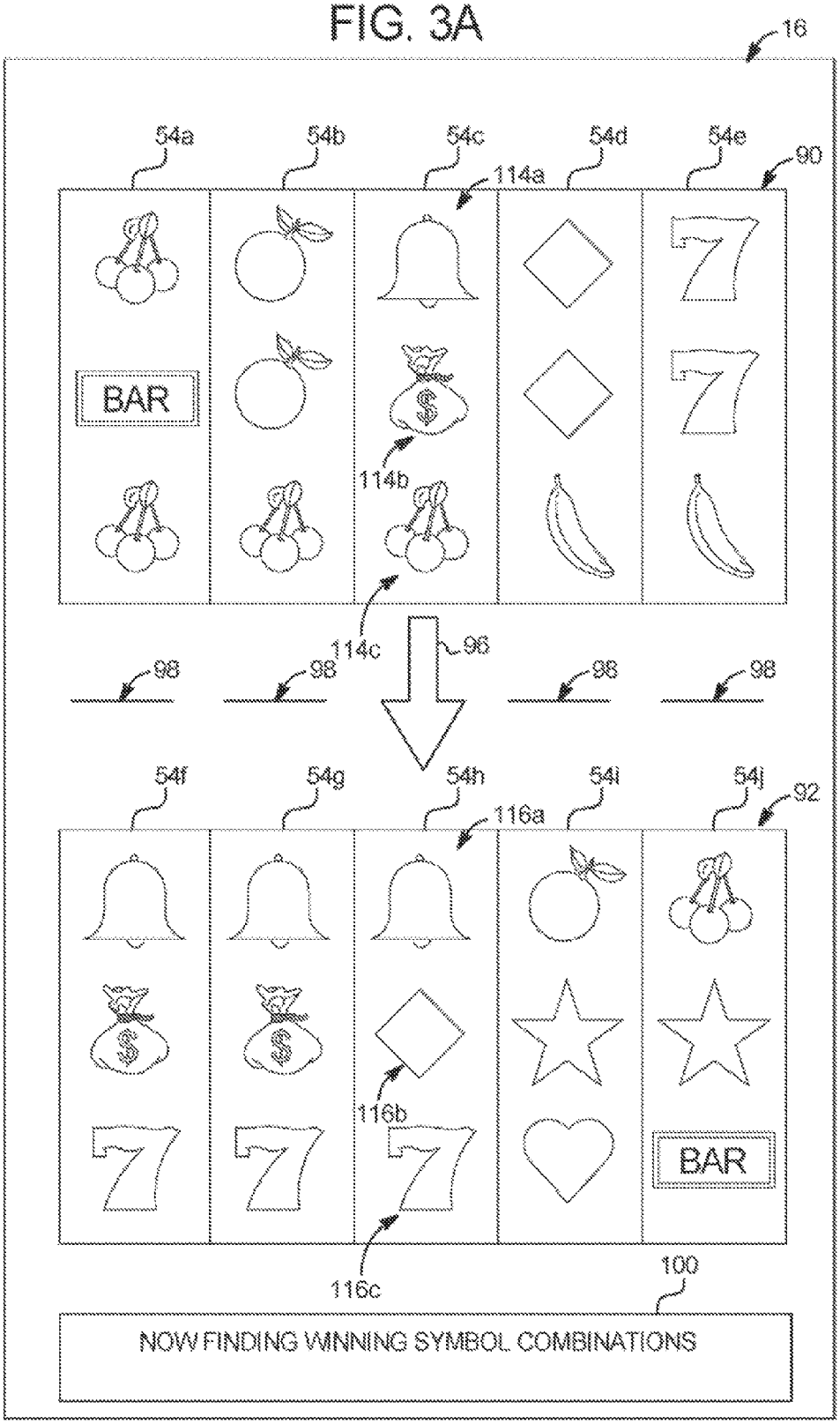
FIGS. 3A, 3B, 3C, 3D, and 3E are front elevation views of the display screen of one embodiment of the gaming device disclosed herein indicating the generation of symbols, determination of winning symbol combinations, removal of symbols, and shift or transfer of symbols from one reel to another, linked reel.

One embodiment of the gaming device disclosed herein displays a plurality of matrices as a plurality of independent reel sets. Each reel set includes a plurality of reels, and each reel includes a plurality of symbol positions. In one embodiment, a reel set is represented as a matrix of symbol positions, with each column corresponding to a reel in the reel set. FIG. 3A illustrates a gaming device including two matrices, with each matrix being indicated by reel set 90 or 92. As illustrated in FIG. 3A, the gaming device displays reel sets 90 and 92 on display screen 16. Display screen 16 contains message display area 100, in which the gaming device displays messages to the player throughout the course of a play of the game. Each reel set 90 and 92 contains five reels 54. For each reel set 90 and 92, the reels 54 are aligned vertically with respect to the gaming device. Reel set 90 is aligned with reel set 92 such that each reel 54 in reel set 90 lines up with one reel 54 in reel set 92. In one embodiment, the plurality of reel sets are displayed in close physical proximity and are displayed such that the reels in each of the plurality of reel sets are aligned with each other. In different embodiments, this alignment may be vertically, horizontally, diagonally, or in some other suitable alignment.

In one embodiment, the gaming device disclosed herein indicates to the player that at least a first reel in at least a first reel set is linked to at least a second reel in at least a second reel set. In one embodiment, the gaming device indicates this linking by the alignment of reels in the reel sets. In this embodiment, the reel sets are displayed in physical proximity and the first reel in the first reel set is aligned with the second reel in the second reel set. In another embodiment, the gaming device indicates which reels are linked by displaying an indicator on the display screen on which the reel sets are displayed.

In one embodiment, the player may cause more than one set of reels to be linked. In one embodiment, linking more than one set of reels increases the probability of generating additional winning symbol combinations after shifting or transferring. In this embodiment, the number of linked reels is based on a wager. If a player places a first wager, a first number of sets of reels are linked; if a player places a second, greater wager, a second, greater number of sets of reels are linked. In one embodiment, the player determines which additional sets of reels are linked together. In another embodiment, the gaming device randomly determines the additional reels to be linked.

As illustrated in FIG. 3A, reel 54*c* is linked to reel 54*h*. Reel 54*c* is aligned with reel 54*h*, and the gaming device communicates this linking to the player by way of indicator 96. As further illustrated, none of the other reels 54*a*, 54*b*, 54*d*, 54*e*, 54*f*, 54*g*, 54*i*, or 54*j* are linked to any other reel. Despite their alignment, the gaming device indicates that none of the other reels 54 are linked by displaying indicators 98. In one embodiment, the gaming device includes a plurality of reels of one reel set linked to a plurality of reels of another reel set. In one such embodiment, the first reel in the first reel set is linked to the first reel in the second reel set and a second reel in the first reel set is linked to a second reel in the second reel set. In one embodiment, each reel is aligned with each reel linked to it in a plurality of reel sets.

In one embodiment, each reel in each reel set includes a plurality of symbol positions. In one embodiment, after the player initiates play of the game by making a suitable wager, the gaming device generates and displays a symbol in each symbol position on each reel in the first reel set. The gaming device then independently generates and displays symbols for each of the plurality of reel sets. That is, the gaming device generates symbols to fill the symbol positions on the reels in each reel set separate from generation of symbols to fill the symbol positions on reels in any other reel set. In one embodiment, the generation and display of symbols for each reel set is separate by a discernable amount of time.

In one embodiment, the gaming device generates and displays the symbols from a symbol map that uniquely corresponds to each reel set. In another embodiment, the symbol maps for one or more of the reel sets contain symbols that are not contained on the symbol maps for any of the other reel sets. In operation of this embodiment, the gaming device generates and displays symbols in one reel set that cannot be generated or displayed in any other reel set. In still another embodiment, the symbols are generated for each reel based on a reel strip that may or may not be the same for more than one of the plurality of reels in one or more reel sets.

In another embodiment, the gaming device generates and displays the symbols from a symbol map that uniquely corresponds to each individual reel in each reel set. In one embodiment, if the gaming device detects an acceptable triggering event, the gaming device generates and displays symbols in the symbol positions of the reels in the remainder of the plurality of reel sets. In different embodiments, the determination of whether the triggering event occurs is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria. In one embodiment, the gaming device generates symbols for the reels in the first reel set, then pauses to enable the player to determine whether the player wishes to make an additional wager to activate the reels in a second reel set. In any embodiment, the generation and display of symbols for each of a plurality of reel sets is performed independently.

As illustrated in FIG. 3A, each reel 54 includes three symbol positions. As further illustrated in FIG. 3A, the symbols generated and displayed in the plurality of symbol positions on reel 54*c* are a bell symbol 114*a*, a moneybag symbol 114*b*, and a cherry symbol 114*c*. Additionally, the gaming device generates and displays a bell symbol 116*a*, a diamond symbol 116*b*, and a seven symbol 116*c* in the plurality of symbol positions on reel 54*h*. It should be appreciated that the gaming device may select and display any suitable symbol, and in one embodiment the symbols generated and displayed relate to the theme of the gaming device. As illustrated in FIG. 3A, in one embodiment, after generating the appropriate symbols, message display area 100 displays an appropriate message such as "NOW FINDING WINNING SYMBOL COMBINATIONS." In one embodiment, the gaming device communicates this message through another suitable audio or audiovisual display.

Figure 3B:
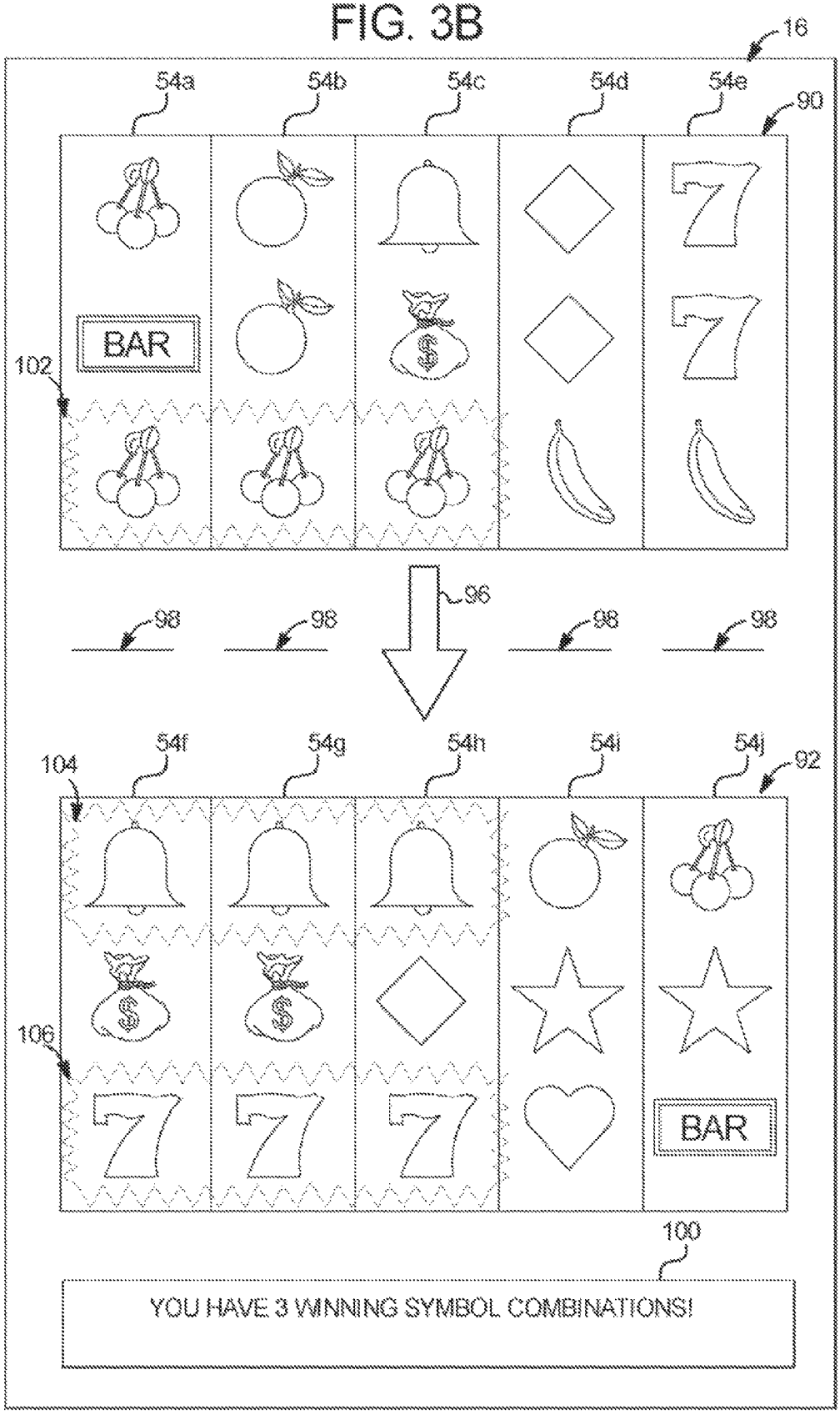

In one embodiment, the gaming device analyzes the symbols generated in the symbol positions to determine any winning symbol combinations. The gaming device indicates the winning symbol combinations to the player, and provides the player with any determined award. As illustrated in FIG. 3B, the gaming device indicates winning symbol combinations 102, 104, and 106 by highlighting lines representing the corresponding paylines. In one embodiment, the gaming device indicates the number of winning symbol combinations by displaying a message in display area 100 such as "YOU HAVE 3 WINNING SYMBOL COMBINATIONS!" In one embodiment, the gaming device communicates this message through another suitable audio or audiovisual display. After indicating the winning symbol combinations to the player, the gaming device provides the player with any awards corresponding to the winning symbol combinations.

Figure 3C:
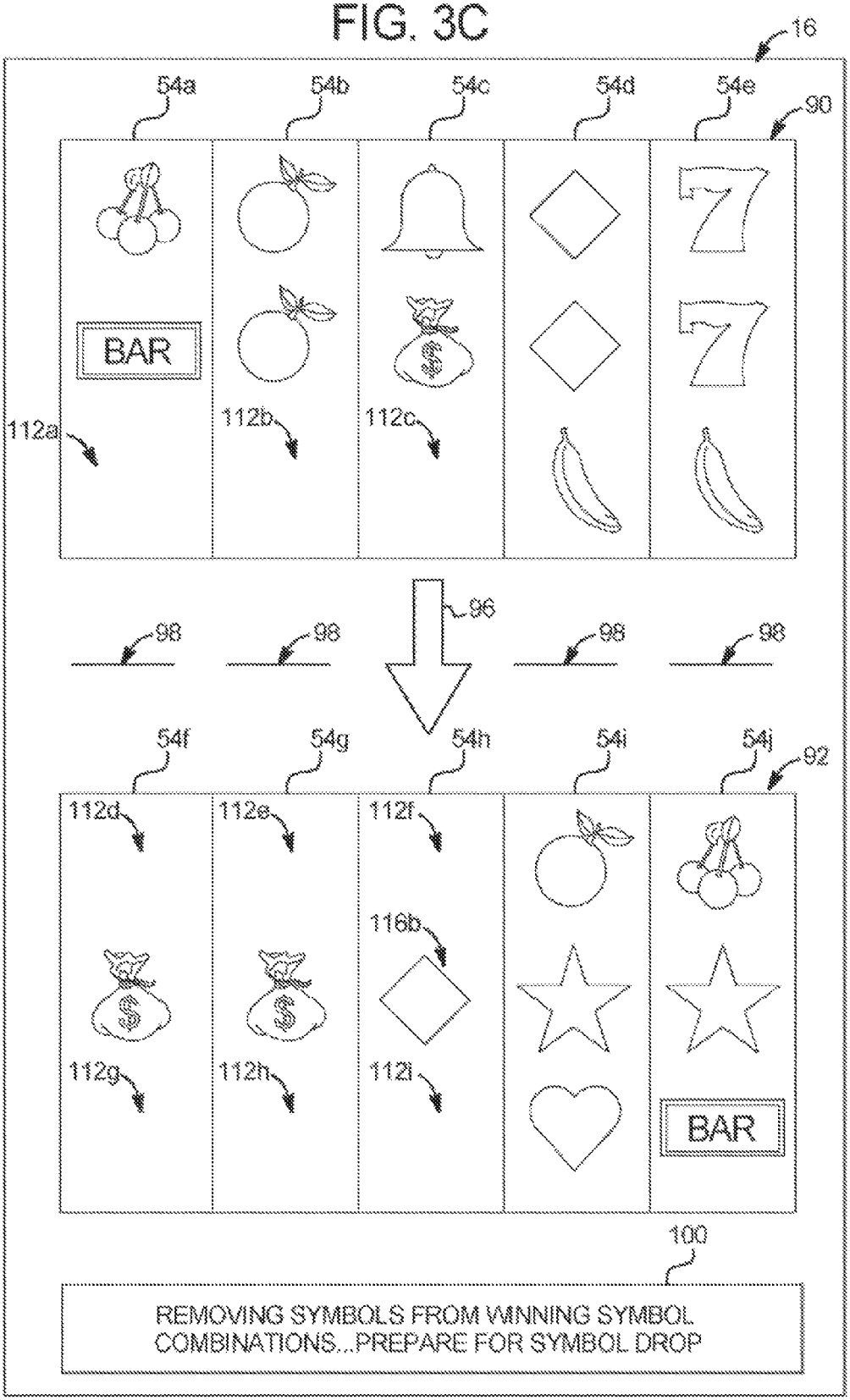

In one embodiment, the gaming device removes each symbol that is part of a winning symbol combination from its symbol position. When it removes the symbols, the gaming device creates an empty symbol position. FIG. 3C illustrates reel sets 90 and 92 after the symbols that were part of any winning symbol combination were removed. As illustrated, removing these symbols results in blank symbol positions 112. It will be appreciated that to increase the enjoyment, excitement, and overall gaming experience to the player, the blank symbol positions in one embodiment will be displayed for a discernable amount of time for a player. Moreover, in one embodiment, the gaming device indicates that it is removing the symbols from the winning symbol combinations. In this embodiment, the gaming device also indicates to the player that the empty symbol locations created will be filled by shifting or transferring existing symbols. In FIG. 3C, the gaming device communicates this by displaying a message in message display area 100 such as "REMOVING SYMBOLS FROM WINNING SYMBOL COMBINATIONS . . . PREPARE FOR SYMBOL DROP." In one embodiment, the gaming device communicates this message through another suitable audio or audiovisual display.

In one embodiment, for each reel that is linked to one or more other reels, the gaming device shifts or transfers all symbols on all linked reels in one direction until there are no empty symbol positions that could be filled by shifting or transferring any symbols in that same direction. In this embodiment, the gaming device shifts or transfers symbols from one linked reel to another linked reel. In one embodiment, the gaming device shifts or transfers symbols from one linked reel to the other linked reel until either there are no empty symbol positions on the linked reel in the direction of the shift or transfer or until there are no symbols remaining on the reel opposite the direction of the shift or transfer. In one embodiment, the gaming device maintains the position of the symbols relative to one another.

Figure 3D:
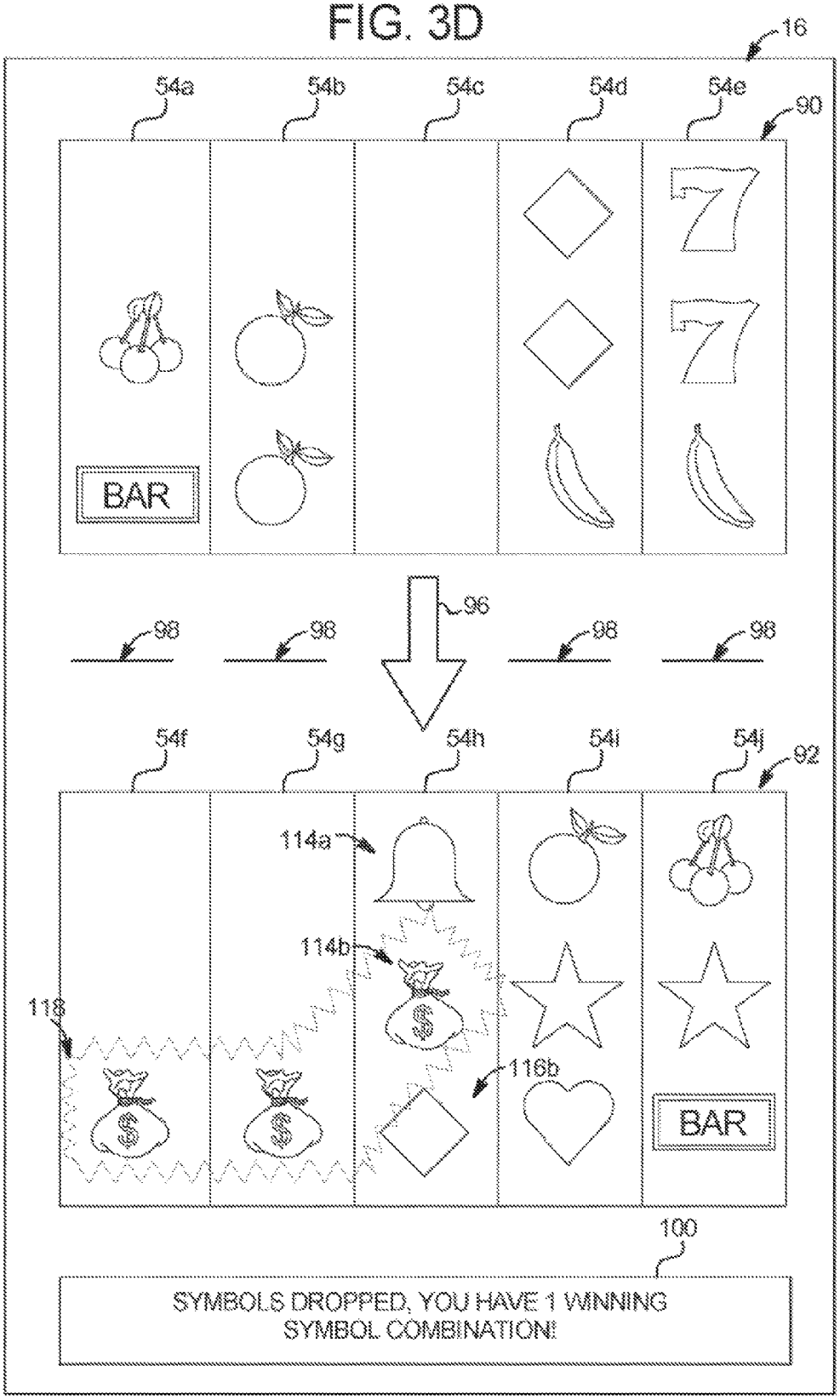

As illustrated in FIG. 3C, when the gaming device removes symbols that were part of any winning symbol combination, empty symbol position 112*c* results on reel 54*c* and empty symbol positions 112*f* and 112*i* result on reel 54*h*. As illustrated in FIG. 3D, the gaming device shifts or transfers the diamond symbol 116*b* downward as far as possible on reel 54*h*. The gaming device also shifts or transfers the bell symbol 114*a* and the moneybag symbol 114*b* downward as far as possible on reel 54*h*. After performing the shifting or transferring for reels 54*c* and 54*h*, the only two reels illustrated in FIG. 3D that are linked to each other, reel 54*c* contains three empty symbol positions and reel 54*h* contains a bell symbol 114*a*, a moneybag symbol 114*b*, and a diamond symbol 116*b*. As further illustrated in FIG. 3D, the shifting or transferring maintained the position of the three symbols relative to one another.

In one embodiment, for each reel that is not linked to any other reel, the gaming device shifts or transfers all symbols on the reel in one direction until there are no empty symbol positions that could be filled by shifting or transferring any symbols the same direction. In this embodiment, the gaming device does not shift or transfer any symbol from one reel to another reel. In one embodiment, the gaming device maintains the position of the symbols relative to one another. As illustrated in FIG. 3C and FIG. 3D, the gaming device shifts or transfers the symbols on reels 54*a*, 54*b*, 54*f*, and 54*g* downward to fill empty symbol positions 112*a*, 112*b*, 112*g* and 112*h*. The gaming device performs these shifts or transfers without changing the position of the symbols relative to one another.

In one embodiment, after shifting or transferring the symbols, the gaming device again determines any winning symbol combinations. As illustrated in FIG. 3D, the gaming device identifies winning symbol combination 118. In one embodiment, the gaming device indicates the winning symbol combinations to the player by displaying a message in message display area 100 such as "SYMBOLS DROPPED, YOU HAVE 1 WINNING SYMBOL COMBINATION!" In another embodiment, the gaming device communicates this message through another suitable audio or audiovisual display. In one embodiment, for each winning symbol combination, the gaming device provides the player with an award. In another embodiment, the gaming device removes the symbols in any winning symbol combinations and again shifts or transfers symbols to fill empty symbol positions as described above.

Figure 3E:
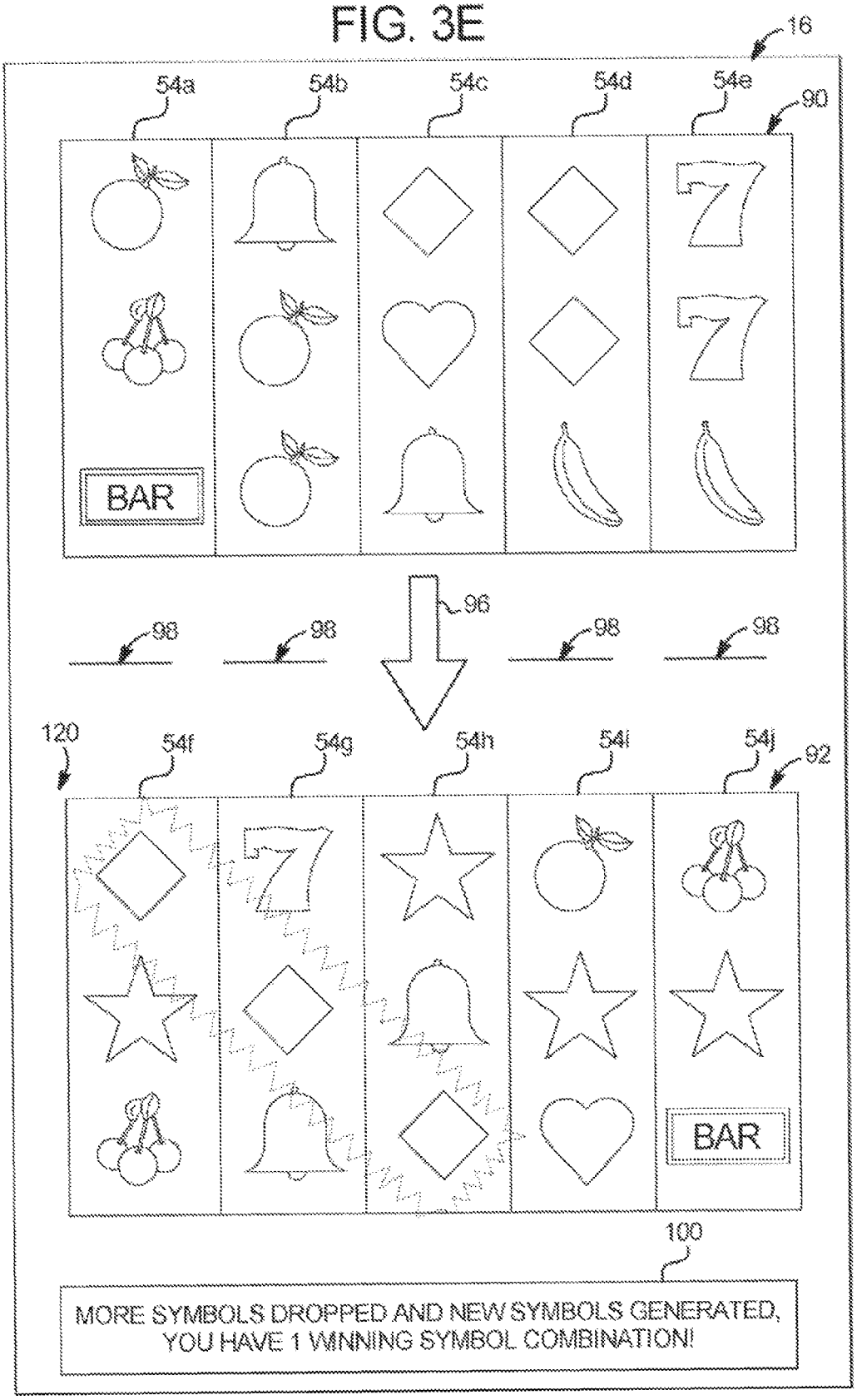

In another embodiment, if the gaming device cannot identify a winning symbol combination, the gaming device generates and displays a symbol from the appropriate symbol map in each blank symbol position on each reel in each reel set. In one embodiment, the gaming device determines any winning symbol combinations and provides the player with a corresponding award. As illustrated in FIG. 3E, the gaming device generates and displays symbols in each blank symbol position on reels 54*a*, 54*b*, 54*c*, 54*f*, and 54*d* and determines that winning symbol combination 120 is present. In one embodiment, the gaming device communicates this to the player by displaying a message in message display area 100 such as "MORE SYMBOLS DROPPED AND NEW SYMBOLS GENERATED, YOU HAVE 1 WINNING SYMBOL COMBINATION!" In one embodiment, the gaming device communicates this message through another suitable audio or audiovisual display. In one embodiment, after determining any winning symbol combinations, the gaming device again removes the symbols in the winning symbol combination and repeats the shifting or transferring as described above. In another embodiment, the gaming device ends the game after determining any winning symbol combinations.

In another embodiment, after the player places a wager, the gaming device generates and displays symbols at a plurality of symbol positions on a plurality of reels in a plurality of reel sets. In one embodiment, at least one reel in a first reel set is linked to at least one reel in a second reel set. In one embodiment, after providing any awards for any generated symbols, the gaming device shifts or transfers each symbol on the reel in the first reel set and each symbol on the reel in the second reel set by at least one position in a given direction. In this embodiment, at least one symbol from the first reel in the first reel set is shifted or transferred to the second, linked reel in the second reel set. In a further embodiment, at least one empty symbol position is created on at least one of the linked reels and at least one symbol is removed from at least one of the linked reels when the gaming device shifts or transfers symbols on linked reels.

Figure 4A:
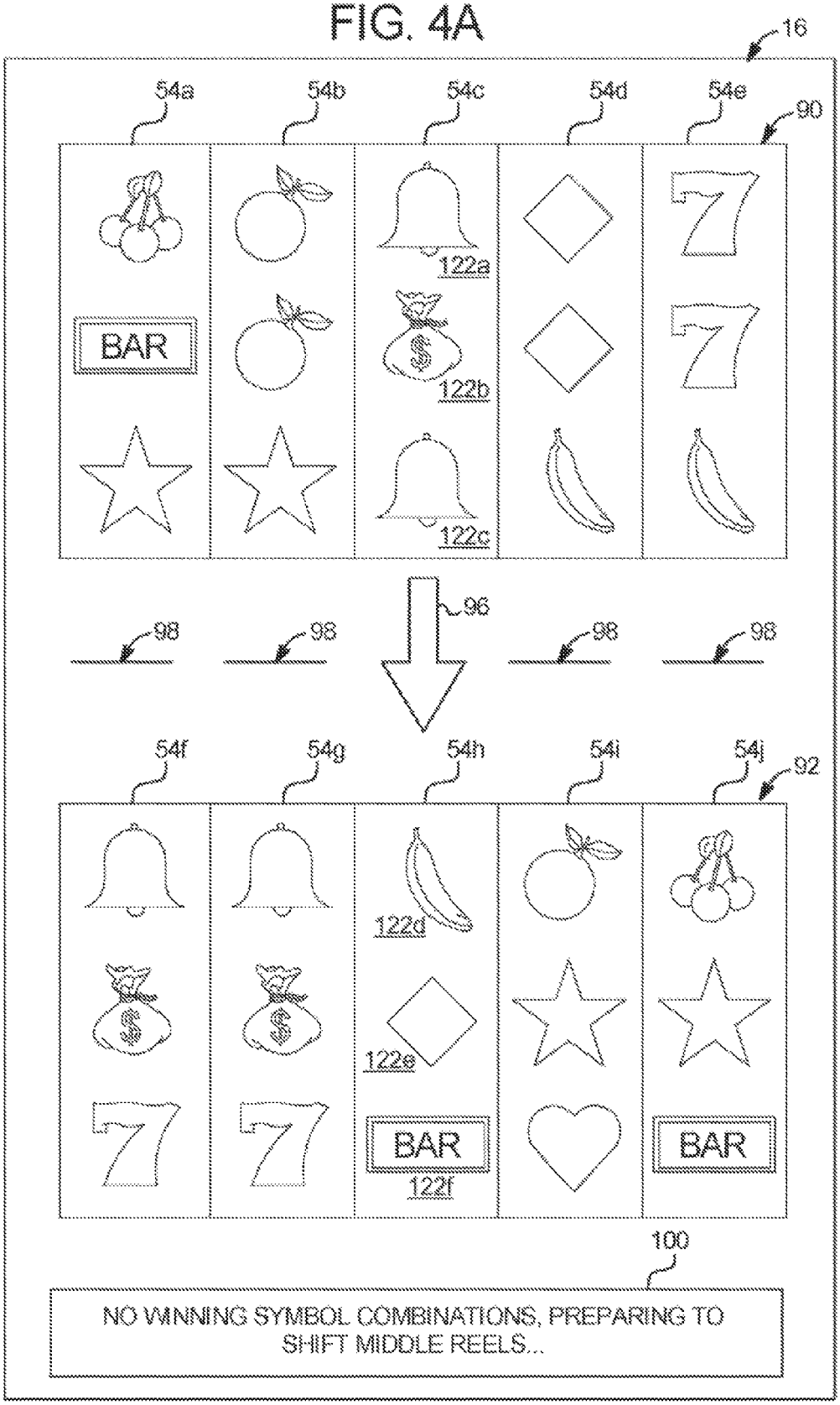
FIGS. 4A and 4B are front elevation views of the display screen of one embodiment of the gaming device disclosed herein illustrating shifting or transferring all the symbols on each linked reel in two reel sets.

As illustrated in FIG. 4A, the gaming device displays reel sets 90 and 92 on display screen 16. The gaming device also displays message display area 100. Each reel set 90 and 92 contains five reels 54, and each reel 54 includes three symbol positions. Reel 54*c* is linked to reel 54*h* as indicated by indicator 96 and the alignment of the reels, and none of the other reels are linked to any other reels, as indicated by indicators 98. The gaming device generates symbols at each symbol position. On reel 54*c*, the gaming device generates a bell symbol 122*a*, a moneybag symbol 122*b*, and a bell symbol 122*c*. On reel 54*h*, the gaming device generates a banana symbol 122*d*, a diamond symbol 122*e*, and a bar symbol 122*f*. The gaming device does not identify any winning symbol combinations. Therefore, as illustrated in FIG. 4A, the gaming device communicates that it did not identify any winning symbol combinations to the player by displaying a message in message area 100 such as "NO WINNING SYMBOL COMBINATIONS, PREPARING TO SHIFT MIDDLE REELS . . . " In one embodiment, the gaming device communicates this message through another suitable audio or audiovisual display.

Figure 4B:
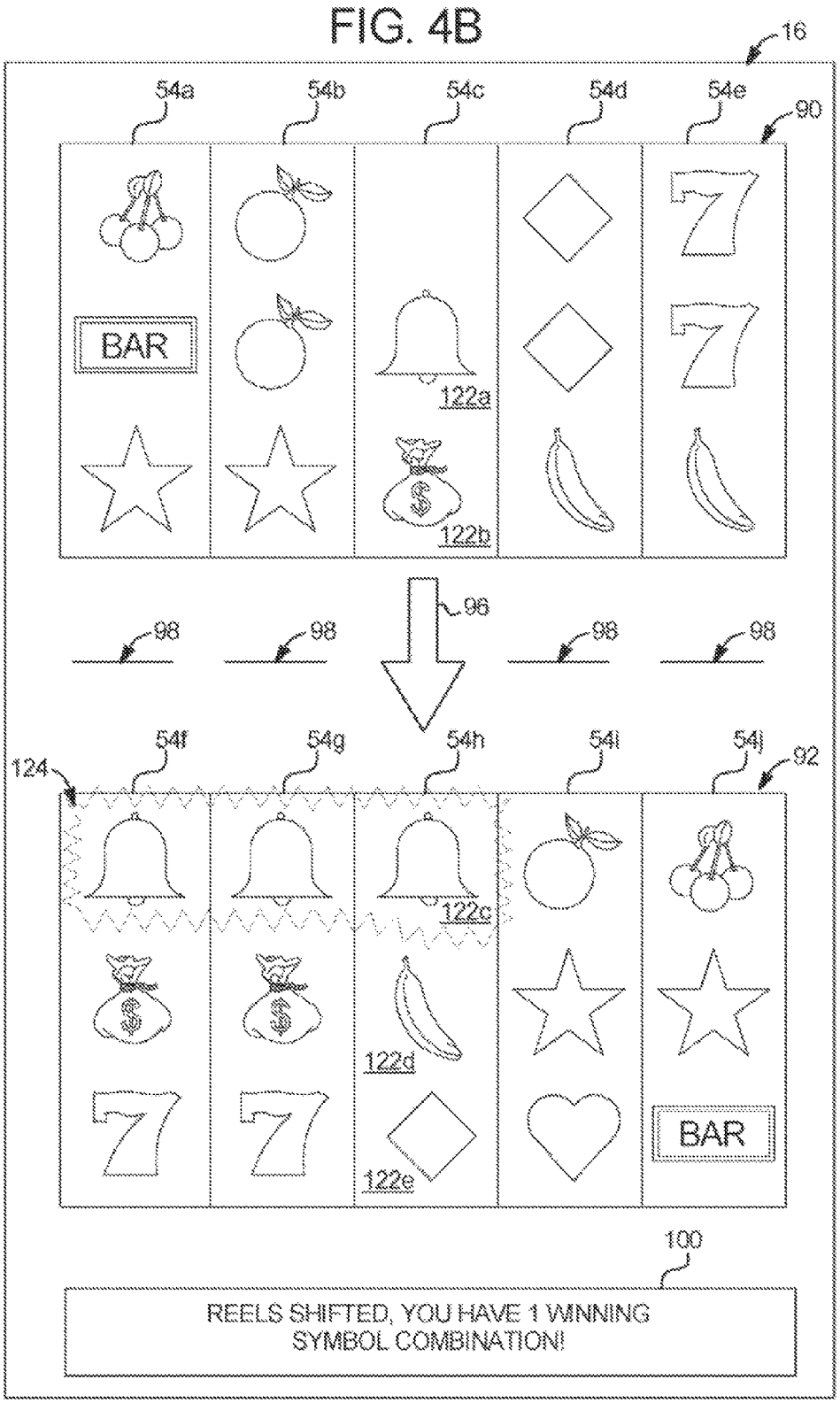

Referring now to FIG. 4B, the gaming device shifts or transfers the symbols on reels 54*c* and 54*h* downward by one position. In this embodiment, the order of the symbols relative to one another remains unchanged. The gaming device removes bar symbol 122*f* from reel 54*h* and moves the banana symbol 122*d* and the diamond symbol 122*e* down by one symbol position. The gaming device then moves the bell symbol 122*c* to the top symbol position on reel 54*h*, and moves the bell symbol 122*a* and the moneybag symbol 122*b* down by one position on reel 54*c*. As illustrated by FIG. 4B, one empty symbol position remains on reel 54*c* after the gaming device performs this shift or transfer.

Moreover, as illustrated in FIG. 4B, the gaming device identifies winning symbol combination 124 after it performs the shift or transfer on linked reels 54*c* and 54*h*. In one embodiment, the gaming device communicates the number of generated winning symbol combinations by displaying a message in the message display area such as "REELS SHIFTED, YOU HAVE 1 WINNING SYMBOL COMBINATION!" In one embodiment, the gaming device communicates this message through another suitable audio or audiovisual display. In one embodiment, the gaming device provides the player with the appropriate award. In one embodiment, the gaming device repeats the shift or transfer one or more times. In another embodiment, the gaming device removes the symbols that were part of a winning symbol combination and performs the shift or transfer described above. In another embodiment, the gaming device ends the game after providing the player with an award.

The gaming device disclosed herein enables the gaming device to vary the player's probability of obtaining an award based on which reels are linked. If the gaming device assesses winning symbol combinations from left to right, the farther to the left a set of linked reels is positioned within a reel set, the more likely a winning symbol combination will include a symbol on one of the reels in the set of linked reels. Similarly, if the winning symbol combinations are determined from right to left, the farther to the right a set of linked reels is positioned within a reel set, the more likely the winning symbol combination will include a symbol on one of the reels in the set of linked reels. In either embodiment, if the winning symbol combination includes a symbol in the linked reel set, shifting or transferring will occur and volatility will be increased.

In an alternative embodiment, winning symbol combinations are determined by a scatter pay method. In this embodiment, the likelihood that a symbol from a given reel in a reel set is included in a winning symbol combination is equal regardless of the position of linked reels in the reel sets. In this embodiment, the magnitude of the award reflects the relative statistical likelihood of a shifted or transferred symbol being included in a new winning symbol combination.

In one embodiment, each symbol map only has one symbol in common with the symbol maps of each of the plurality of other reel sets. In this embodiment, it would be rare for a shift or transfer to result in a winning symbol combination using the one symbol that both symbol maps have in common. In this embodiment, the gaming device provides a large award to reflect the relative rarity of the post-shift winning symbol combination.

In another embodiment, a plurality of symbols are specific to certain reel sets. In this embodiment, at least one symbol generated and displayed in a symbol position on a reel in one reel set can only be part of a winning symbol combination when the symbol is shifted or transferred to a different reel set and is combined in a winning symbol combination with a symbol from another reel set. This embodiment provides increased volatility of the gaming device because by transferring one or more symbols from a symbol position in one reel set to one or more symbol positions in another reel set, the gaming device is configured to provide awards for winning symbol combinations that would have been impossible without the transfer.

In another embodiment, a plurality of symbols are specific to certain reel sets. In this embodiment, at least one symbol specific to at least one reel set is configured to be part of at least one winning symbol combination on the reel set in which it is generated and displayed. In this embodiment, at least one symbol generated in a symbol position on a reel in the first reel set can also be part of a winning symbol combination when the symbol is shifted or transferred to a different reel set and is combined in a winning symbol combination with a symbol from another reel set. In this embodiment, the gaming device provides a greater award to the player when the symbol from the first reel set is transferred to the second reel set and forms a winning symbol combination with the at least one symbol from the second reel set. This embodiment also provides increased volatility because by transferring one or more symbols from a symbol position in one reel set to one or more symbol positions in another reel set, the gaming device is configured to provide awards for symbol combinations that would have been impossible without the transfer.

In one embodiment, the gaming device generates stacked symbols in the first reel set. In another embodiment, the gaming device generates wild symbols in the first reel set. In another embodiment, the gaming device generates bonus symbols in the first reel set. In these embodiments, the gaming device does not generate stacked, wild, or bonus symbols in the second reel set. In another embodiment, the stacked symbols, wild symbols, or bonus symbols cannot function as stacked symbols, wild symbols, or bonus symbols in the first reel set, but do function as such if and when they are shifted or transferred to the second reel set.

If the symbols in the second reel set form a winning symbol combination, the gaming device removes the symbols and shifts or transfers the remaining symbols in the second reel set as far as possible within each reel. The gaming device then shifts or transfers symbols in the first reel set into the corresponding linked reels in the second reel set. The gaming device then analyzes winning symbol combinations in the second reel set and provides any necessary award.

In one embodiment, the first reel set is a top reel set, positioned above and aligned with the second reel set. In this embodiment, the second reel set is a bottom reel set, positioned below and aligned with the first reel set. In one such embodiment, symbols are shifted or transferred downward. In another embodiment, the first reel set is the bottom reel set, positioned below and aligned with the second reel set. In this embodiment, the second reel set is a top reel set, positioned above and aligned with the first reel set. In one such embodiment, the symbols are shifted or transferred upward.

In one embodiment, the number of sets of linked reels is determined by the player's wager. In different embodiments, the number of sets of linked reels is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, the gaming device determines which winning symbol combinations are evaluated based on the player's wager. In another embodiment, which winning symbol combinations are eligible to provide an award is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on time (such as the time of day), determined based on an amount of coin-in accumulated in one or more pools or determined based on any other suitable method or criteria.

In another embodiment, the gaming device selects which paylines within a given reel set are active based on the player's wager. In another embodiment, which paylines within a given reel set are active is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on time (such as the time of day), determined based on an amount of coin-in accumulated in one or more pools or determined based on any other suitable method or criteria.

In one embodiment, the location of the sets of linked reels is determined by the player's wager. In different embodiments, the location of the sets of linked reels is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one alternative embodiment, the gaming device displays a plurality of reel sets that are not in close physical proximity with one another. In one embodiment, the reels in each reel set may be aligned horizontally with respect to the gaming device, vertically with respect to the gaming device, or diagonally with respect to the gaming device. In another embodiment, the reels in each reel set need not be in close proximity with the other reels in the reel set. In another embodiment, the reels of one or more of the plurality of reel sets may be represented as concentric circles.

In one embodiment, the gaming device indicates that two or more reels are linked by statically displaying an image on the cabinet of a gaming device. In another embodiment, the gaming device indicates a linking between a plurality of reels by displaying them such that the linked reels are aligned. In another embodiment, the gaming device represents the linking of two or more reels by informing the player through an audio or visual cue prior to or during play of the game. The gaming device may indicate the linking of reels in any suitable manner.

Moreover, the gaming device may link more than two reels in more than two reel sets. In one embodiment, a first reel in a first reel set is linked to a first reel in a second reel set and a first reel in a third reel set. In an alternative embodiment, one or more reels in one reel set may be linked to one or more reels in another reel set. In this embodiment, at least two reels in a first reel set are linked to at least two reels in a second reel set.

In one embodiment, the player uses one or more input devices to select which reel or reels will be linked to which other reel or reels. In another embodiment, the gaming device always links the same sets of reels. In different embodiments, the gaming device randomly selects or the player selects the linking of any reels of any reel sets before the game begins. In another embodiment, the gaming device randomly determines or the player selects the linking of at least one reel of at least one first reel set and at least a second reel of at least a second reel set after the game has begun. In one embodiment, the larger a player's wager, the more sets of linked of reels that can be chosen by the gaming device or by the player. In another embodiment, which reels are linked is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, each reel in each reel set includes the same number of symbol positions. In another embodiment, the reels of a first reel set may each include a different number of symbol positions than the reels in a second reel set. In another embodiment, the reels within a single reel set may each include a different number of symbol positions. In one embodiment, the number of active symbol positions on a given reel or in a given reel set is determined by the player's wager, as described above. In other embodiments, different reel sets include different numbers of reels.

In one embodiment, the symbols are randomly generated based on a separate random number generator seed for each reel set. In an alternative embodiment, the symbols are randomly generated for each reel set based on the same random number generator seed. In this embodiment, the seed is the same for each reel in a reel set, but the starting positions of the reels are different.

In one embodiment, the gaming device determines winning symbol combinations by analyzing paylines. In another embodiment, the gaming device determines winning symbol combinations in a scatter-pay method. In another embodiment, winning symbol combinations are determined based on the player's wagered on ways to win. In other embodiments, the gaming device may determine winning symbol combinations by using a combination of the methods described above, wherein the gaming device analyzes one or more of the above patterns for each reel set. In one embodiment, the determination of winning symbol combinations is not made in the same way for each reel set. In another embodiment, the determination of winning symbol combinations above is made from left to right, from right to left, or a combination of the two. In one embodiment, the direction of determining winning symbol combinations is different for at least one of the plurality of reel sets.

In one embodiment, the gaming device removes each symbol that is included in a winning symbol combination. In different embodiments, which symbols are removed is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

For each empty symbol position, the gaming device shifts or transfers symbols where possible to fill the empty symbol position. In one embodiment, the order of the symbols is reversed or randomized as the gaming device shifts or transfers the symbols. The relative positions of the symbols need not be maintained whether the shifting or transferring occurs on a single reel or between linked reels. In one embodiment, the gaming device does not shift or transfer in a single direction for all sets of linked reels. In one embodiment, all the symbols are shifted or transferred upward. In alternative embodiments, the symbols are shifted or transferred, downward, laterally, diagonally, radially inward, radially outward, or around the circumference of a circle. In still alternative embodiments, the symbols are shifted or transferred in a plurality of the aforementioned manners, which plurality of directions may or may not be the same for each reel or each reel set.

In one embodiment, the gaming device performs a shift or transfer for symbols on a reel not linked to any other reel. In this embodiment, the symbols on the reel are each shifted or transferred in a given direction, with zero or more of the symbols being removed from zero or more symbol positions. This shift or transfer can be performed on a reel even if there are no empty symbol positions on that reel.

In one embodiment, the shift or transfer does not result in any empty symbol positions. Instead, each of any symbol that is shifted or transferred off of any reel is moved to one of any empty symbol position resulting from the shift or transfer.

In one embodiment, the gaming device shifts or transfers symbols for any number of reels in any number of reel sets. In one embodiment, the gaming device shifts or transfers zero, one, or more sets of linked reels, and/or zero, one, or more reels not linked to any other reel. In another embodiment, any shifting or transferring is not performed in the same direction for each of the plurality of reel sets or even for each of the plurality of reels within a given reel set. Rather, in this embodiment, each reel in a reel set or each set of linked reels within a plurality of reel sets may have symbols shifted or transferred upward, downward, laterally, diagonally, around the circumference of a circle, in some other direction, or any combination of the above.

In one embodiment, if any shifting or transferring does not result in a winning symbol combination, the gaming device may repeat the shift or transfer one or more times until a winning symbol combination is achieved. If the initial generation and display of symbols on the reel sets does not result in a winning symbol combination, in one embodiment the gaming device shifts or transfers at least one set of linked reels until a winning symbol combination is obtained. In an alternative embodiment, the gaming device will perform exactly zero, exactly one, or exactly some other number of shifts or transfers regardless of whether or how often a winning symbol combination is generated.

In one embodiment, the gaming device analyzes winning symbol combinations on each reel set. In an alternative embodiment, the gaming device only analyzes winning symbol combination for the second reel set. In this embodiment, the first reel set represents a preview of or staging area for the symbols that could be shifted or transferred to fill empty symbol positions in the second reel set. This increases the excitement and enjoyment to the player. In an alternative embodiment, the gaming device analyzes winning symbol combinations in the first reel set but the paytable used to calculate the awards is less lucrative.

In one embodiment, the functionality of symbols in the first reel set changes when the symbol is shifted or transferred from the first reel set to the second reel set. In another embodiment, the functionality change is represented by a change in appearance of the symbol as it is shifted or transferred from the first reel set to the second reel set. This embodiment increases volatility because symbols that were independently generated in the first reel set have the potential to be shifted or transferred into the second reel set. Moreover, once the symbols from the first reel set occupy symbol positions in the second reel set, they increase the likelihood that additional winning symbol combinations will result.

In one embodiment, the gaming device contains a first reel set and a second reel set. In one embodiment, at least one but less than all reels in the first reel set are each linked to an aligned reel in the second reel set. In another embodiment, all the reels in the first reel set are each linked to an aligned reel in the second reel set. In another embodiment, all reels are linked to at least another reel in another reel set based on a wager made by the player. In another embodiment, whether all reels will be linked is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on time (such as the time of day), determined based on an amount of coin-in accumulated in one or more pools or determined based on any other suitable method or criteria.

The gaming device makes the game more enjoyable for players because the shifting between linked columns in a plurality of matrices provides an opportunity to use independently generated symbols from one matrix to generate winning symbol combinations in another matrix. Moreover, the gaming device disclosed increases player excitement and enjoyment because winning symbol combinations are generated after all visible winning symbol combinations have already yielded awards. Finally, the gaming device enhances the overall gaming experience because winning symbol combinations will be generated that are not immediately visible to the player.

In one embodiment, the gaming device displays a symbol matrix including a plurality of symbol positions. In this embodiment, for a play of the game, the gaming device generates and displays a symbol in each of the symbol positions of the symbol matrix. In one embodiment, after generating and displaying symbols in the plurality of symbol positions, the gaming device determines whether to remove any of the displayed symbols. For example, the gaming device removes any symbols of the symbol matrix which are included in one or more winning symbol combinations. In one embodiment, each removed symbol from the symbol matrix results in an empty symbol position in the symbol matrix.

In one embodiment, the gaming device disclosed herein is configured to shift one or more supplemental symbols into one or more empty symbol positions of a symbol matrix from one or more symbol staging areas. In this embodiment, instead of shifting symbols from a reel in a first reel set to another, associated reel in a second reel set, as discussed above, the gaming device shifts one or more supplemental symbols from one or more symbol staging areas associated with a symbol matrix into any empty symbol positions created in the symbol matrix during a play of a game.

In one embodiment, the gaming device displays a single symbol staging area in association with each of a plurality of positions of the symbol matrix. In another embodiment, the gaming device displays a plurality of symbol staging areas, each symbol staging area associated with each of the plurality of symbol positions of the symbol matrix. In one embodiment, at least one symbol staging area is associated with a subset of the symbol positions of the symbol matrix, such as a single row of symbol positions of the symbol matrix.

In various embodiments, the gaming device shifts one of the supplemental symbols which is displayed in an appropriate symbol staging area into each of any empty symbol positions created by removing symbols from the symbol matrix during a play of the game. In one embodiment, the gaming device shifts such supplemental symbols directly into empty symbol positions. In another embodiment, the gaming device shifts one or more symbols displayed in the symbol matrix into one or more empty symbol positions, resulting in one or more different empty symbol positions. In this embodiment, the gaming device shifts one or more supplemental symbols from an appropriate symbol staging area into any then-displayed empty symbol positions. In one embodiment, following such filling of empty symbol positions with supplemental symbols, the gaming device again evaluates the symbol matrix to determine whether any winning symbol combinations are displayed. In this embodiment, the gaming device also generates one or more supplemental symbols to display in any empty symbol positions of the symbol staging area.

Figure 5:
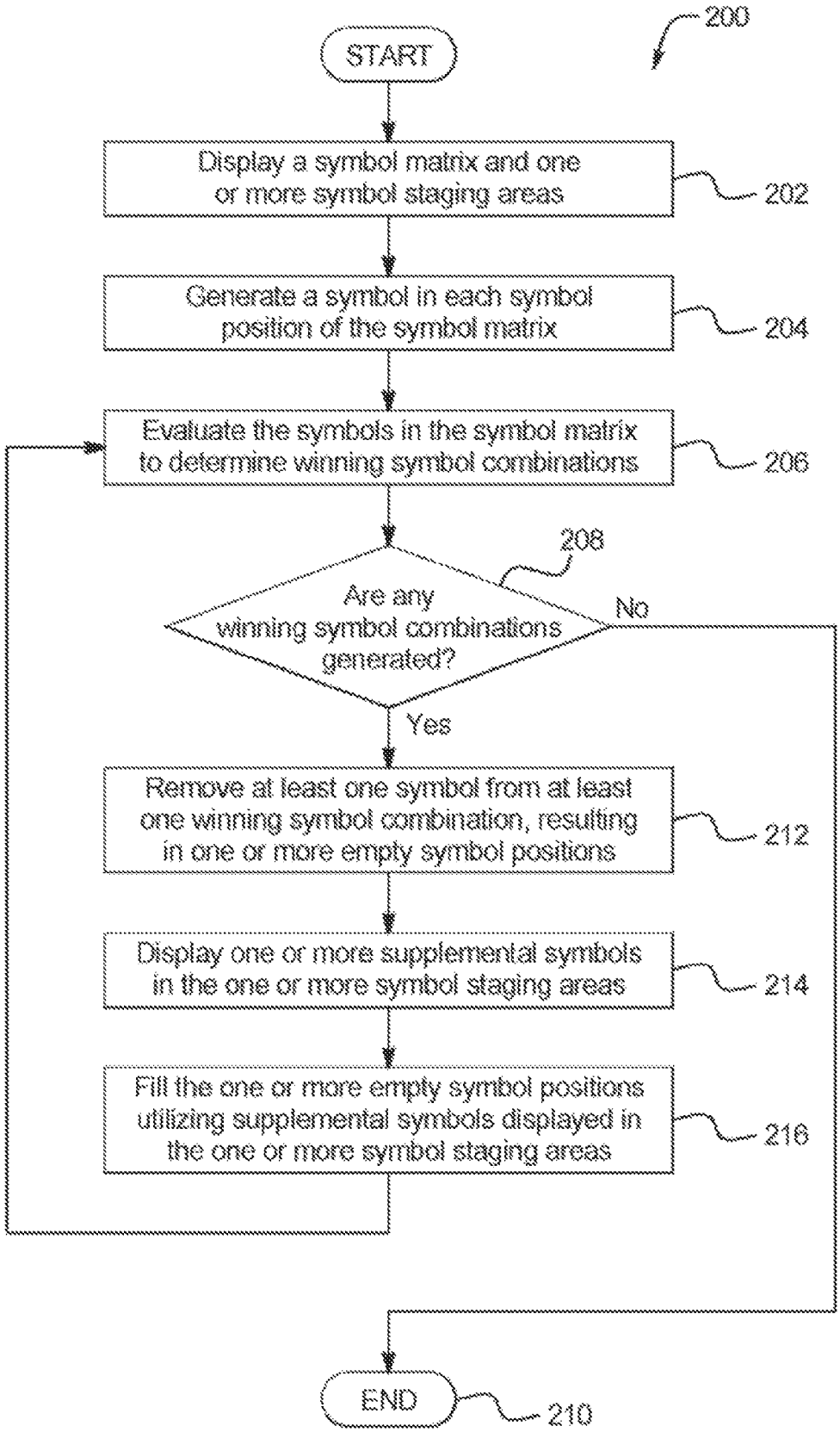
FIG. 5 is a flowchart of an example process for providing the game disclosed herein.

In operation of one embodiment, the disclosed gaming device enables a player to play a symbol game wherein one or more supplemental symbols displayed in one or more symbol staging areas are shiftable into one or more empty symbol positions of a symbol matrix. FIG. 5 illustrates a flow chart of an example process 200 for operating a gaming device and for providing the symbol shifting game disclosed herein. Although the example process 200 is described with reference to the flow chart illustrated in FIG. 5, it should be appreciated that the gaming device described herein can enable a player to play the disclosed game utilizing other methods of operating a gaming device. For example, the order of certain of the steps of process 200 may be changed, certain of the steps of process 200 are optional, and certain steps of the process 200 may be altered.

In the illustrated embodiment, the process 200 for providing the symbol shifting game disclosed herein begins by displaying a symbol matrix and one or more symbol staging areas, as indicated by block 202. In this embodiment, the symbol matrix includes a plurality of symbol positions, each symbol position configured to display a generated symbol for a play of a primary game. Each of the one or more symbol staging areas is configured to display at least one supplemental symbol transferrable to an empty symbol position created during a play of the game. In one embodiment, each symbol staging area is configured to display at least one indicated supplemental symbol, the indicated supplemental symbol being the supplemental symbol currently displayed in a designated location of the staging area such that the indicated supplemental symbol will be the next supplemental symbol to be shifted into an empty symbol position of the symbol matrix.

In one embodiment, for a play of the game, the gaming device generates a symbol in each of the plurality of symbol positions of the symbol matrix, as indicated by block 204. In one such embodiment, the gaming device generates these symbols by selecting a symbol from an independent reel associated with each symbol position. In other such embodiments, the gaming device generates a symbol for each symbol position utilizing any other suitable mechanisms for generating symbols. In one embodiment, after generating a symbol for each of the symbol positions of the symbol matrix, the gaming device evaluates the plurality of generated symbols of the symbol matrix to determine whether any winning symbol combinations are displayed, as indicated by block 206.

In one embodiment, if no winning symbol combinations are generated and displayed in the symbol matrix, as indicated by diamond 208, the gaming device ends the play of the game, as indicated by block 210. In this embodiment, the gaming device enables the player to participate in another play of the game, such as by beginning the process 200 anew.

In one embodiment, if the gaming device determines that at least one winning symbol combination is generated and displayed for the play of the game, as indicated by block 208, the gaming device removes at least one symbol from the at least one displayed winning symbol combination of the symbol matrix, resulting in one or more empty symbol positions in the symbol matrix, as indicated by block 212. In one such embodiment, the gaming device removes each symbol of each displayed winning symbol combination. In another such embodiment, the gaming device removes fewer than all of the symbols which make up at least one winning symbol combination. In either embodiment, each removed symbol results in an empty symbol position in the symbol matrix. That is, the symbol position of the symbol matrix which previously contained a symbol of the winning symbol combination is temporarily displayed as blank or empty.

In one embodiment, the gaming device also displays one or more supplemental symbols in the one or more displayed symbol staging areas, as indicated by block 214. In one such embodiment, the gaming device generates and displays a new set of supplemental symbols in one or more symbol staging areas for each play of the primary game. In another such embodiment, for a play of the game, the gaming device displays one or more supplemental symbols in the one or more symbol staging areas which are displayed for one or more subsequent plays of the game. That is, one or more of the supplemental symbols displayed in a symbol staging area persists from one play of the disclosed game to another.

In the illustrated embodiment, the gaming device utilizes one or more of the supplemental symbols, displayed in one or more symbol staging areas, to fill one or more empty symbol positions of the symbol matrix, as indicated by block 216. As discussed above, it should be appreciated that the empty symbol positions of the symbol matrix can be created by removing one or more symbols from one or more winning symbol combinations for a play of the game. In one embodiment, the gaming device shifts at least one symbol from one of the symbol staging areas directly into at least one empty symbol position, regardless of where in the symbol matrix the empty symbol position is displayed. In a further embodiment, the gaming device shifts at least one symbol which is an indicated supplemental symbol from one of the symbol staging areas into at least one empty symbol position of the symbol matrix. In another embodiment, the gaming device shifts one or more symbols of the symbol matrix into one or more empty symbol positions, creating one or more different empty symbol positions. That is, the gaming device performs an internal shift of at least one symbol to fill at least one empty symbol position of the symbol matrix, resulting in a different empty symbol position. In this embodiment, the gaming device shifts one or more supplemental symbols from the symbol staging area into the empty symbol position(s) created after shifting internally within the symbol matrix.

After utilizing an appropriate number of supplemental symbols from the at least one symbol staging area to fill any empty symbol positions of the symbol matrix, the gaming device evaluates the then-displayed symbols of the symbol matrix to determine whether any winning symbol combinations are displayed, as indicated by block 206. If no winning symbol combinations are displayed, as indicated by diamond 208, the gaming device ends the play of the game, as indicated by block 210. If one or more winning symbol combinations are generated after filling the empty symbol position(s), as indicated by diamond 208, the gaming device removes at least one symbol from the winning symbol combination(s), as indicated by block 212, displays one or more supplemental symbols, as indicated by block 214, and fills the empty symbol position(s), as indicated by block 216, in the manner discussed above.

In one embodiment, the gaming device repeats the process 200 until no winning symbol combinations are displayed after shifting any symbols from the symbol staging areas to the symbol matrix to fill any empty symbol positions. In another embodiment, the process 200 includes an additional determination after each evaluation, represented by block 206, of whether to continue the play of the game by removing one or more symbols from the symbol matrix. In various embodiments, whether to continue the play of the game is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In another embodiment, the gaming device is configured to remove only certain types of symbols which are included in winning symbol combinations, such as designated or wild symbols. In this embodiment, the gaming device removes only such designated or wild symbols in the portion of the process indicated by block 212.

In one embodiment, the gaming device determines whether to remove one or more winning symbols from a displayed winning symbol combination based on an occurrence of an appropriate triggering event. In the embodiment of process 200 illustrated in FIG. 5, the appropriate triggering event is simply the existence of a winning symbol combination. In another embodiment, the triggering event includes an existence of a winning symbol combination coupled with an appropriate wager, such as a maximum wager, on the play of the game. In various other embodiments, whether the triggering event occurs for a play of the game is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria. It should be appreciated that for a single play of the game, the triggering event could occur for an initial generation of a plurality of symbols, but upon subsequent filling of empty symbol positions utilizing the supplemental symbols displayed in the symbol staging area, the triggering event may not occur. It should thus be appreciated that in one embodiment, the triggering event is determined for each generation of any symbol in any symbol position of the symbol matrix.

In the embodiments illustrated in FIGS. 6A, 6B, 6C, 6D, 7A, 7B, 7C, 7D, 7E, 7F, 8A, 8B, 8C, 8D, 8E, 8F, 8G, 8H, 8I, 9A, 9B, 9C, 9D, 9E, 9F, 9G, 9H, 10A, 10B, and 10C, the gaming device is configured to generate one or more high-value symbols (such as major symbols) in addition to a plurality of standard symbols for one or more plays of the game. In certain embodiments, discussed below, the gaming device is configured to generate one or more high-value or major symbols, such as symbols M1, M2, and M3, in either a symbol position of the symbol matrix or in one or more supplemental symbol staging areas. In another embodiment, such as the embodiment illustrated at FIGS. 7A, 7B, 7C, 7D, 7E, and 7F, the gaming device is configured to generate and display high-value or major symbols M1, M2, and M3 only in one or more of the supplemental symbol display areas. It should be appreciated that in such an embodiment, the high-value symbols are potentially included in a winning symbol combination for a play of the game only after such high-value symbols are shifted into the symbol matrix, such as following the removal of one or more symbols from the symbol matrix to result in one or more empty symbol positions. These example embodiments are described in detail below.

FIGS. 6A, 6B, 6C, and 6D, each illustrate a front elevation view of the display screen 250 of one embodiment of the gaming device disclosed herein. Specifically, FIGS. 6A, 6B, 6C, and 6D illustrate a play of the game disclosed herein, wherein symbols are shifted or transferred between a single symbol staging area 260 and a symbol matrix 270 as needed to fill any empty symbol positions of the symbol matrix 270. In the illustrated embodiment, the symbol matrix 270 includes three rows of symbol positions 252*a*, 252*b*, and 252*c*. Each row of symbol positions is arranged in five columns 254*a*, 254*b*, 254*c*, 254*d*, and 254*e*. Further, as illustrated, a single symbol staging area 260 is configured to display four different supplemental symbols 260*a*, 260*b*, 260*c*, and 260*d*. Supplemental symbol 260*d* is an indicated supplemental symbol, and as indicated by arrow 265, and as such is the next supplemental symbol to be shifted into any symbol position of the symbol matrix 270 (i.e., regardless of the column and/or row of the shifted-to empty symbol position). Finally, FIGS. 6A, 6B, 6C, and 6D each illustrate a game information display area 280, which enables the gaming device to communicate information about the progress of the play of the game to the player.

Figure 6A:
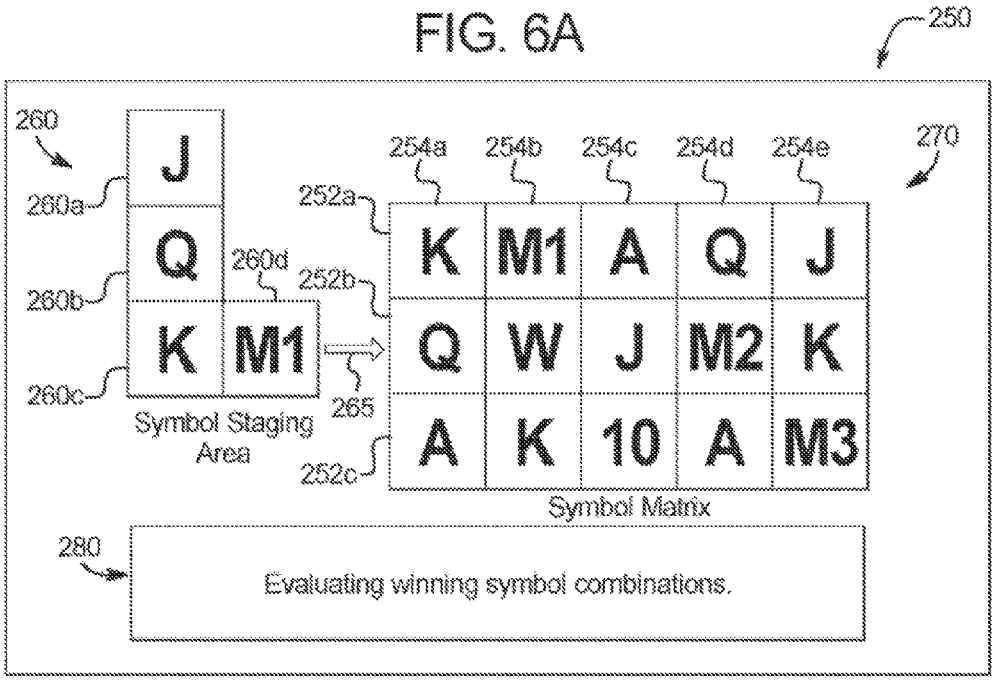
FIGS. 6A, 6B, 6C, and 6D are front elevation views of the display screen of one embodiment of the gaming device disclosed herein illustrating shifting or transferring symbols between a single symbol staging area and a symbol matrix.

Referring specifically to FIG. 6A, the gaming device disclosed herein displays a plurality of symbols in the plurality of symbol positions of the symbol matrix 270. In the illustrated embodiment, the M1 symbol displayed at row 252*a* and column 254*b*, the M2 symbol displayed at row 252*b* and column 254*d*, and the M3 symbol displayed at row 252*c* and column 254*e* are each high-value or major symbols as discussed above. These major symbols are high-valued symbols which, when generated as part of a winning symbol combination, result in relatively higher valued awards than winning symbol combinations which do not include such symbols. Further, in the illustrated embodiment, the W symbol displayed at row 252*b*, column 254*b* is a Wild symbol which is configured to act as any necessary symbol for purposes of evaluating winning symbol combinations.

In the embodiment illustrated in FIG. 6A, the gaming device generates and displays a plurality of supplemental symbols in the single symbol staging area 260. As illustrated, an M1 symbol is displayed at symbol position 260*d* of the symbol staging area. Since the M1 symbol of the symbol staging area 260 is an indicated supplemental symbol, the M1 symbol is the next supplemental symbol to be shifted into an empty symbol position (if any) for the illustrated play of the game. Thus, it should be appreciated that shifting an additional high-value symbol (i.e., the M1 symbol) into the symbol matrix 270 increases player excitement and enjoyment by increasing the likelihood of winning high-value awards for the play of the game. Game information display area 280 of FIG. 6A displays a message to the player indicating that the generated symbols of the symbol matrix are being evaluated to determine whether any winning symbol combinations are displayed.

Figure 6B:
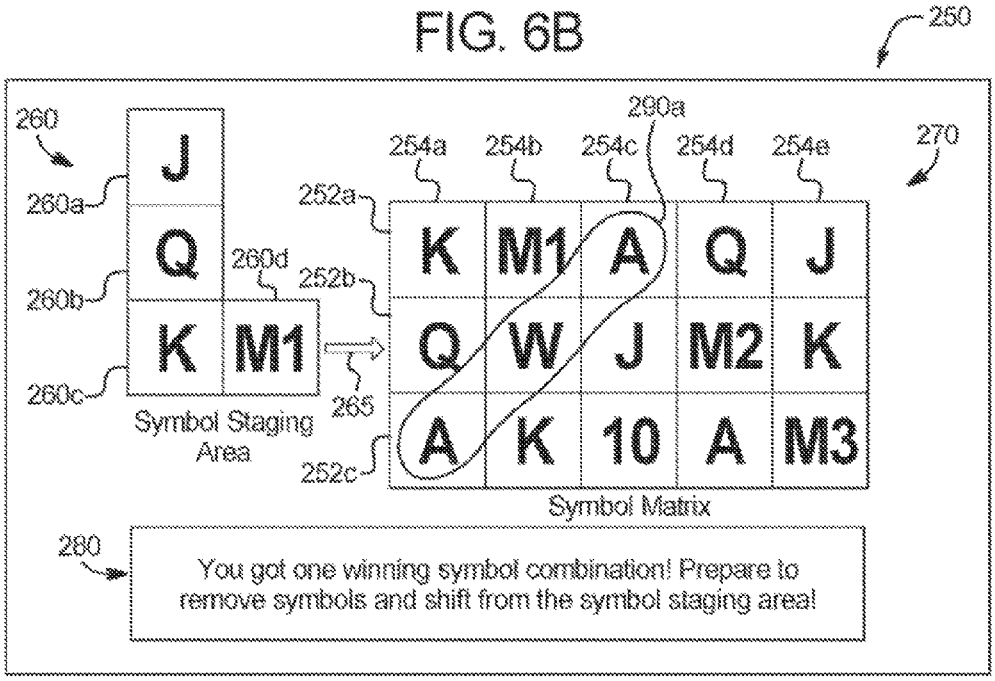

Referring now to FIG. 6B, the gaming device disclosed herein is illustrated after evaluating whether any winning symbol combinations are displayed in the symbol matrix. The gaming device displays an indication that a winning symbol combination 290*a* was found for the play of the game. Further, in FIG. 6B, game information display area 280 displays a message to the player indicating that one winning symbol combination was generated, and that symbols forming the winning symbol combination will be removed from the symbol matrix. Moreover, game information display area 280 displays a message that at least one symbol will be shifted from the symbol staging area 260 to fill any empty symbol positions remaining in the symbol matrix 270 following removal of the symbols of the winning symbol combination 290*a*.

Figure 6C:
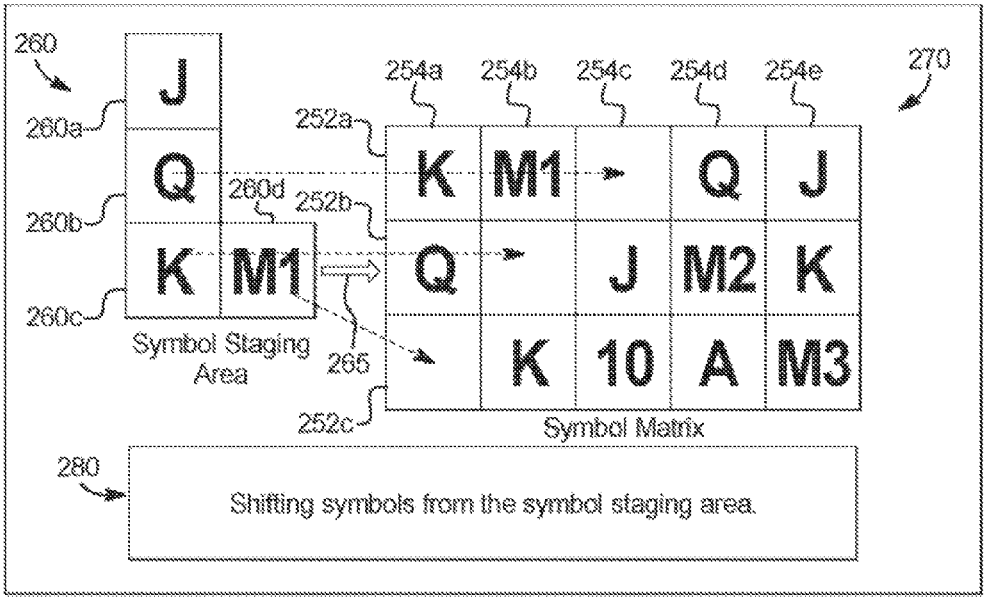

As illustrated in FIG. 6C, the gaming device removes the symbols contained in the winning symbol combination 290*a* from row 252*a* column 254*c*, row 252*b* column 254*b*, and row

252*c* column 254*a* of the symbol matrix 270. In the illustrated embodiment, removal of these three symbols results in three empty symbol positions at the aforementioned columns and rows. Moreover, as indicated in FIG. 6C, the gaming device prepares to shift symbols from the symbol staging area 260 into the symbol matrix 270 to fill the empty symbol positions previously occupied by symbols of winning symbol combination 290*a*. In the illustrated embodiment, the symbols of the symbol staging area 260 are serially shifted into the empty symbol positions, beginning at the bottom left corner of the symbol matrix, proceeding left to right across each row, and proceeding upwards from row to row. As such, the M1 symbol displayed at 260*d* is shifted into the empty symbol position at row 252*c*, column 254*a*; the K symbol displayed at 260*c* is shifted to the empty symbol position at row 252*b*, column 254*b*; and the Q symbol displayed at 2260*b* is shifted into the empty symbol position at row 252*a*, column 254*c*. In the illustrated embodiment, arrows indicate the eventual location of each of the symbols of the symbol staging area. It should be appreciated that in one embodiment, the gaming device displays the symbols as shifting to the empty symbol positions serially, such that after the M1 symbol is shifted from position 260*d* to the appropriate empty symbol position, the K symbol, Q symbol, and J symbol of the symbol staging are each shifted one position toward 260*d*. In this embodiment, the gaming device repeats the shifting from the symbol staging area 260 to the symbol matrix 270, wherein each shifted symbol is shifted from position 260*d* to an empty symbol position of the symbol matrix. In a further embodiment, for each shifted symbol out of the symbol staging area 260 and into the symbol matrix 270, the gaming device also randomly generates a new symbol and displays that symbol at position 260*a* of the symbol staging area 260. Game information display area 280 displays a message to the player indicating that symbols are being shifted from the symbol staging area 260 to the symbol matrix 270 to fill the empty symbol positions contained therein.

It should thus be appreciated that the disclosed gaming device displays the supplemental symbols as shifting, one at a time, into the symbol matrix, and for each shifted supplemental symbol, the gaming device displays the remaining supplemental as filling the symbol staging area prior to the next shift. Thus, in one embodiment, the symbol staging area resembles a tube or container of symbols, wherein for each symbol shifted out of the tube, the remaining symbols of the tube appear to fall or tumble downward in the tube, with a new symbol being placed in the newly formed empty position of the symbol staging area.

Figure 6D:
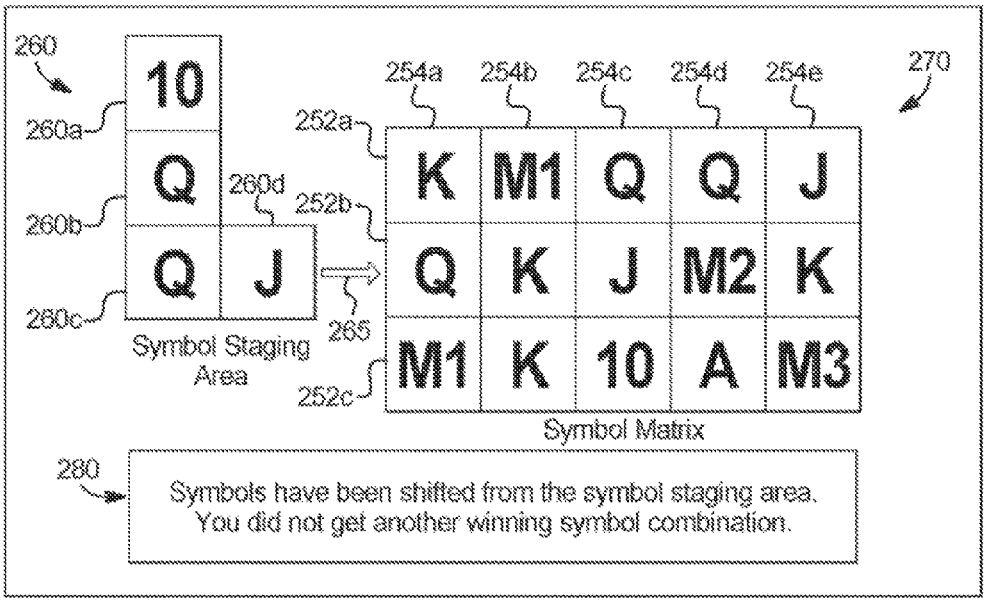

FIG. 6D illustrates the display screen 250 after the shifting of the symbols from the symbol staging area 260 to the symbol matrix 270 has occurred as described with respect to FIG. 6C. In the illustrated embodiment, the gaming device has shifted the M1 symbol from illustrated position 260*d* into the symbol matrix at row 252*c* column 254*a*, has shifted the K symbol from the illustrated position 260*c* into the symbol matrix at row 252*b* column 254*b*, and has shifted the Q symbol from the illustrated position 260*b* into the symbol matrix at row 252*a* column 254*c*. As further illustrated in FIG. 6D, the J symbol, previously displayed at position 260*a*, has shifted to position 260*d* of the symbol staging area, indicating that the J symbol would be the next supplemental symbol usable to fill any empty symbol positions.

After the shifting described above to fill the empty symbol positions of symbol matrix 270, the gaming device again evaluates the symbols of the symbol matrix to determine whether any winning symbol combinations are displayed. In the illustrated embodiment, no winning symbol combinations are displayed. Therefore, the gaming device displays a message at game information display area 280 indicating that the supplemental symbols have been shifted into the symbol matrix, and that no further winning symbol combination has been generated. The gaming device therefore ends the play of the game.

In one embodiment, the gaming device provides an award to the player for the play of the game (not shown), wherein the award is based only on the winning symbol combination 290*a*. It should be appreciated that by shifting the M1 symbol into the symbol matrix from the symbol staging area, wherein the M1 symbol is a high-value symbol, the gaming device increases the likelihood that a future award provided to a player will be a high-value award, thus increasing player excitement and enjoyment.

FIGS. 7A, 7B, 7C, 7D, 7E, and 7F each illustrate a front elevation view of a display screen 350 of one embodiment of the gaming device disclosed herein. Specifically, FIGS. 7A, 7B, 7C, 7D, 7E, and 7F illustrate a play of the game disclosed herein, wherein supplemental symbols are shifted or transferred between one of two symbol staging areas 362 and 364 and a symbol matrix 370 as needed to fill any empty symbol positions of the symbol matrix 370. Further, in the illustrated embodiment, the gaming device displays a symbol staging area indicator 366 for indicating one of the plurality of symbol staging areas 362 or 364 from which supplemental symbols will be shifted during the play of the game. In the illustrated embodiment, the symbol matrix 370 includes three rows of symbol positions 352*a*, 352*b*, and 352*c*. Each row of symbol positions is arranged in five columns 354*a*, 354*b*, 354*c*, 354*d*, and 354*e*. Further, as illustrated, symbol staging area 362 is configured to display four different supplemental symbols at positions 362*a*, 362*b*, 362*c*, and 362*d*. Supplemental symbol 362*d* is an indicated supplemental symbol, and as indicated by arrow 365*a*, and is shiftable into any empty symbol position of the symbol matrix 370 (i.e., regardless of the column and/or row of the empty shifted-to symbol position). Likewise, symbol staging area 364 is configured to display four different supplemental symbols at positions 364*a*, 364*b*, 364*c*, and 364*d*, wherein supplemental symbol 364*d* is an indicated supplemental symbol. As indicated by arrow 365*b*, the supplemental symbol at position 364*d* is shiftable into any of the symbol positions of the symbol matrix 370, regardless of where in the symbol matrix that empty symbol position is located. Finally, FIGS. 7A, 7B, 7C, 7D, 7E, and 7F each include game information display area 380, which enables the gaming device to communicate information to the player regarding the status of the game at various points in time during the play of the game.

In the embodiments illustrated in FIGS. 7A, 7B, 7C, 7D, 7E, and 7F, the gaming device is configured not to generate any high-value or major symbols (i.e., M1, M2, or M3 symbols) for display in the symbol positions of the symbol matrix 370. Rather, the gaming device is configured to generate high-value or major symbols only as supplemental symbols in one of the supplemental symbol display areas 362 or 364. Moreover, in the illustrated embodiment, the gaming device is relatively likely to generate high-value or major symbols in the supplemental symbol staging areas. In the illustrated embodiment, the gaming device can generate wild symbols (i.e., W symbols) in either the symbol matrix 370 or the supplemental symbol staging areas 362 and 364. It should thus be appreciated that as illustrated in FIGS. 7A, 7B, 7C, 7D, 7E, and 7F, if a winning symbol combination is initially generated for the play of the game (i.e., in the symbol matrix 370), the gaming device is relatively likely to shift one or more high-value symbols into the symbol matrix, and is thus relatively likely to generate an additional winning symbol combination associated with a relatively high-valued award for the play of the game.

Figure 7A:
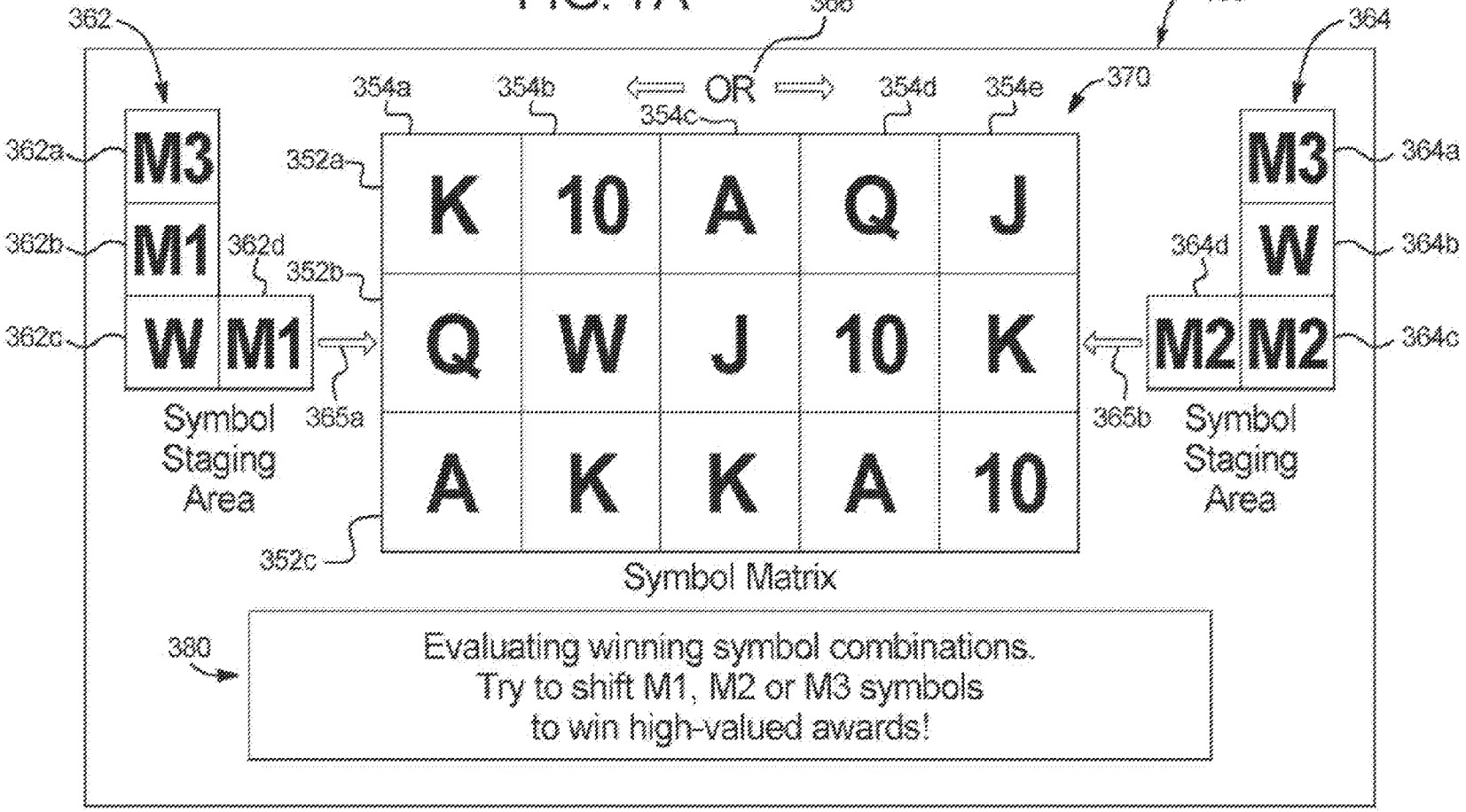
FIGS. 7A, 7B, 7C, 7D, 7E, and 7F are front elevation views of the display screen of an embodiment of the gaming device disclosed herein illustrating shifting or transferring symbols between a plurality of symbol staging areas and a symbol matrix, each symbol staging area including a single indicated supplemental symbol, wherein the symbols of the symbol staging areas are generated from a different set of symbols than the symbols of the symbol matrix.

Referring now to FIG. 7A, the gaming device disclosed herein is illustrated after having generated a plurality of symbols for the symbol positions of the symbol matrix 370, as well as after having generated a plurality of supplemental symbols for display in the symbol staging areas 362 and 364. As illustrated, the symbols of the symbol matrix 370 do not include any high-value symbols M1, M2, or M3. As similarly illustrated, the symbols of symbol staging areas 362 and 364 are primarily higher-valued major symbols M1, M2, and M3. The gaming device displays a message to the player, in game information display area 380, indicating that the gaming device is evaluating the symbols of the symbol matrix 370 to determine whether any winning symbol combinations are displayed. The message displayed in game information display area 380 also increases player excitement by informing the player that if the M1, M2, and M3 symbols are shifted into the symbol matrix, the player can receive higher-valued awards.

Figure 7B:
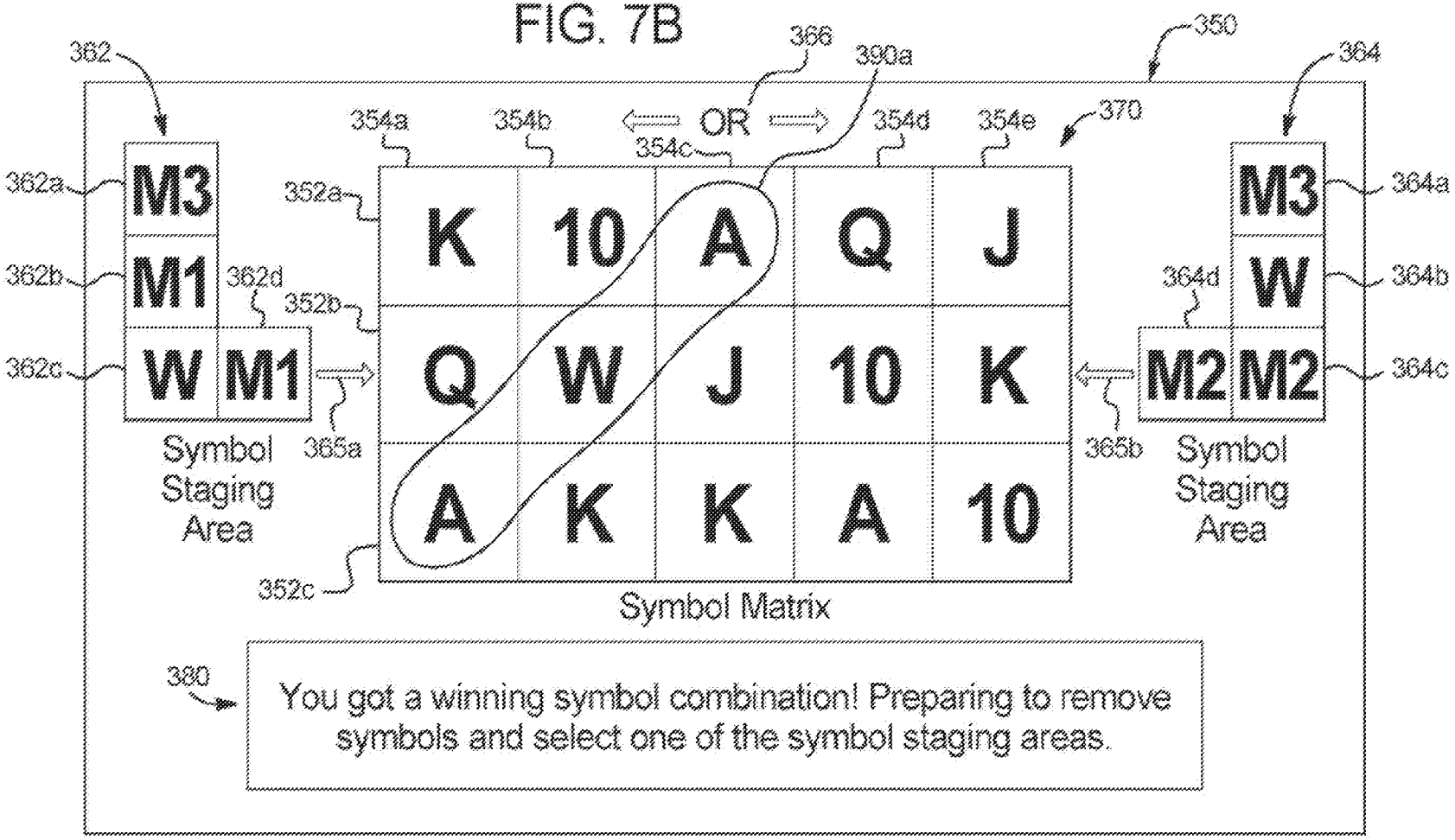

FIG. 7B illustrates the gaming device disclosed herein after evaluating the symbols initially displayed in the symbol matrix 370 to determine whether any winning symbol combinations are present. In the illustrated embodiment, the gaming device determined that a single winning symbol combination was present, the winning symbol combination indicated by numeral 390*a*. Winning symbol combination 390*a* includes an A symbol, a W symbol, and an A symbol, as illustrated. As noted above, the W symbol, which is a Wild symbol, is treated as an A symbol for purposes of determining whether a winning symbol combination has been generated. Game information display area 380 displays a message to the player indicating that a winning symbol combination was generated. Moreover, game information display area 380 displays a message indicating that the symbols of the winning symbol combination will be removed, and that the gaming device will select one of the symbol staging areas 362 or 364 from which to fill any empty symbol positions. It should be appreciated that the indication of a selected one of the symbol staging areas will be indicated using symbol staging area indicator 366.

Figure 7C:
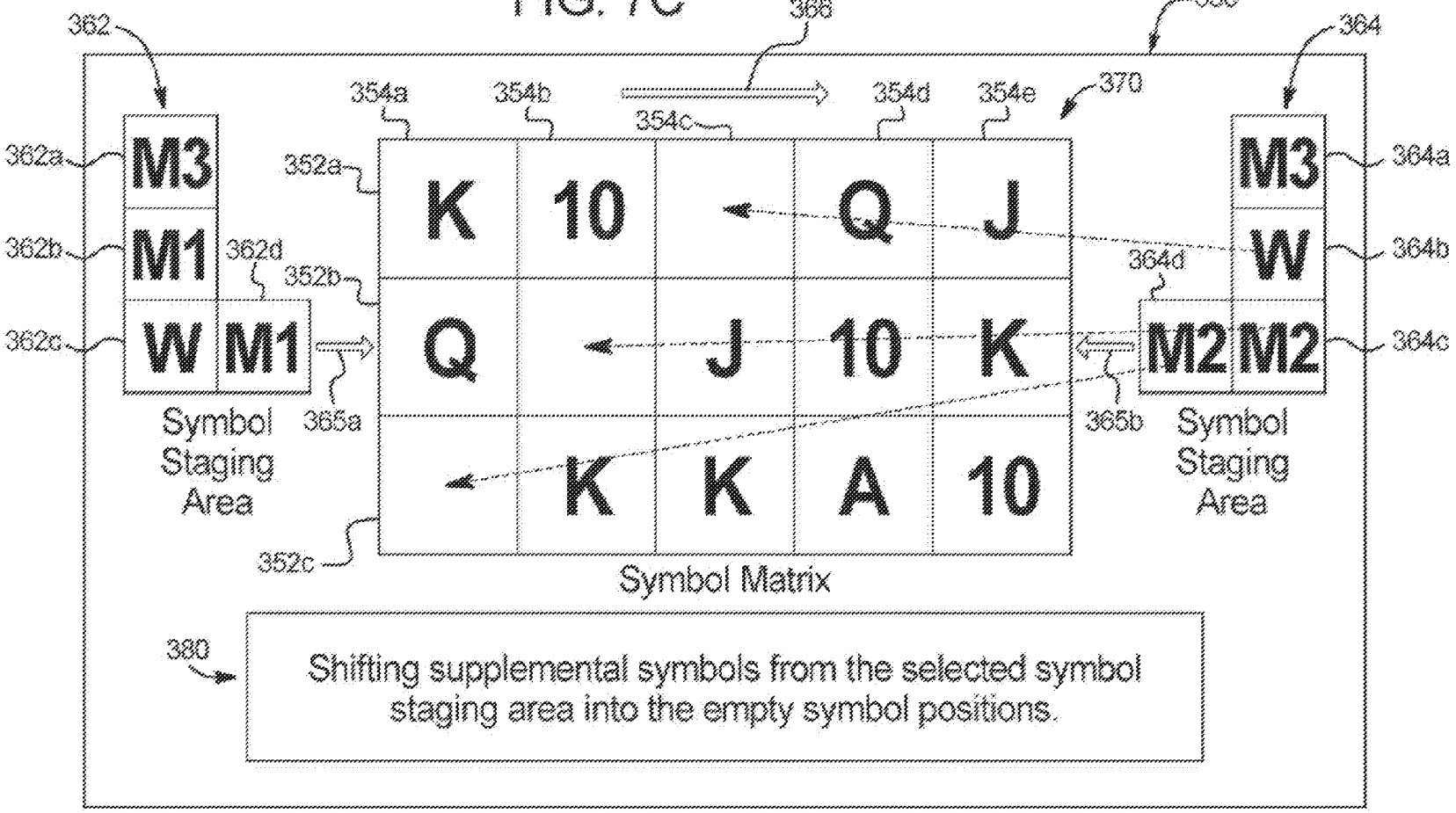

FIG. 7C illustrates the gaming device disclosed herein after removing the symbols from winning symbol combination 390*a*. Specifically, in the embodiment illustrated at FIG. 7C, the gaming device displays an empty symbol position at row 352*c* column 354*a*, at row 352*b* column 354*b*, and at row 352*a* column 354*c*. Moreover, as illustrated in FIG. 7C, the gaming device selected symbol staging area 364, indicated by the symbol staging area indicator 366. Thus, the gaming device will shift symbols from symbol staging area 364 to fill the empty symbol positions of the symbol matrix 370. Moreover, as indicated in FIG. 7C, the gaming device will shift the M2 symbol displayed at 364*d* into the empty symbol position at row 352*c* column 354*a* of the symbol matrix 370, will shift the M2 symbol displayed at 364*c* into the empty symbol position at row 352*b* column 354*b* of symbol matrix 370, and will shift the W symbol displayed at 364*b* into the empty symbol position at row 352*a* column 354*c* of symbol matrix 370. As discussed above, in one embodiment this shifting will occur serially, with each shifted symbol resulting in a shifting of the remaining symbols of the symbol staging area 364 toward the position 364*d*, and in a generation of a new symbol at the position 364*a*. The gaming device displays a message to the player, at game information display area 380, indicating that the gaming device is shifting the appropriate symbols from the selected symbol staging area into the empty symbol positions of the symbol matrix 370.

Figure 7D:
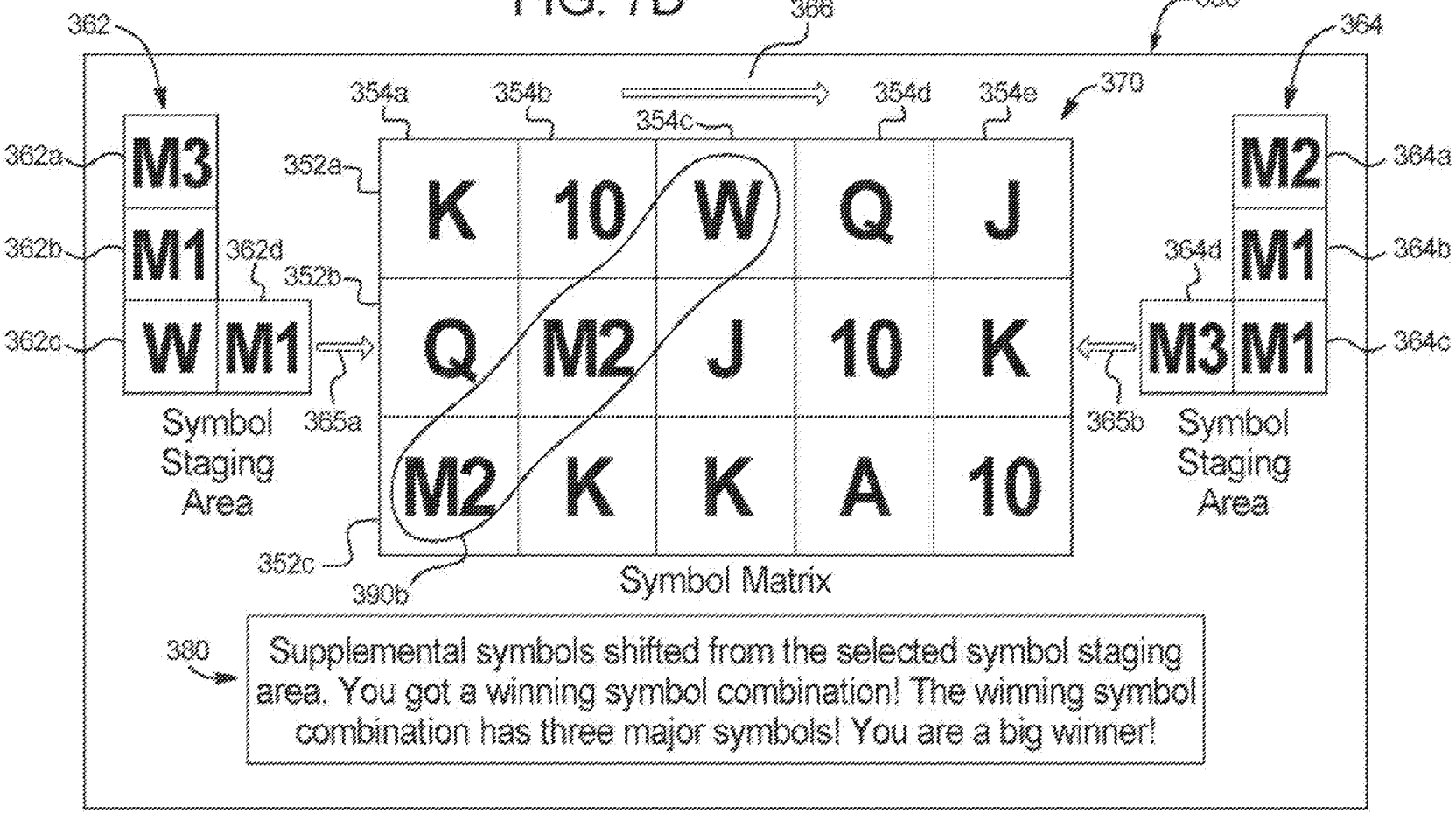

As illustrated at FIG. 7D, the gaming device has performed the shifting described above. Specifically, the gaming device has shifted the M3 symbol, previously displayed at position 364*a*, to position 364*d* of the indicated symbol staging area 364. Moreover, the gaming device has generated three additional symbols, including an M1 symbol, an M1 symbol, and an M2 symbol, at positions 364*c*, 364*b*, and 364*a*, respectively, of the indicated symbol staging area 364. In the illustrated embodiment, the gaming device evaluates the symbols of the symbol matrix 370 to determine whether any winning symbol combinations are displayed. As indicated in game information display area 380, the gaming device determines that new winning symbol combination 390*b* has been generated, the winning symbol combination including two high-value symbols M2 and M2, and a W symbol. The gaming device further indicates, at game information display area 380, that because the winning symbol combination 390*b* included high-value symbols, the winning symbol combination results in an award with a relatively high value due to the presence of the M2 symbols in the winning symbol combination. Thus, it should be appreciated that by shifting symbols from the supplemental symbol display area, the gaming device provided the player with an increased probability of receiving an award with a relatively high value based on the potential for shifting high-value symbols into the symbol matrix 370.

Figure 7E:
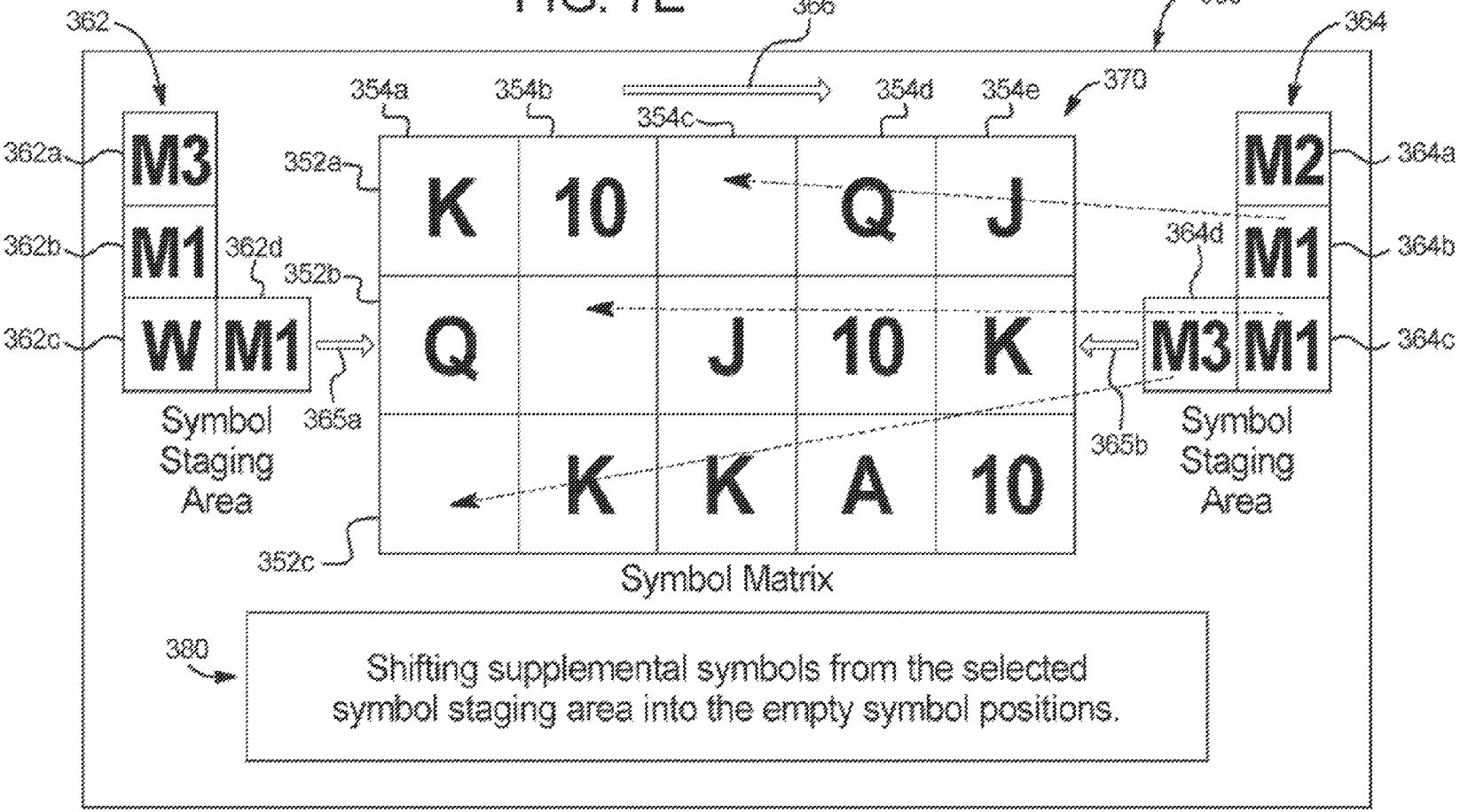

FIG. 7E illustrates the gaming device after removal of the symbols of winning symbol combination 390*b*. Specifically, the embodiment of the gaming device illustrated at FIG. 7E indicates empty symbol positions at row 352*c* column 354*a* of the symbol matrix 370, at row 352*b* column 354*b* of the symbol matrix 370, and at row 352*a* column 354*c* of the symbol matrix 370. As is further illustrated in FIG. 7E, the gaming device is preparing to shift an M3 symbol, an M1 symbol, and an M1 symbol into the three empty symbol positions, respectively. As discussed above, for each shifted symbol out of the indicated symbol staging area 364, the gaming device will shift the remaining symbols of the symbol staging area 364 toward position 364*d*, resulting in an appearance that the symbols are serially inserted into the symbol matrix from left-to-right. Moreover, for each shifted symbol, the gaming device will generate and display a new supplemental symbol in the symbol display area 364 at position 364*a*. The game information display area 380 indicates that the described shifting will occur for the selected symbol staging area 364.

Figure 7F:
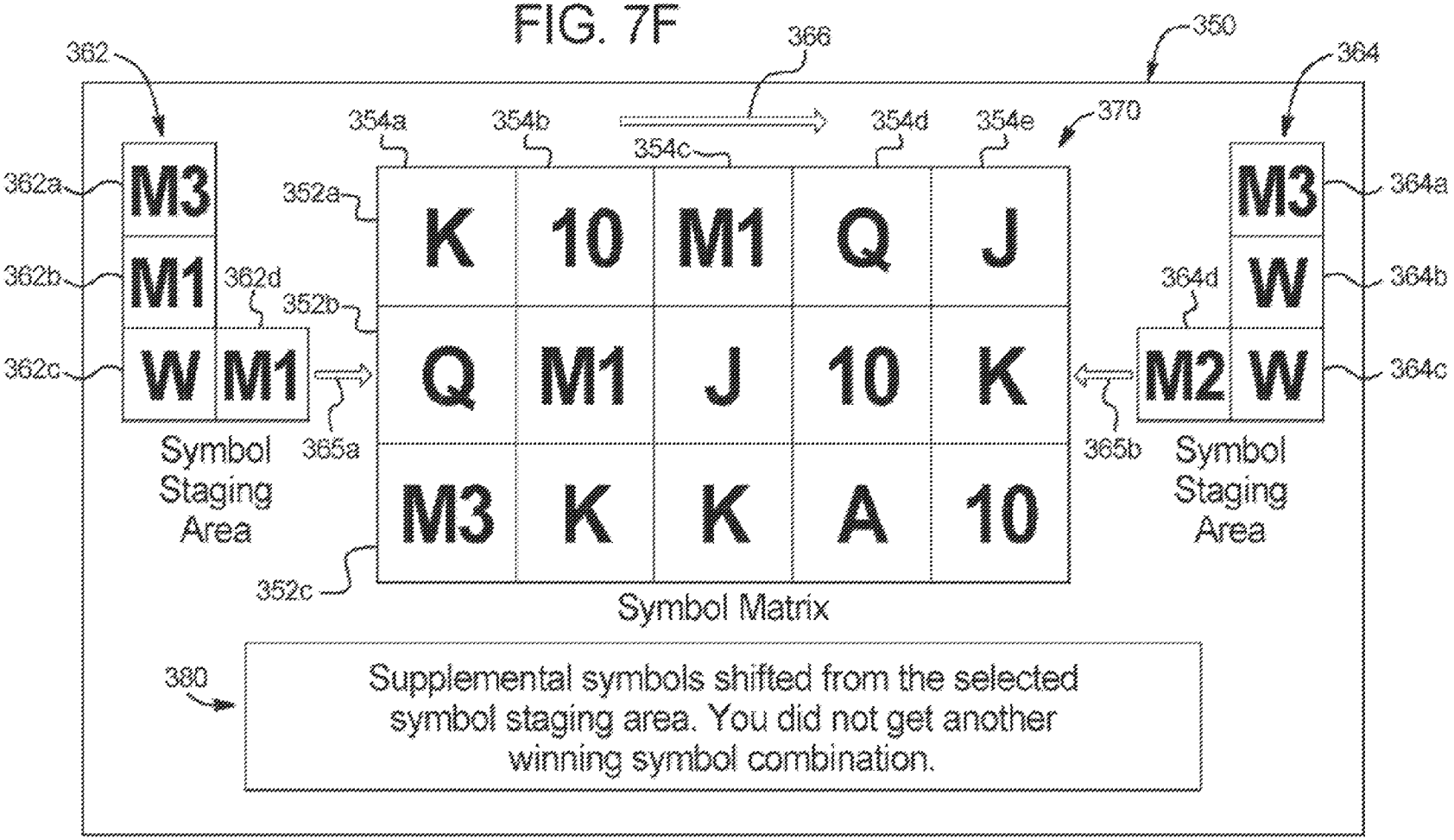

FIG. 7F illustrates the gaming device after the symbols previously displayed in the selected symbol staging area 364 are shifted into the appropriate empty symbol positions, as discussed above. In this embodiment, the gaming device has shifted the M2 symbol, previously at position 364*a*, to position 364*d*. It should be appreciated that if any further empty symbol positions are created for the play of the game, the M2 symbol displayed at position 364*d* will be the first symbol utilized to fill such empty symbol positions. Moreover, the gaming device has generated a W symbol, a W symbol, and an M3 symbol in positions 364*c*, 364*b*, and 364*a*, respectively. In the embodiment illustrated in FIG. 7F, the gaming device evaluates the symbols displayed in the symbol matrix 370 to determine whether any winning symbol combinations are present. Since in the illustrated embodiment no winning symbol combinations are present, the gaming device ends the play of the game. The game information display area 380 indicates that the symbols have been shifted from the symbol staging area, and that no additional winning symbol combinations were generated. In one embodiment, the gaming device provides an award based on any winning symbol combinations for the play of the game. In the embodiment illustrated in FIGS. 7A, 7B, 7C, 7D, 7E, and 7F, the gaming device would therefore provide an award based on winning symbol combinations 390*a* and 390*b*.

As discussed above, the embodiment illustrated in FIGS. 7A, 7B, 7C, 7D, 7E, and 7F, wherein major symbols are only generated for positions of the plurality of symbol staging areas, increases player excitement and enjoyment because when a winning symbol combination is generated for an initial display of a plurality of symbols of the symbol matrix (which do not include any major symbols), the gaming device provide the player an opportunity to shift one or more major symbols into the symbol matrix, and to potentially generate winning symbol combinations which include the shifted major symbols. Therefore, the gaming device provides the player an opportunity to win higher-valued awards after an initial generation of a winning symbol combination by forming winning symbol combinations using one or more major symbols shifted from the symbol staging areas.

In another embodiment (not shown), the gaming device determines that the combination of the M3 symbol, the M1 symbol, and the M1 symbol, displayed at row 352*c* and column 354*a*, row 352*b* and column 354*b*, and row 352*a* and column 354*c* of FIG. 7F, respectively, form a winning symbol combination. That is, in one embodiment any combination of three or more high-value or major symbols, regardless of which particular symbols are included in the combination, forms a winning symbol combination. It should be appreciated that in this embodiment, the gaming device would have determined that one winning symbol combination, including an M3 symbol, an M1 symbol, and an M1 symbol, is displayed in the symbol matrix 370 as illustrated in FIG. 7F. In this embodiment, the gaming device further increases player excitement and enjoyment because a winning combination of symbols is any combination of high-value or major symbols, regardless of which symbols are displayed. Thus, each subsequent shift from the symbol staging area is relatively likely to include many high-value symbols, and as a result, is relatively likely to result in further winning symbol combinations associated with higher-valued awards.

FIGS. 8A, 8B, 8C, 8D, 8E, 8F, 8G, 8H, and 8I illustrate an embodiment of the disclosed gaming device wherein shifting or transferring symbols occurs between a plurality of symbol staging areas and a symbol matrix, and wherein each of the plurality of symbol staging areas includes a plurality of different indicated supplemental symbols, each indicated supplemental symbol associated with a different subset of the symbol matrix. FIGS. 8A, 8B, 8C, 8D, 8E, 8F, 8G, 8H, and 8I each illustrate a screen 450 of a gaming device for displaying one or more plays of a game as disclosed herein. In the illustrated embodiment, the gaming device displays two symbol staging areas 462 and 464, a symbol matrix 470, and a game information display area 480. Symbol staging area 462 includes a plurality of positions 462*a*, 462*b*, 462*c*, and 462*d*, each position displaying a supplemental symbol potentially usable to fill an empty symbol position of the symbol matrix 470. Likewise, symbol staging area 464 includes a plurality of supplemental symbols in symbol positions 464*a*, 464*b*, 464*c*, and 464*d*, each potentially usable to fill one or more empty symbol positions. The gaming device includes a symbol staging area indicator 466 for indicating one of the symbol staging areas for a play of the game.

Finally, each of the symbol staging areas 462 and 464 includes a plurality of indicated supplemental symbols, each indicated supplemental symbol associated with a different subset of the symbol matrix 470. In the illustrated embodiment, arrow 465*a* indicates that the supplemental symbol displayed at position 462*b* is associated with the top row 452*a* of the symbol matrix 470. Thus, the supplemental symbol at position 462*b* is potentially usable to fill any empty symbol position which is generated in row 452*a*. Arrow 465*b* indicates that the supplemental symbol displayed at position 462*c* is associated with the middle row 452*b* of the symbol matrix 470, and is therefore usable to fill empty symbol positions in row 452*b*. Arrow 465*c* indicates that the supplemental symbol at position 462*d* is associated with the bottom row 452*c*, and is usable to fill empty symbol positions in row 452*c*. Similarly, for symbol staging area 464, arrows 467*a*, 467*b*, and 467*c* indicate that the supplemental symbols at positions 464*b*, 464*c*, and 464*d* are associated with the top row 452*a*, the middle row 452*b*, and the bottom row 452*c*, respectively.

Figure 8A:
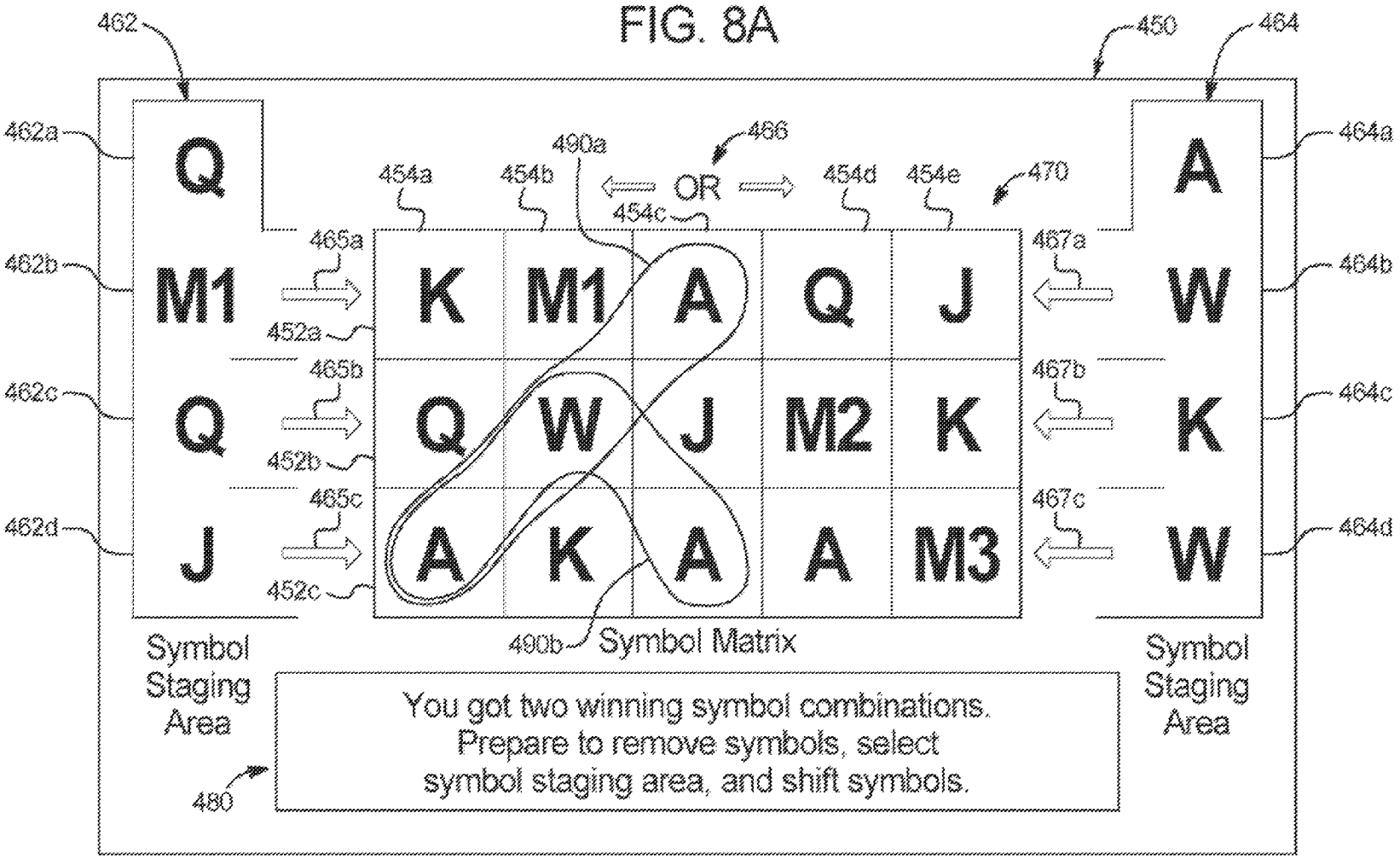
FIGS. 8A, 8B, 8C, 8D, 8E, 8F, 8G, 8H, and 8I are front elevation views of the display screen of an embodiment of the gaming device disclosed herein illustrating shifting or transferring symbols between a plurality of symbol staging areas and a symbol matrix, each symbol staging area including a plurality of indicated supplemental symbols.

FIG. 8A further indicates that for the play of the game, the generated symbols of the symbol matrix 470, when evaluated, form two winning symbol combinations 490*a* and 490*b*. The game information display area 480 indicates that two winning symbol combinations were generated, and indicates that the symbols included in those winning symbol combinations will be removed, a symbol staging area will be selected utilizing the symbol staging area indicator 466, and the appropriate supplemental symbols will be shifted into the appropriate empty symbol positions.

Figure 8B:
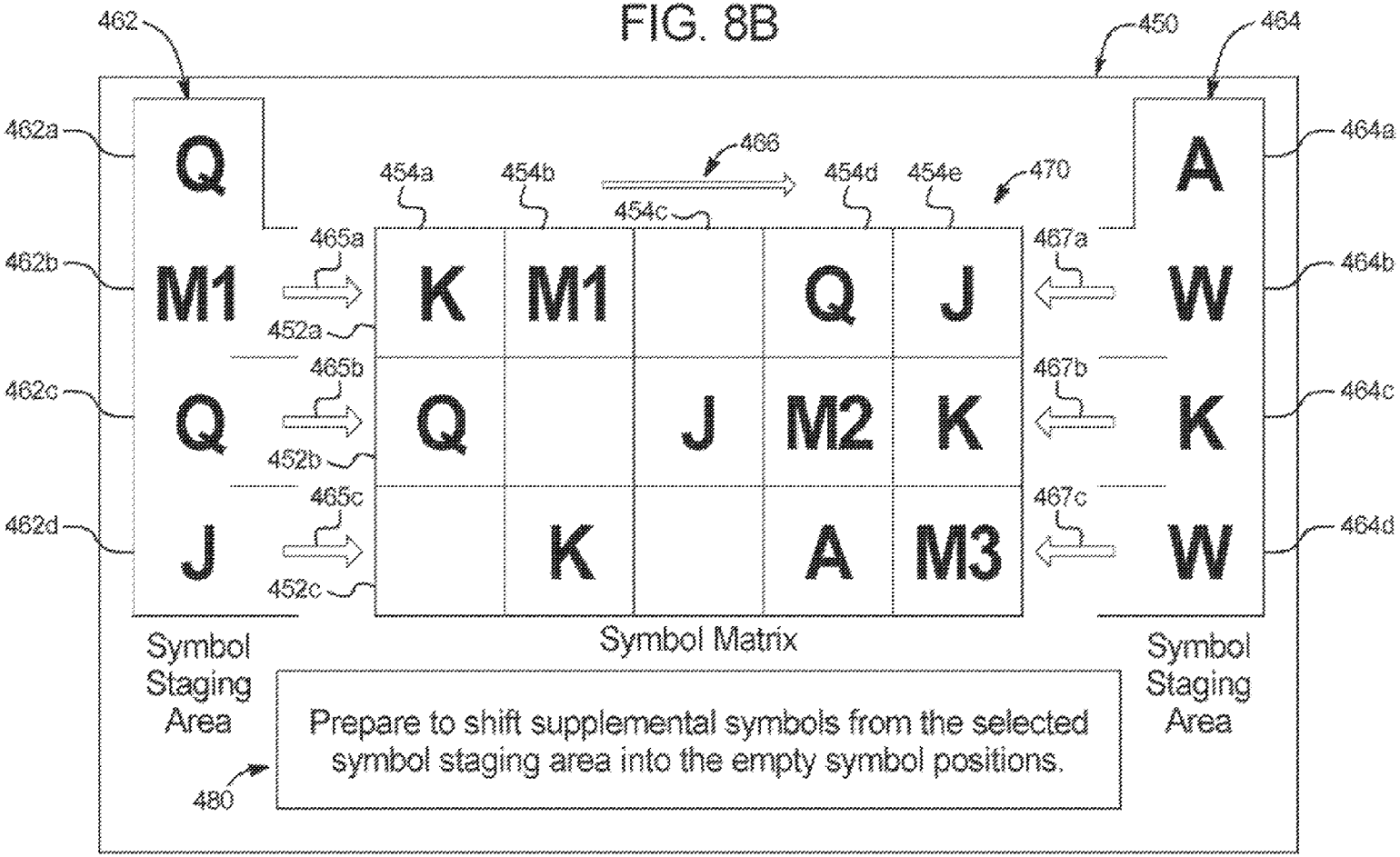

Referring now to FIG. 8B, the gaming device disclosed herein has removed the symbols included in winning symbol combinations 490*a* and 490*b*, resulting in empty symbol positions at row 452*a* column 454*c*, row 452*b* column 454*b*, row 452*c* column 454*a*, and row 454*c* column 454*c*. Moreover, in the illustrated embodiment, the symbol staging area indicator 466 indicates that the gaming device has selected symbol staging area 464 for use in shifting symbols into the empty symbol positions of the symbol matrix 470. Game information display area displays a message indicating that the gaming device is preparing to shift supplemental symbols from the indicated symbol staging area (i.e., symbol staging area 464) into the empty symbol positions of the symbol matrix. It should therefore be appreciated that to fill the empty symbol positions, the gaming device will shift the appropriate indicated supplemental symbol as indicated by the arrows 467*a*, 467*b*, and 467*c*.

Figure 8C:
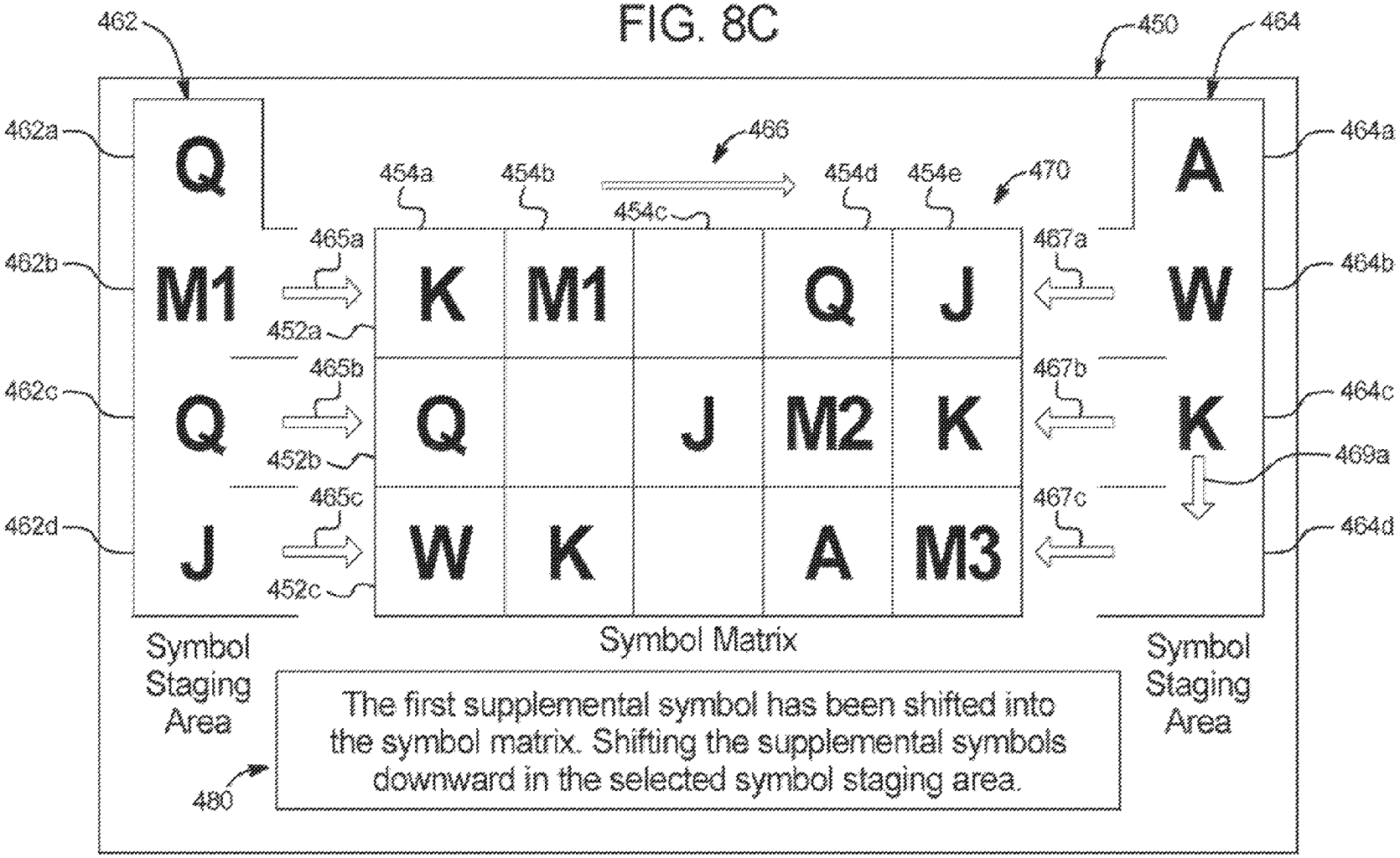

In the illustrated embodiment, the gaming device begins the process of filling the empty symbol positions by filling any empty symbol positions in the bottom row 452*c* of the symbol matrix 470. Specifically, to fill the empty symbol position at row 452*c* column 454*a*, the gaming device shifts the indicated supplemental W symbol at position 464*d* into the empty symbol position at row 452*c* column 454*a*. It should be appreciated that the gaming device shifts the symbol at position 464*d* because position 464*d* is associated with the bottom row 452*c* of the symbol matrix, as indicated by arrow 467*c*. Upon shifting the symbol at position 464*d*, and as illustrated in FIG. 8C, the gaming device shifts the remaining symbols of the selected symbol staging area 464 downward to fill the empty position at 464*d*, and generates a new symbol at symbol position 464*a*. It should be appreciated that arrow 469*a* indicates such downward shifting. It should also be appreciated that after such downward shifting, the newly displayed K symbol at symbol position 464*d* is the indicated supplemental symbol for purposes of the bottom row 452*c* of the symbol matrix 470. Moreover, it should be appreciated that in the illustrated embodiment, the gaming device does not shift any other supplemental symbols into an empty symbol position of the symbol matrix prior to shifting the supplemental symbols of the symbol staging area 464 downward.

The game information display area 480 of FIG. 8C indicates that the first supplemental symbol has been shifted, and that the remaining supplemental symbols are being shifted downward within the symbol staging area.

Figure 8D:
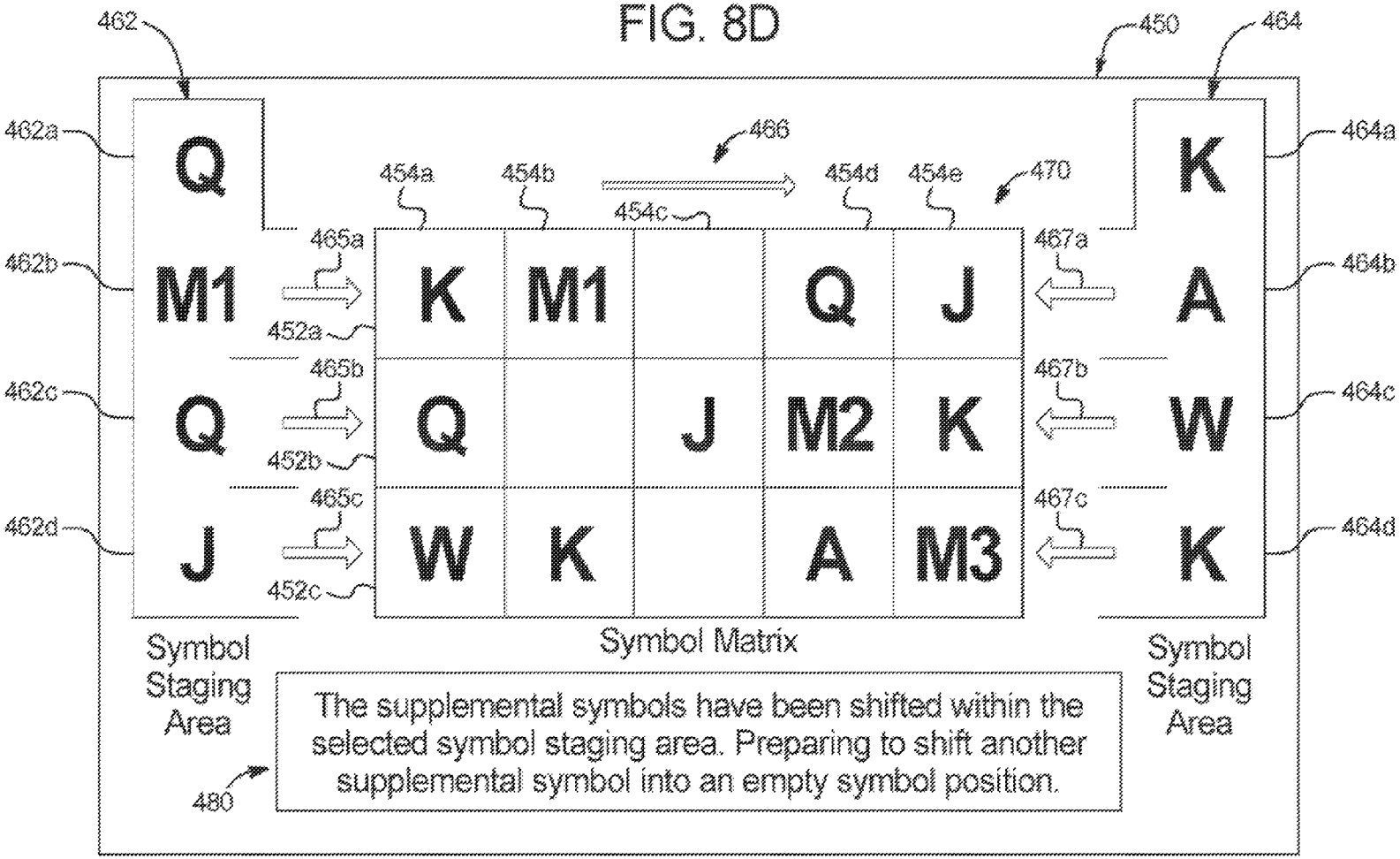

FIG. 8D illustrates that a new supplemental K symbol has been generated and displayed at symbol position 464*a* of supplemental symbol display area 464. Game information display area 480 indicates that the supplemental symbols have been shifted, and that the gaming device is preparing to fill another empty symbol position of the symbol matrix 470 with one of the supplemental symbols from the indicated symbol staging area. It should be appreciated that the next empty symbol position to be filled in the illustrated embodiment is the symbol position at row 452*c* and column 454*c*.

Figure 8E:
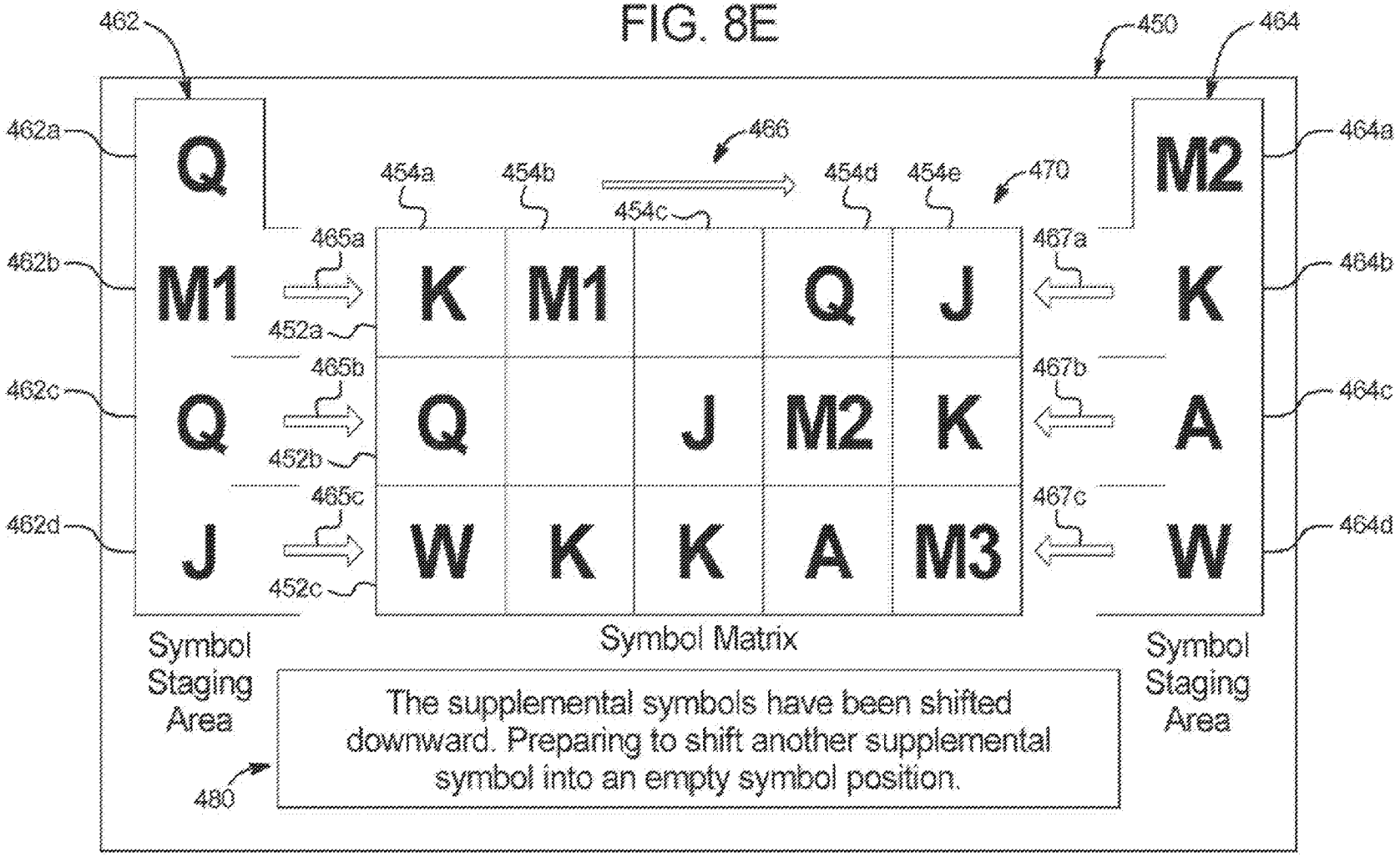

FIG. 8E illustrates the gaming device after shifting the K symbol previously displayed at position 464*d* (as illustrated in FIG. 8D) of symbol staging area 464 into the empty symbol position at row 452*c* and column 454*c*. In the illustrated embodiment of FIG. 8E, the gaming device has also shifted the remaining symbols of symbol staging area 464 downward, and has generated a new M2 symbol at position 464*a*. The game information display area 480 indicates that the supplemental symbols of symbol staging area 464 have been shifted downward, and that the gaming device is preparing to shift another supplemental symbol to fill an empty symbol position. It should be appreciated that the symbol position to be filled is the symbol position at row 452*b* and column 454*b*. Moreover, as indicated by arrow 467*b*, the supplemental symbol to be shifted into the empty symbol position is the A symbol displayed at position 464*c*, as position 464*c* is associated with row 452*b* in which the empty symbol position is present.

Figure 8F:
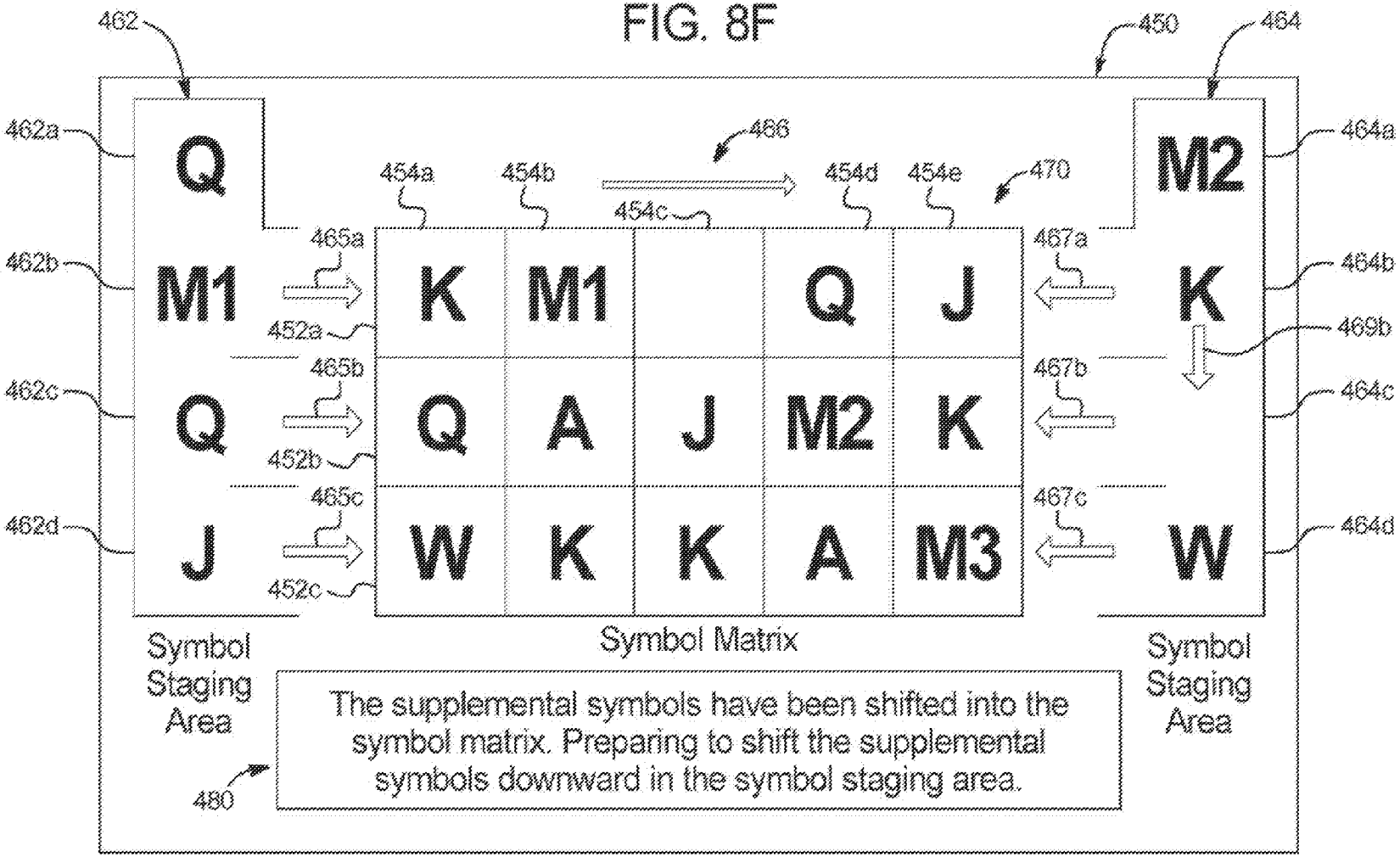

FIG. 8F illustrates the symbol matrix 470 after the A symbol was shifted from position 464*c* of the indicated symbol staging area 464 into the previously empty symbol position at row 452*b* column 452*b*, as indicated by arrow 467*b*. Arrow 469*b* of FIG. 8F indicates that the symbols at positions 464*b* and 464*a* are being shifted downward within the symbol staging area 464. It should be appreciated that the gaming device will also generate a new supplemental symbol for display in position 464*a* of the symbol staging area 464. Game information display area 480 indicates that the supplemental symbol previously at position 464*c* has been shifted into the empty symbol position of the symbol matrix (i.e., the A symbol at row 452*b* and column 454*b*) and that the remaining supplemental symbols have been shifted downward within the supplemental symbol display area.

Figure 8G:
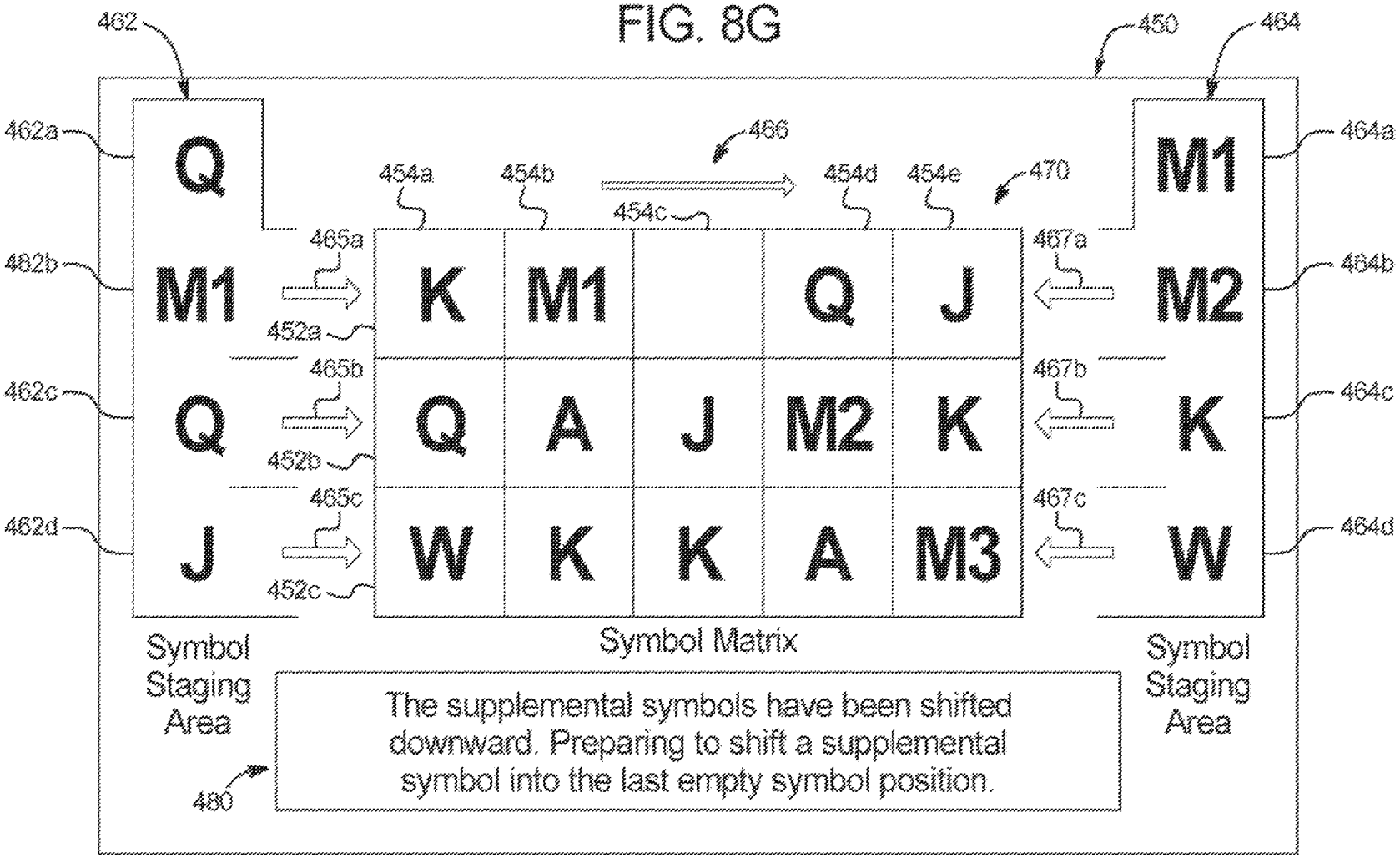

FIG. 8G illustrates the symbol staging area 464 after shifting the symbols contained therein downward and generating a new M1 symbol at symbol position 464*a*. The game information display area 480 indicates that the supplemental symbols have been shifted downward, and indicates that one of the supplemental symbols will be shifted into the only remaining empty symbol position of the symbol matrix 470. It should be appreciated that as indicated by arrow 467*a*, the supplemental M2 symbol at position 464*b* will be shifted into the empty symbol position at row 452*a* and column 454*c*, as the symbol position 464*b* is associated with row 452*a*.

Figure 8H:
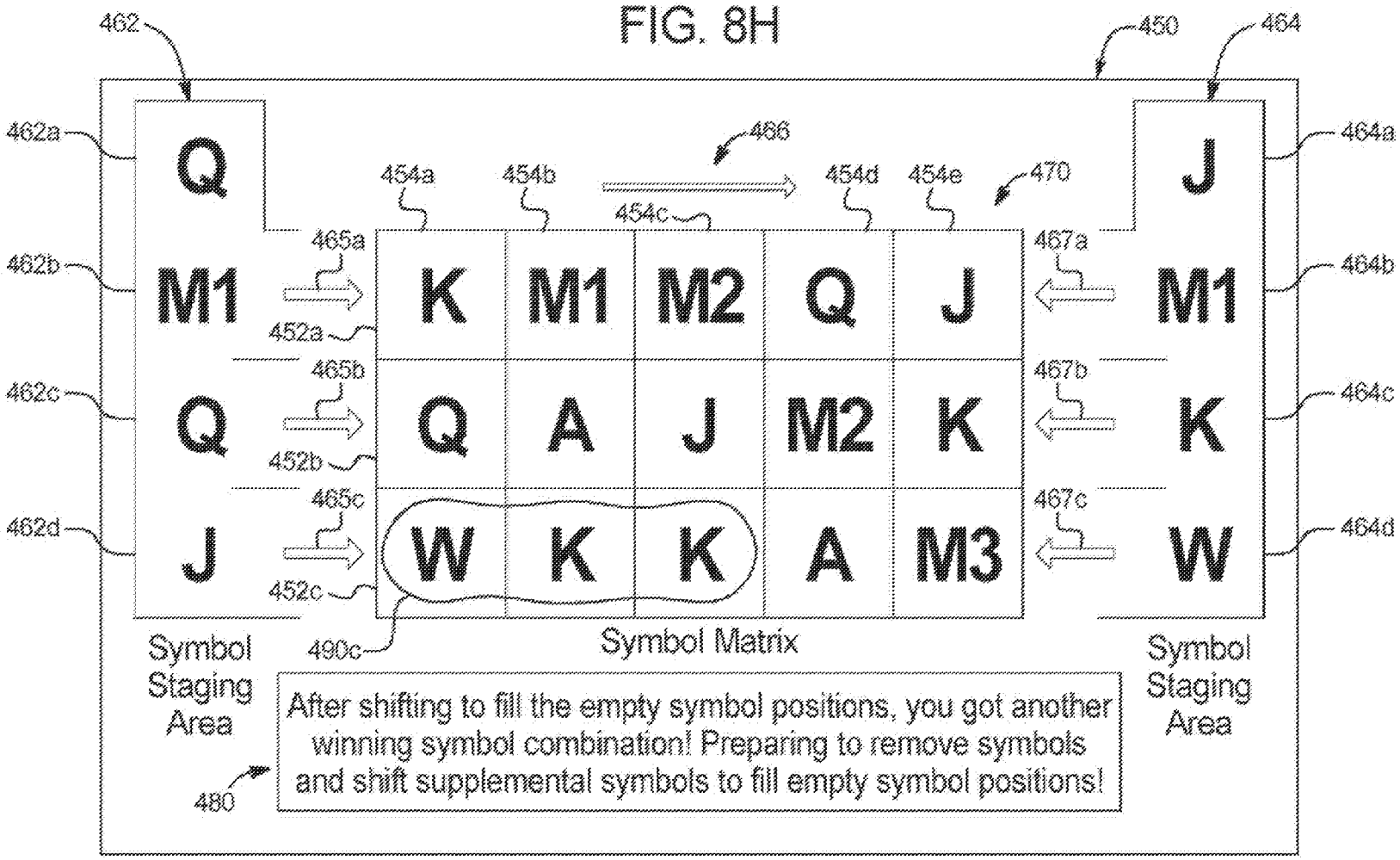

FIG. 8H illustrates the symbol matrix 470 after shifting the M2 symbol into the symbol position at row 452*a* and column 454*c*. As is further illustrated in FIG. 8H, the gaming device has shifted the M1 symbol downward within the symbol staging area 464 (from position 464*a* to position 464*b*), and has generated a new J symbol at symbol position 464*a*. Moreover, the gaming device evaluates the symbols of the symbol matrix to determine whether any winning symbol combinations are generated. In the illustrated embodiment, winning symbol combination 490*c* was generated. As such, the gaming device indicates the presence of winning symbol combination 490*c*, and displays a message at game information display area 480 indicating that the winning symbol combination 490*a* was generated. Game information display area 480 also indicates that the symbols of winning symbol combination 490*a* will be removed, and that the empty symbol positions created by such removal will be filled with supplemental symbols from symbol staging area 464.

Figure 8I:
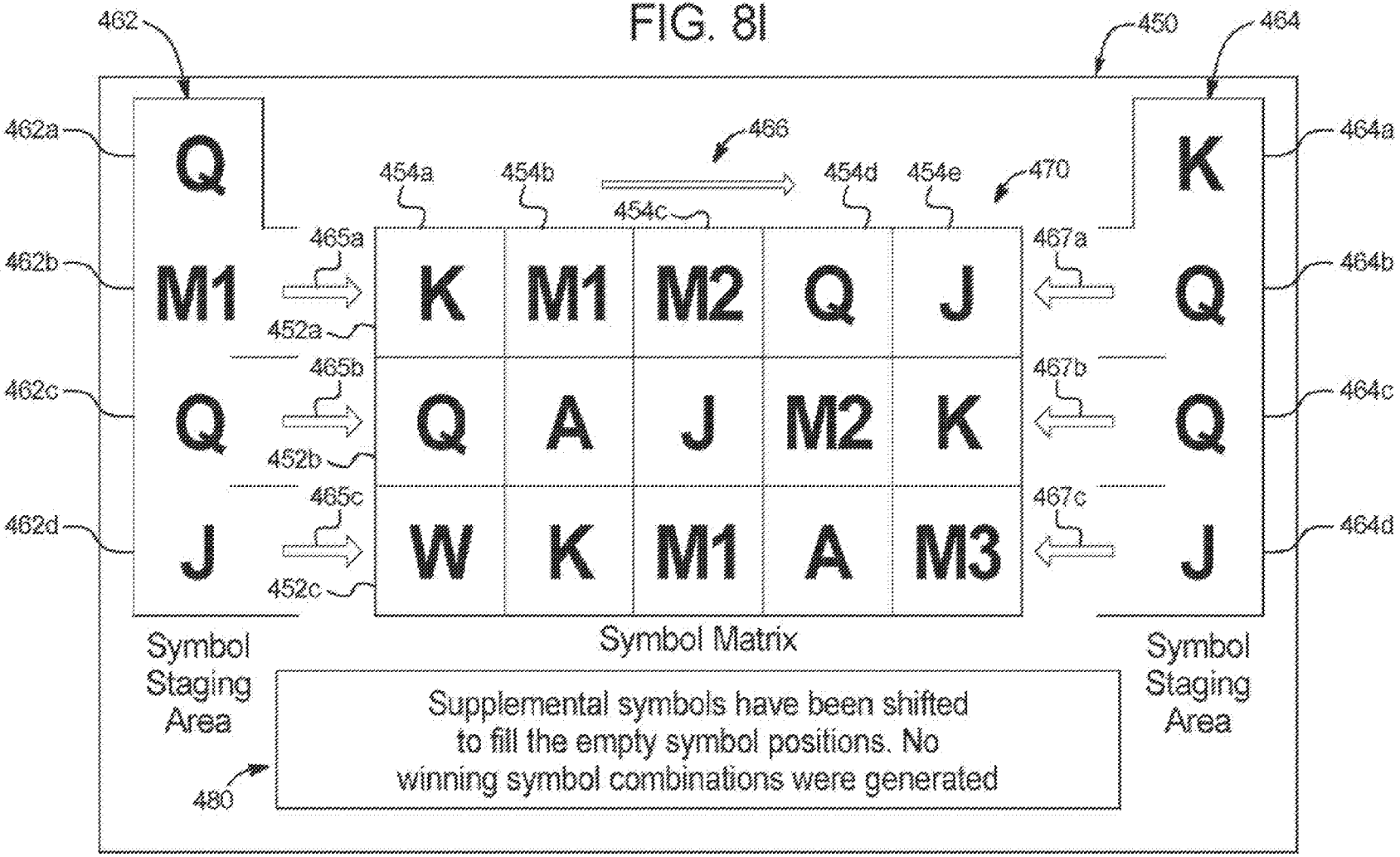

Referring to FIG. 8I, the gaming device disclosed herein has shifted the W symbol, the K symbol, and the M1 symbol from positions 464*d*, 464*c*, and 464*b* into the empty symbol positions at row 452*c* column 454*a*, row 452*c* column 454*b*, and row 452*c* column 454*c*, respectively. It should be appreciated that in one embodiment, for each symbol shifted into an empty symbol position, the gaming device shifted the remaining supplemental symbols downward within symbol staging area 464 such that each symbol which was shifted to fill an empty symbol position was shifted from position 464*d*, as indicated by arrow 467*c*. As indicated by game information display area 480 of FIG. 8I, no additional winning symbol combinations are generated, ending the play of the game. In one embodiment, the gaming device provides the player an award based on the winning symbol combinations generated during the play of the game. In the illustrated embodiment, the gaming device would provide an award for winning symbol combinations 490*a*, 490*b*, and 490*c*.

In the embodiment illustrated by FIGS. 8A, 8B, 8C, 8D, 8E, 8F, 8G, 8H, and 8I, it should be appreciated that the gaming device shifted any symbols from the symbol staging area directly to the empty symbol position in which the supplemental symbol was to be positioned. That is, no internal shifting of symbols within the symbol matrix occurred prior to the shifting of a supplemental symbol from a symbol staging area into the symbol matrix. FIGS. 9A, 9B, 9C, 9D, 9E, 9F, 9G, 9H, and 9I illustrate an embodiment of the gaming device disclosed herein wherein one or more symbols of the symbol matrix are shifted into one or more empty symbol positions prior to shifting a supplemental symbol from one of the supplemental symbol staging areas into the symbol matrix.

Referring now to FIGS. 9A, 9B, 9C, 9D, 9E, 9F, 9G, 9H, and 9I, the gaming device displays symbol staging areas 462 and 464, symbol staging area indicator 466, symbol matrix 470, and game information display area 480, as in FIGS. 8A, 8B, 8C, 8D, 8E, 8F, 8G, 8H, and 8I. Moreover, arrows 465*a*, 465*b*, and 465*c* indicate that positions 462*b*, 462*c*, and 462*d* are associated with rows 452*a*, 452*b*, and 452*c*, respectively, as in FIGS. 8A, 8B, 8C, 8D, 8E, 8F, 8G, 8H, and 8I. Finally, arrows 467*a*, 467*b*, and 467*c* indicate that positions 464*b*, 464*c*, and 464*d* are associated with rows 452*a*, 452*b*, and 452*c*, respectively, as in FIGS. 8A, 8B, 8C, 8D, 8E, 8F, 8G, 8H, and 8I.

Figure 9A:
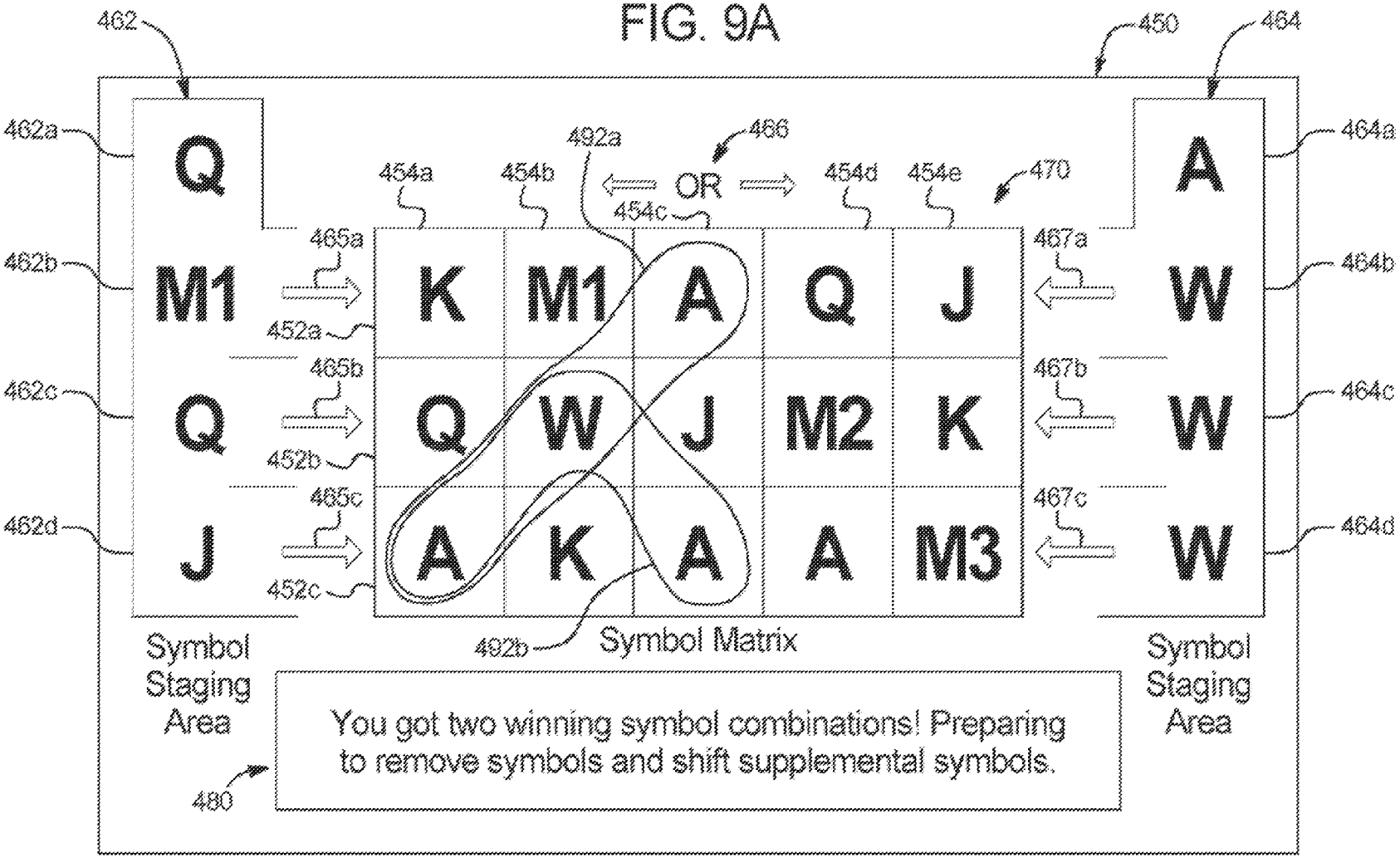
FIGS. 9A, 9B, 9C, 9D, 9E, 9F, 9G, 9H, and 9I are front elevation views of the display screen of another embodiment of the gaming device disclosed herein illustrating shifting or transferring symbols within a symbol matrix and between a plurality of symbol staging areas and a symbol matrix, each symbol staging area including a plurality of indicated supplemental symbols.

FIG. 9A indicates that the gaming device determines two winning symbol combinations 492*a* and 492*b* for the evaluation of the symbols generated and displayed in the symbol matrix 470. In the illustrated embodiment, the gaming device displays a message in game information display area 480 indicating the presence of such winning symbol combinations.

Figure 9B:
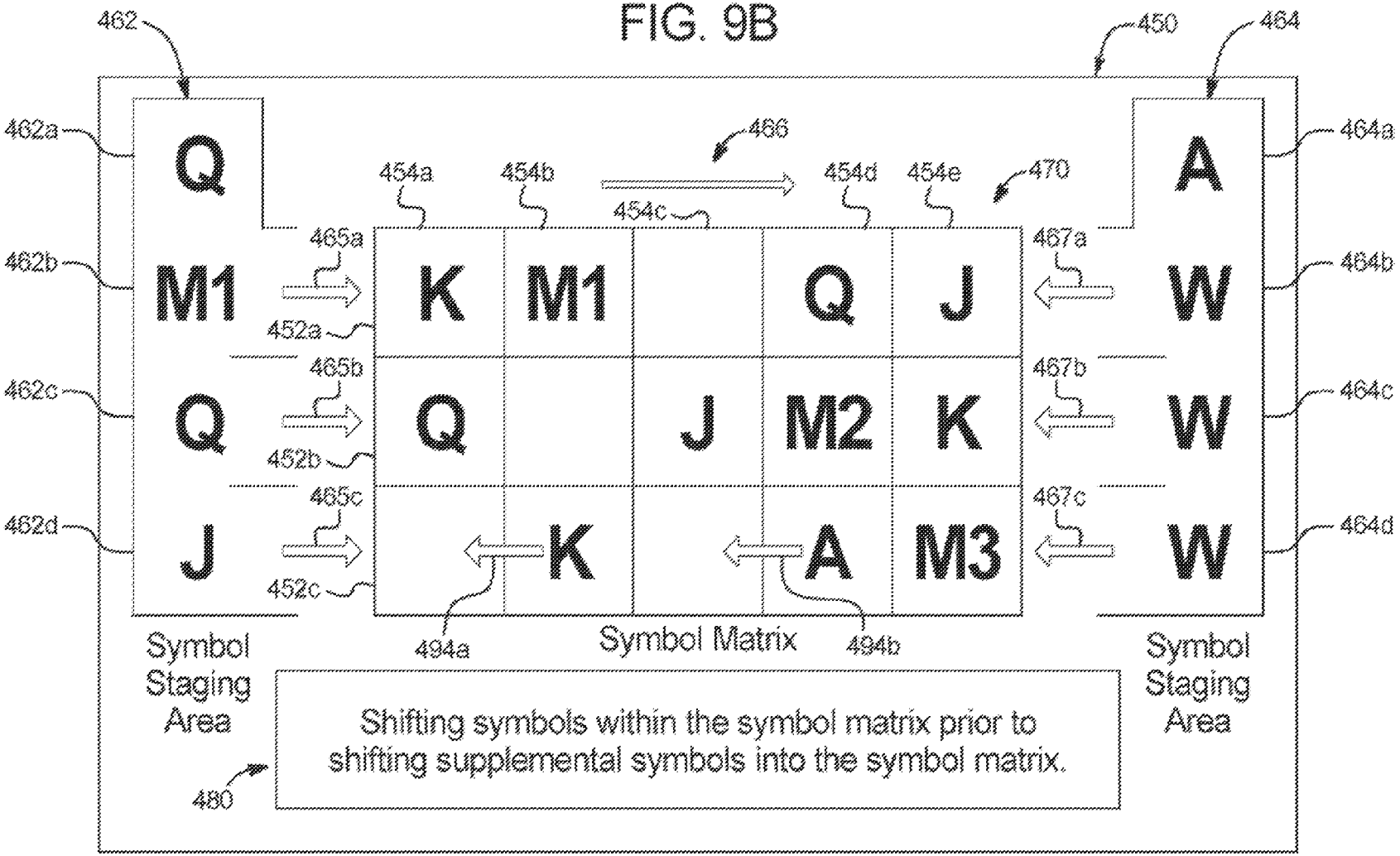

As indicated in FIG. 9B, the gaming device thereafter removes the symbols from winning symbol combinations 492*a* and 492*b*, resulting in empty symbol positions at row 452*c* column 454*a*, row 452*c* column 454*c*, row 452*b* column 454*b*, and row 452*a* column 452*c*. Moreover, the gaming device indicates via symbol staging area indicator 466 that symbol staging area 464 will be utilized to fill certain empty symbol positions during the play of the game. It should be appreciated that in this embodiment, the gaming device makes a determination of one of the symbol staging areas 462 or 464 usable to fill empty symbol positions of the symbol matrix for each row of the symbol matrix in which an empty symbol position is displayed. Thus, in the illustrated embodiment, the gaming device indicates that symbol staging area 464 will be utilized to fill empty symbol positions occurring in the bottom row 452*c* of the symbol matrix 470.

Referring still to FIG. 9B, the gaming device indicates at game information display area 480 that symbols of the symbol matrix will be shifted within the symbol matrix prior to shifting one or more supplemental symbols from an indicated symbol staging area. Arrows 494*a* and 494*b* illustrate the shifting that will occur within the symbol matrix 470. Specifically, arrows 494*a* and 494*b* indicate that the symbols remaining in row 452*c* of the symbol matrix 470 will be shifted to the left as far as possible while maintaining the relative order of the symbols. That is, after shifting the symbols to the left, the bottom row 452*c* of the symbol matrix will display the following symbols, from left to right: K symbol; A symbol; M3 symbol; empty symbol position; empty symbol position.

Figure 9C:
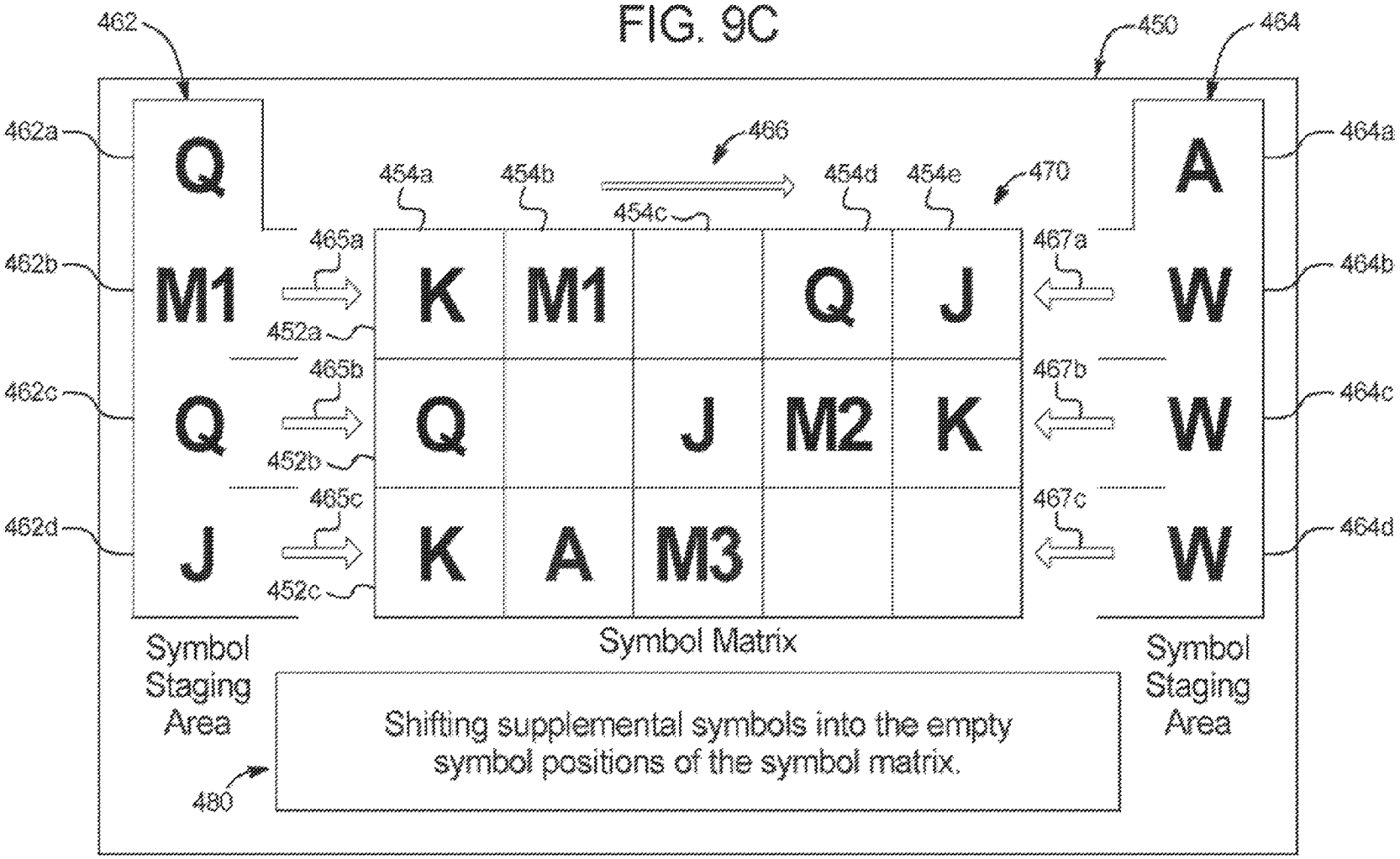

FIG. 9C illustrates symbol matrix 470 after shifting the symbols within the bottom row 452*c* of the symbol matrix to the left as far as possible. FIG. 9C further illustrates, in game information display area 480, that the gaming device will next shift any appropriate indicated supplemental symbols from the indicated symbol staging area 464 into the empty symbol positions of the bottom row of the symbol matrix 470.

Figure 9D:
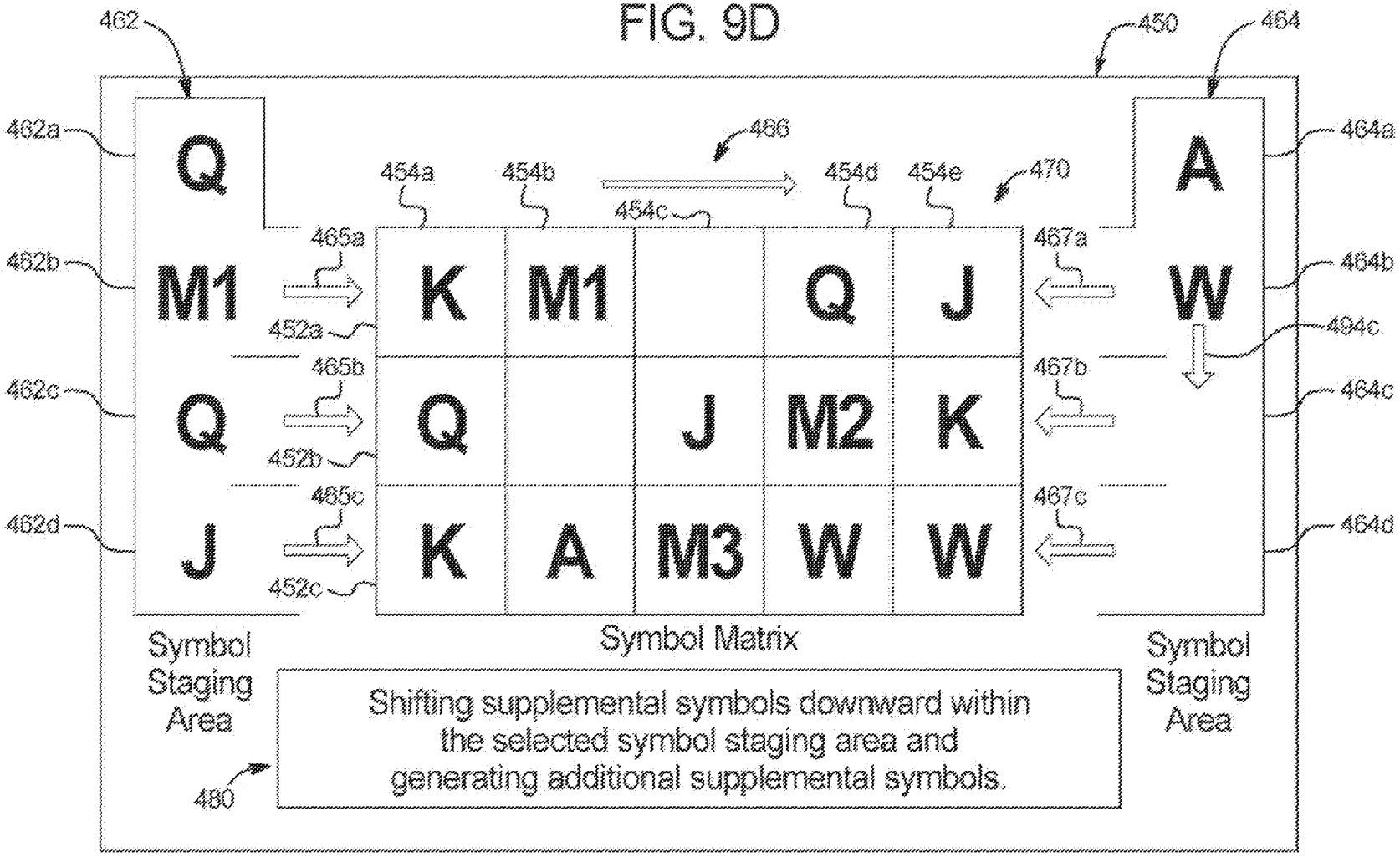

FIG. 9D illustrates the gaming device after shifting the W symbol previously at position 464*d* into the symbol position at row 452*c* column 454*d*, and after shifting the W symbol previously at position 464*c* into the symbol position at row 452*c* column 454*e*. As illustrated, the bottom row 452*c* of the symbol matrix is thereafter populated with symbols (i.e., there are no displayed empty symbol positions). Moreover, arrow 494*c* indicates that the symbols remaining in the symbol staging area 464 will be shifted downward as far as possible to fill the symbol staging area.

Figure 9E:
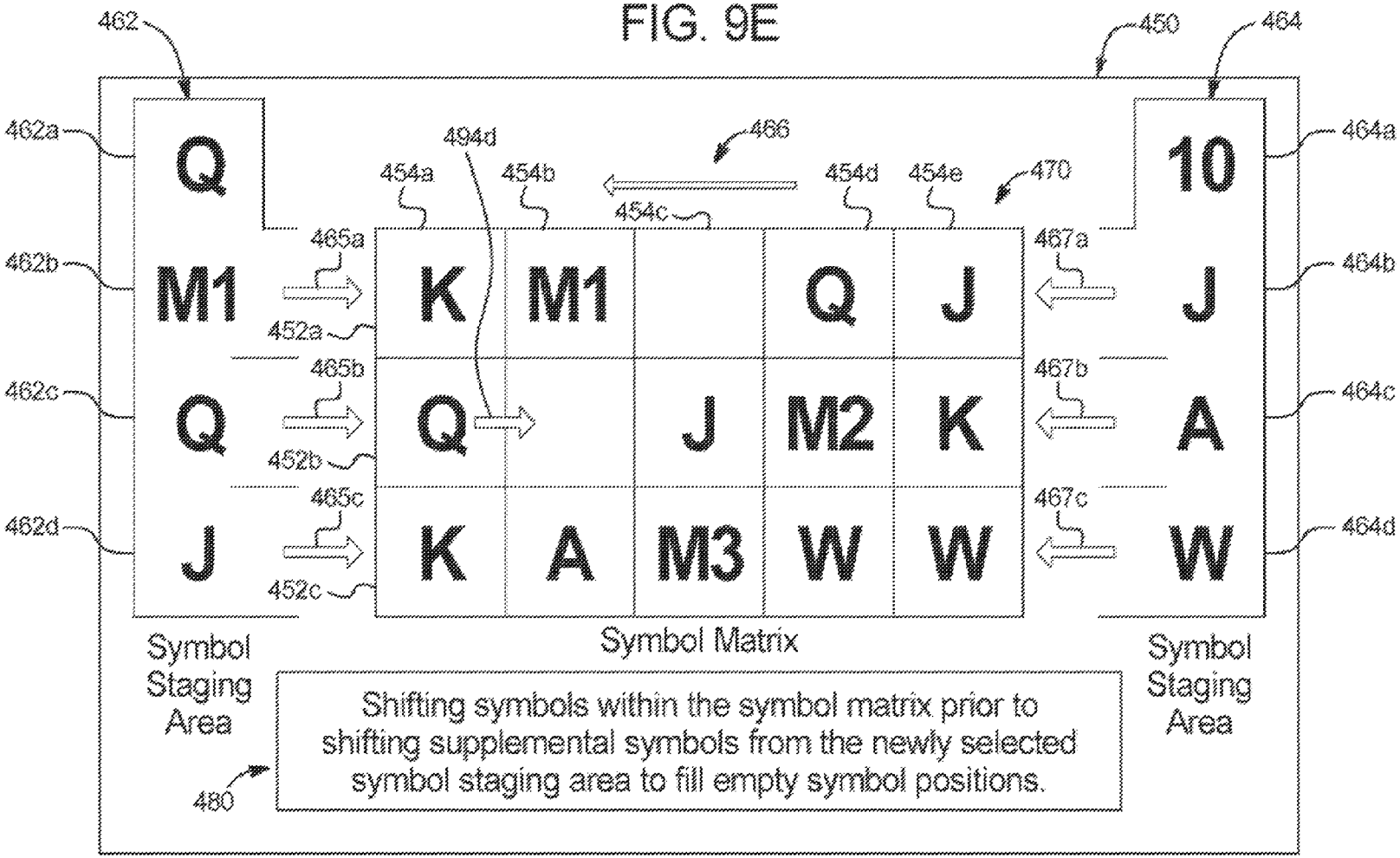

FIG. 9E illustrates symbol staging area 464 after shifting the supplemental symbols downward, and after generating a new J symbol and a new 10 symbol for display in positions 464*b* and 464*a*, respectively. It should be appreciated that in one embodiment, each of the W symbols was shifted from position 464*d*; that is, in one embodiment, the gaming device is configured to shift the symbols of the symbol staging area downward as far as possible following each shift of an indicated supplemental symbol into the symbol matrix. Moreover, as illustrated, the gaming device shifted the symbols from position 464*d* into the symbol matrix because of the association of position 464*d* with the bottom row of the symbol matrix 470, as indicated by arrow 467*c*.

Referring again to FIG. 9E, the gaming device in the illustrated embodiment makes another determination regarding which of the symbol staging areas to utilize to fill an empty symbol position. In the illustrated embodiment, the gaming device determines that it will utilize symbol staging area 462 to fill the next empty symbol position, as indicated by the symbol staging area indicator 466. This functionality is in contrast to the functionality displayed above with respect to FIGS. 8A, 8B, 8C, 8D, 8E, 8F, 8G, 8H, and 8I, wherein the gaming device only determined one of the two symbol staging areas once for the play of the game, as opposed to determining one of the symbol staging areas for each row of the symbol matrix.

Further, as illustrated by arrow 494*d* of FIG. 9E, the gaming device will shift the Q symbol displayed at row 452*d* column 454*a* into the empty symbol position at row 452*d* column 454*b* prior to shifting a supplemental symbol into an empty symbol position of the symbol matrix. Game information display area 480 indicates the shifting of the Q symbol within the symbol matrix prior to shifting a supplemental symbol from the symbol staging area 462 into the symbol matrix 470.

Figure 9F:
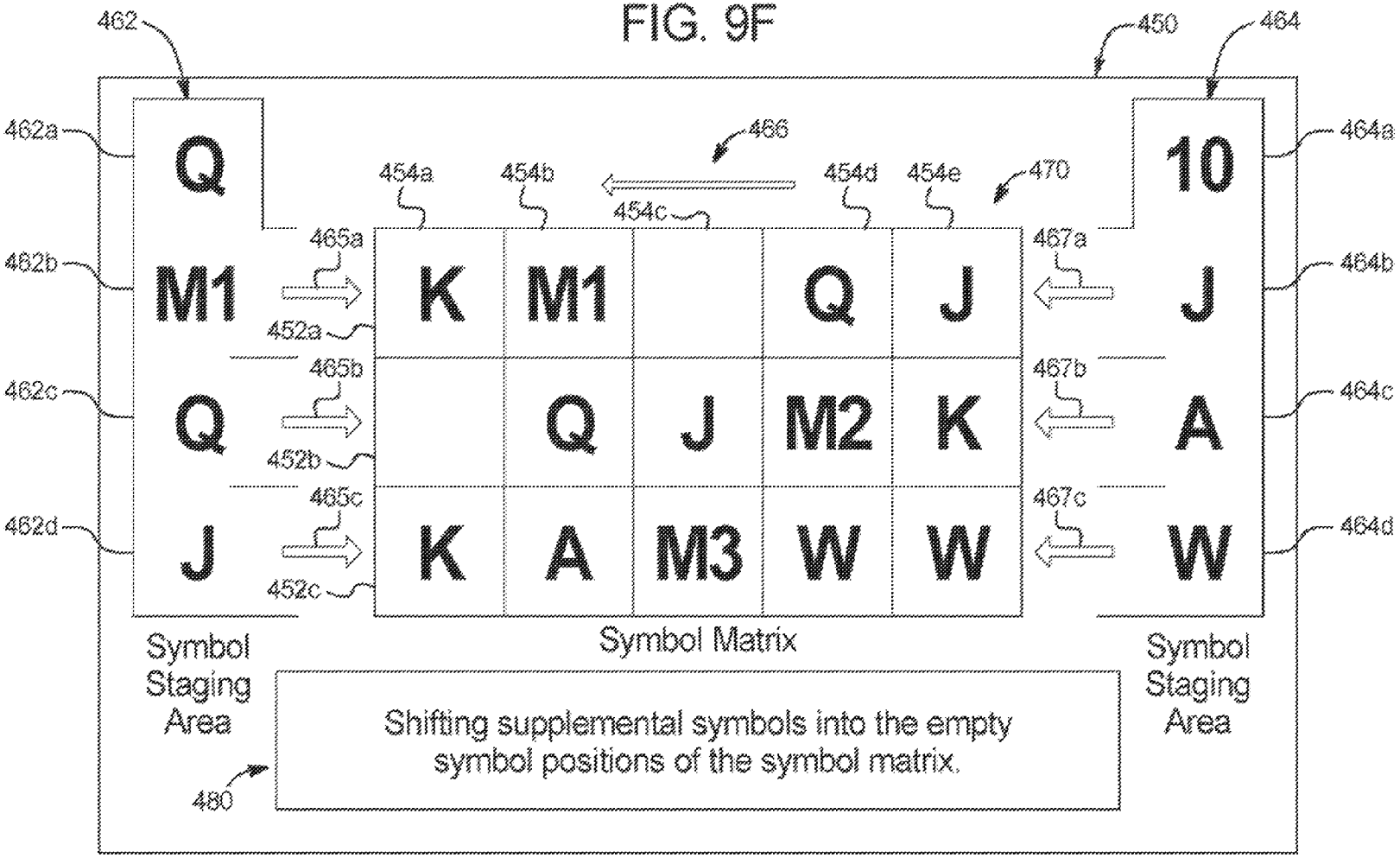

FIG. 9F illustrates the symbol matrix 470 after performing the internal shifting described with respect to FIG. 9E. Moreover, the game information display area of FIG. 9F indicates that the gaming device will shift one or more supplemental symbols into one or more empty symbol positions. Since position 462*c* is associated with the middle row of the symbol matrix, as indicated by arrow 465*b*, the supplemental symbol displayed at position 462*c* is an indicated supplemental symbol and will be utilized to fill any empty symbol positions in the middle row of the symbol matrix. Thus, the gaming device will shift the Q symbol displayed at position 462*c* into the empty symbol position at row 452*b* column 454*a*.

Figure 9G:
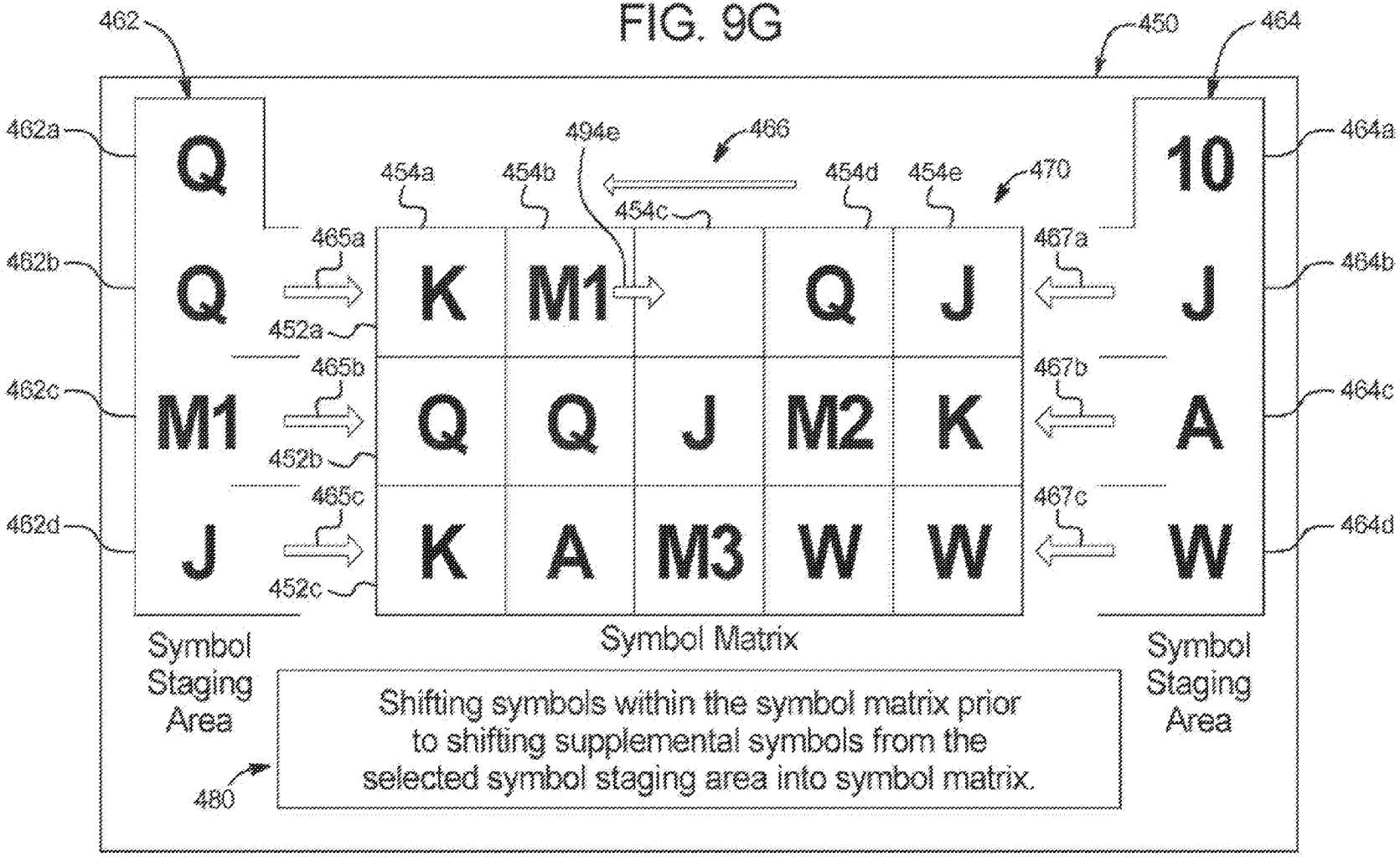

FIG. 9G illustrates the symbol matrix 470 after shifting the Q symbol of the position 462*b* into the symbol matrix, as described above with respect to FIG. 9F. It should be further appreciated that upon filling the empty symbol position as described, the gaming device shifted the M1 symbol and the Q symbol, previously displayed at positions 262*b* and 262*a*, respectively, downward within the symbol staging area 262. To fill the created empty symbol position, the gaming device randomly generated another Q symbol, displayed in position 462*a* of FIG. 9G.

As illustrated in FIG. 9G, the gaming device again determines that it will utilize symbol staging area 462 to fill any empty symbol positions of the top row of the symbol matrix 470. This determination is indicated by symbol staging area indicator 466. Once again, this is in contrast to the embodiment discussed with respect to FIGS. 8A, 8B, 8C, 8D, 8E, 8F, 8G, 8H, and 8I, wherein the gaming device only indicated a symbol staging area once for the play of the game.

Since the remaining empty symbol position at row 452*a* and column 454*c* is in the top row of the symbol matrix, arrow 465*a* indicates that the gaming device will shift the Q symbol displayed at position 462*a* into the symbol matrix 470. As above, arrow 494*e* indicates that the K symbol and the M1 symbol, displayed at row 452*a* column 454*a* and row 452*a* column 454*b*, respectively, will be shifted to the right prior to shifting the indicated supplemental symbol displayed at position 462*a* into the symbol matrix. Game information display area 480 indicates this internal shifting prior to shifting a supplemental symbol into the symbol matrix.

Figure 9H:
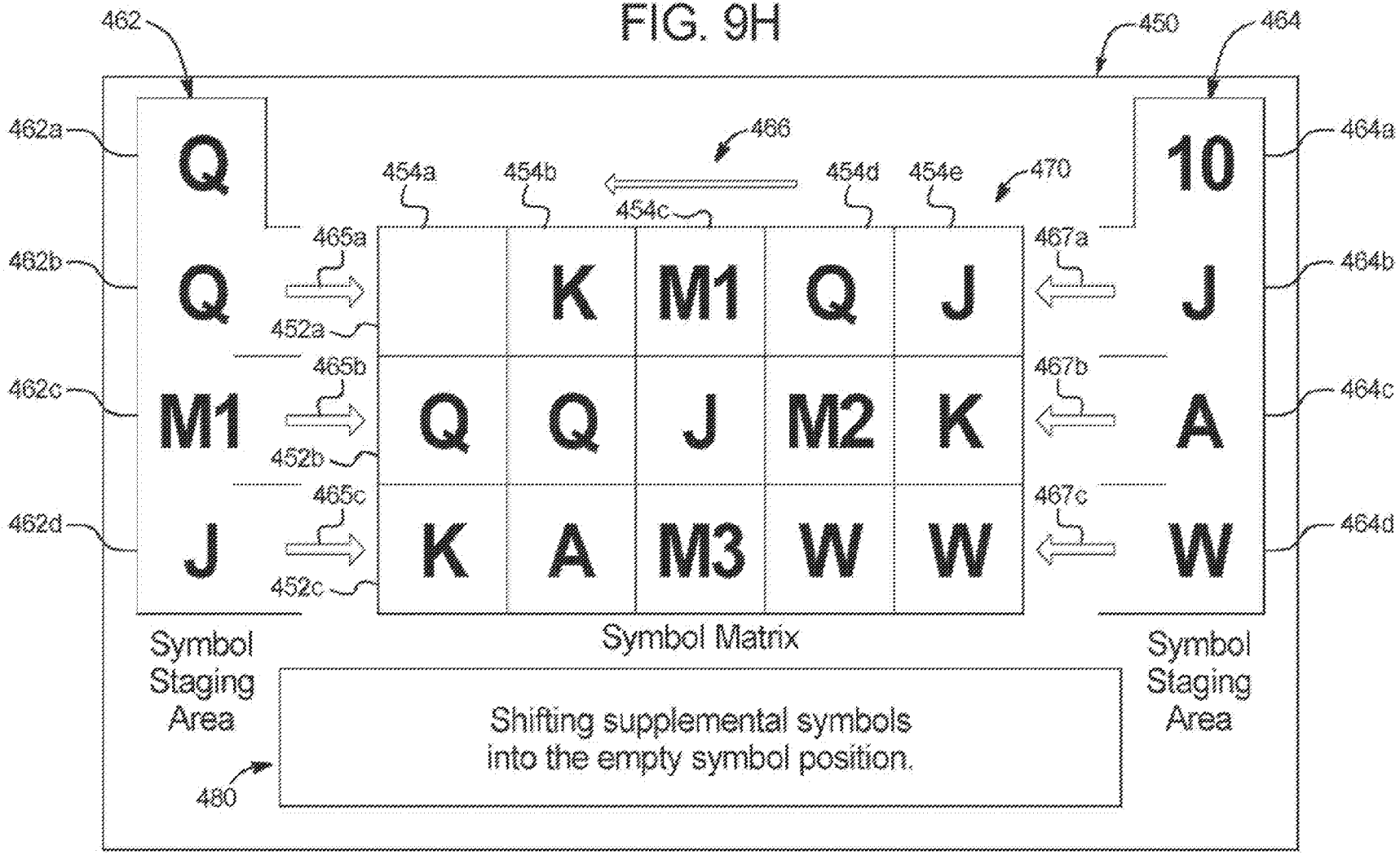

FIG. 9H illustrates the symbol matrix after internally shifting the K symbol and the M1 symbol within row 452*a*, as discussed above. The internal shifting results in an empty symbol position at row 452*a* column 454*a*, which empty symbol position will be filled by shifting the indicated supplemental Q symbol at position 462*b* of symbol staging area 462 into the symbol matrix 470. Game information display area 480 indicates that this shifting is imminent.

Figure 9I:
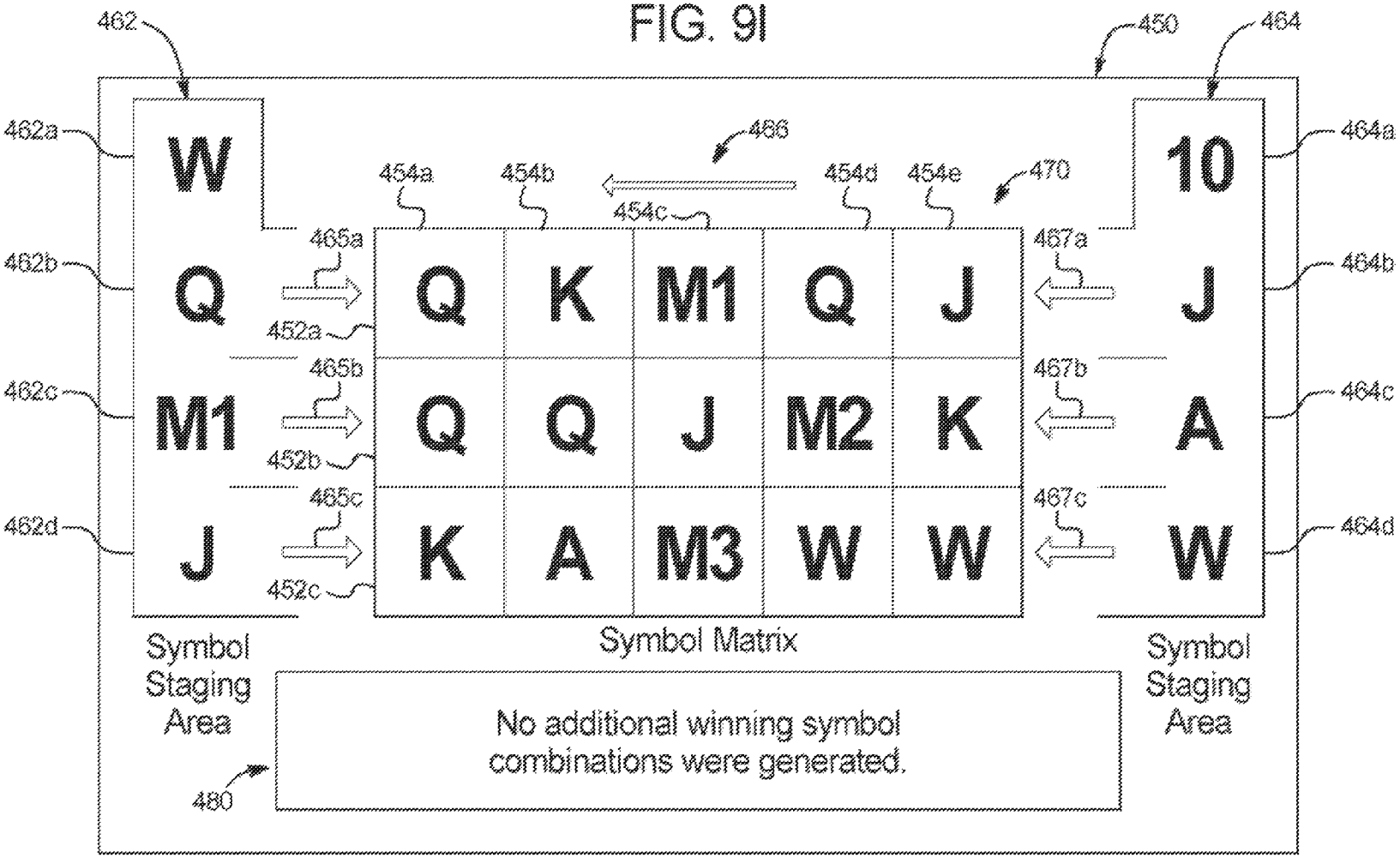

FIG. 9I illustrates the symbol matrix 470 after shifting the Q symbol previously displayed at position 462*b* into the previously empty symbol position at row 452*a* column 452*a*. In the illustrated embodiment, the gaming device has shifted the Q symbol previously displayed at position 462*a* downward, and has newly generated a W symbol at symbol position 462*a*. The gaming device evaluates the currently-displayed symbols of the symbol matrix to determine whether any winning symbol combinations are displayed. As indicated by the game information display area 480, no such winning combinations are displayed. Thus, the gaming device ends the play of the game. In one embodiment, the gaming device provides the player with an award (not shown), such as an award based on winning symbol combinations 492*a* and 492*b*.

Figure 10A:
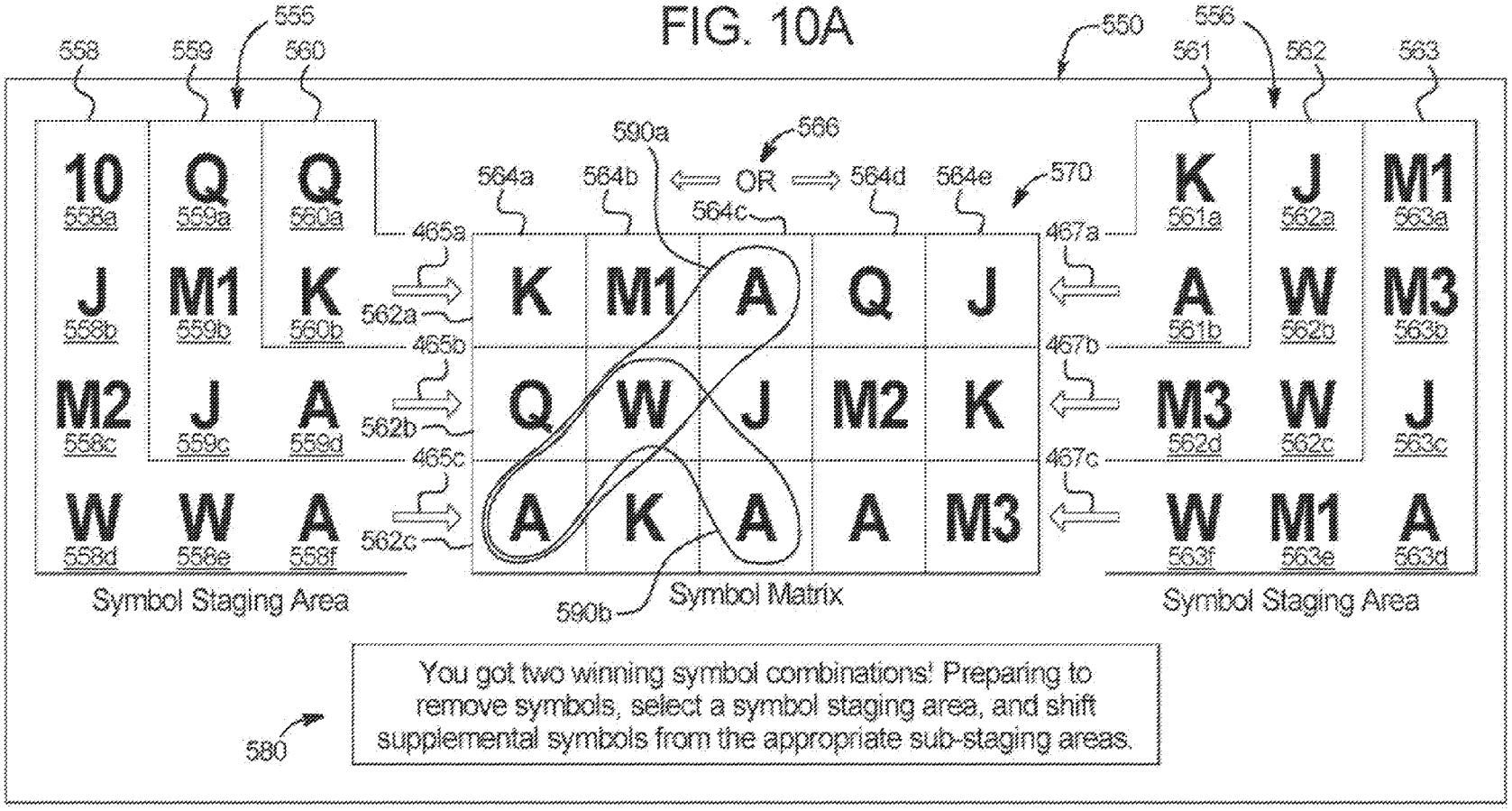
FIGS. 10A, 10B, and 10C are front elevation views of the display screen of still another embodiment of the gaming device disclosed herein illustrating shifting or transferring symbols between a plurality of symbol staging areas and a symbol matrix, each symbol staging area including a plurality of indicated supplemental symbols.
Figure 10B:
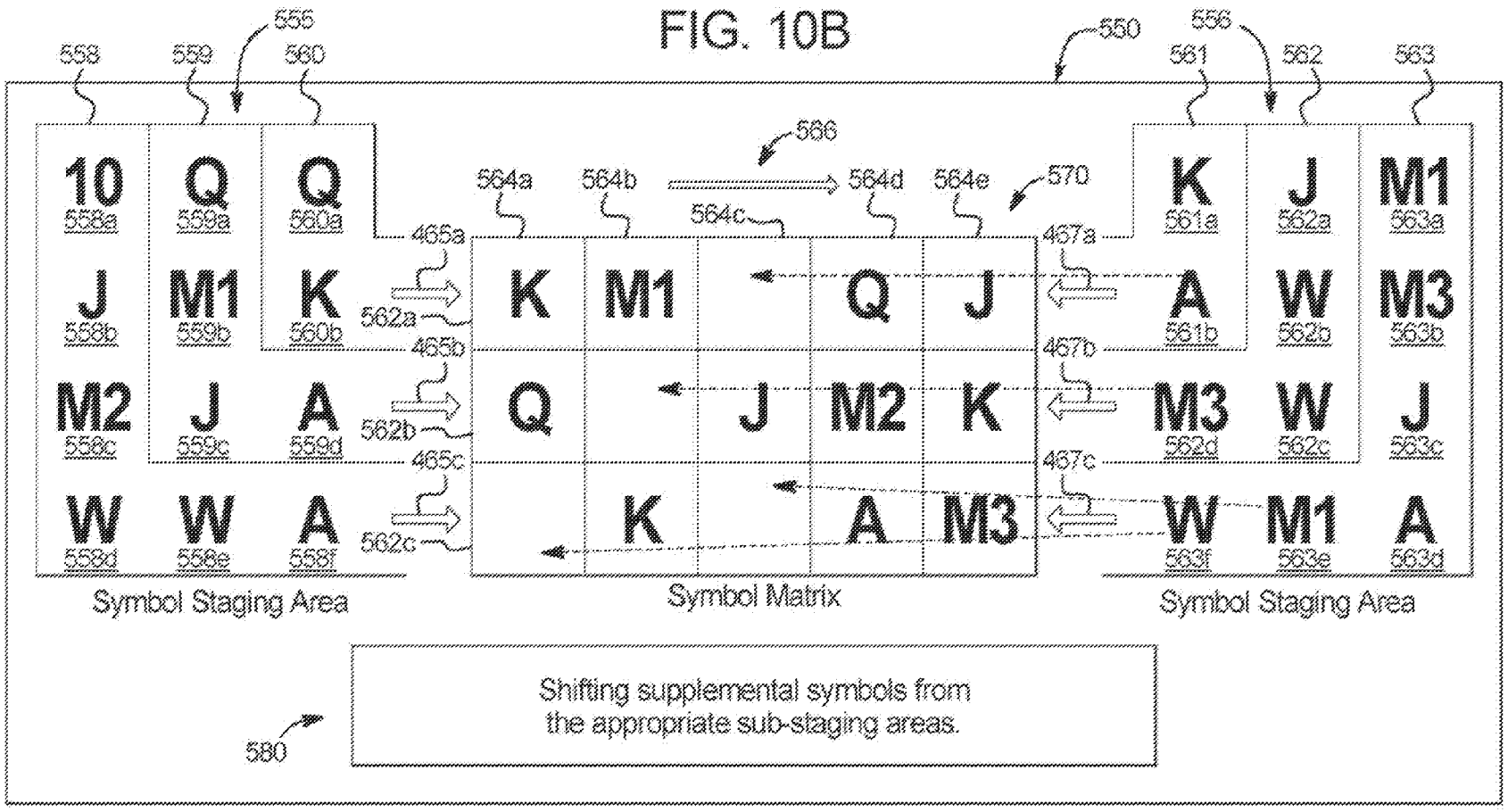
Figure 10C:
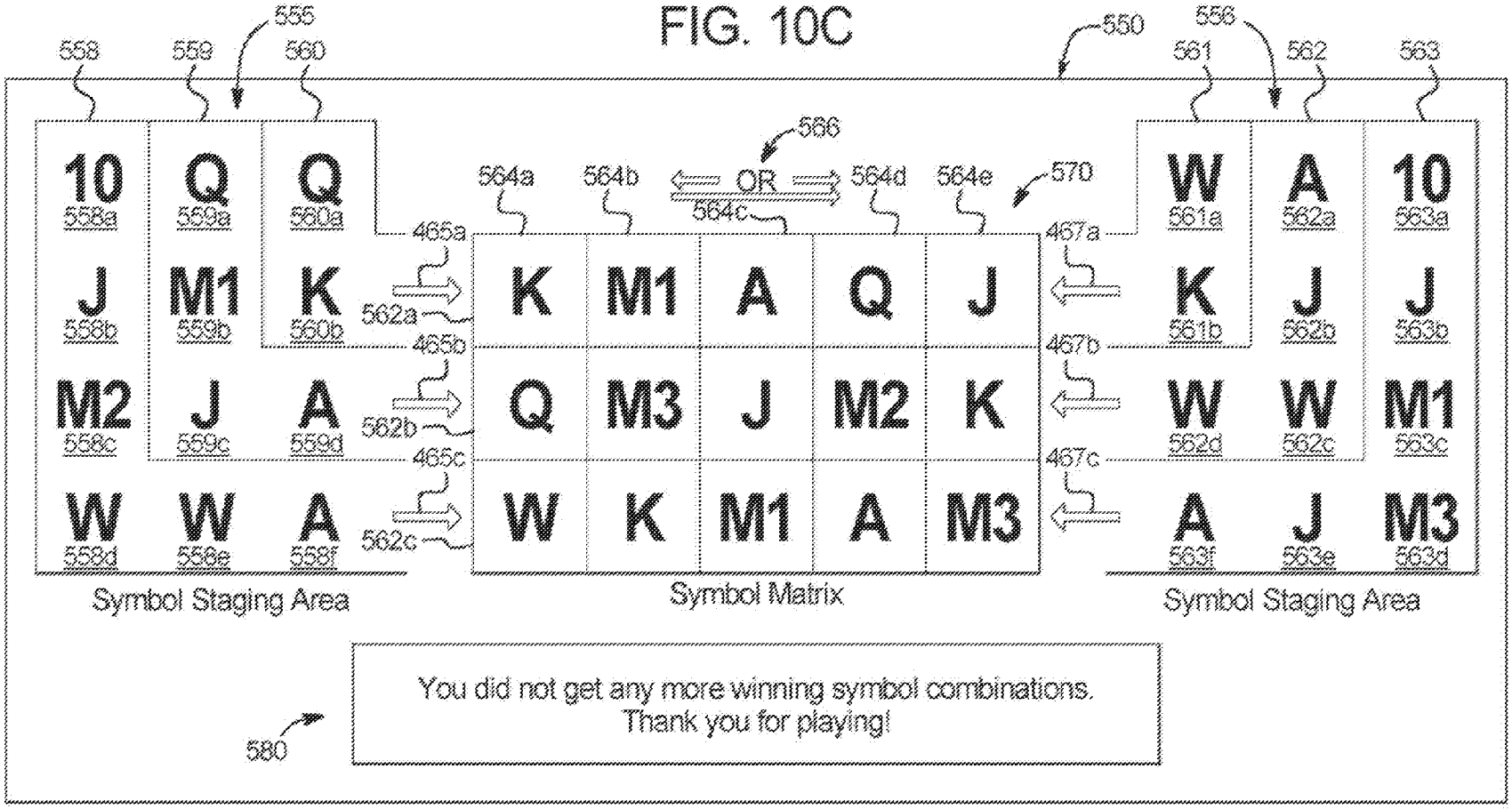

FIGS. 10A, 10B, and 10C illustrate one embodiment of the gaming device disclosed herein, wherein each of a plurality of symbol staging areas each include a plurality of supplemental symbols, arranged in sub-staging areas, potentially usable to fill one or more empty symbol positions for a play of the game, and wherein the gaming device is configured to generate new supplemental symbols for each symbol staging area such that newly generate symbols are only usable to fill empty symbol positions in a same subset of the symbol matrix as the subset of the matrix which includes the filled empty symbol position. Specifically, the gaming device illustrated in FIGS. 10A, 10B, and 10C includes a screen 550 configured to display one or more plays of the game disclosed herein. The illustrated gaming device also includes a symbol matrix 570 for displaying a plurality of symbols in a plurality of symbol positions, the matrix 570 being divided into three rows 552*a*, 552*b*, and 552*c*, and five columns 554*a*, 554*b*, 554*c*, 554*d*, and 554*e*. In the illustrated embodiment, the gaming device displays a plurality of symbol staging areas 555 and 556, each symbol staging area including a plurality of sub-staging areas. Specifically, symbol staging area 555 includes sub-staging areas 558, 559, and 560, and symbol staging area 556 includes sub-staging areas 561, 562, and 563. Game information display area 580 enables the gaming device to communicate information about game progress and/or status at various points during a play of the game disclosed herein.

In the illustrated embodiment, each sub-staging area of each symbol staging area is associated with a specific subset of the symbol matrix. Sub-staging area 558 is associated with row 552*a*, as indicated by arrow 565*a*; sub-staging area 559 is associated with row 552*b*, as indicated by arrow 565*b*: sub-staging area 560 is associated with row 552*c*, as indicated by arrow 565*c*: sub-staging area 561 is associated with row 552*a*, as indicated by arrow 567*a*; sub-staging area 562 is associated with row 552*b*, as indicated by arrow 567*b*; and sub-staging area 563 is associated with row 552*c*, as indicated by arrow 567*c*. In the embodiment illustrated in FIGS. 10A, 10B, and 10C, the gaming device disclosed herein is configured to shift supplemental symbols into empty symbol positions of the symbol matrix only from sub-staging areas associated with the row in which the empty symbol position is present.

In the illustrated embodiment, sub-staging area 558 includes positions 558*a*, 558*b*, 558*c*, 558*d*, 558*e*, and 558*f*; sub-staging area 559 includes positions 559*a*, 559*b*, 559*c*, and 559*d*; and sub-staging area 560 includes positions 560*a* and 560*b*. It should be appreciated that if symbol staging area 555 is selected for one or more plays of the game (i.e., by arrow 566 pointing to the left), the gaming device will utilize sub-staging areas 558, 559, and 560 to fill any empty symbol positions of the symbol matrix 570 for such plays of the game. Likewise, sub-staging area 561 includes positions 561*a* and 561*b*: sub-staging area 562 includes positions 562*a*, 562*b*, 562*c*, and 562*d*; and sub-staging area 563 includes positions 563*a*, 563*b*, 563*c*, 563*d*, 563*e*, and 563*f*. It should be appreciated that if symbol staging area 556 is selected for one or more plays of the game (i.e., by arrow 566 pointing to the right), the gaming device will utilize sub-staging areas 561, 562, and 563 to fill any empty symbol positions of the symbol matrix 570 for such plays of the game. Moreover, in the illustrated embodiment, the gaming device is configured to indicate one of the symbol staging areas 555 or 556 for a play of the game, as opposed to newly determining and indicating a symbol staging area for each row of the symbol matrix, as in FIGS. 9A, 9B, 9C, 9D, 9E, 9F, 9G, 9H, and 9I.

Referring now to FIG. 10A, the gaming device generates a plurality of symbols in the symbol matrix 570, and also generates a plurality of supplemental symbols in each of the symbol staging areas 558, 559, 560, 561, 562, and 563. In the illustrated embodiment, the gaming device evaluates the symbols generated and displayed in the symbol matrix, as discussed above, and determines that two winning symbol combinations, 590*a* and 590*b*, are displayed for the play of the game. In the illustrated embodiment, the game information display area indicates that two winning symbol combinations were generated, and indicates that the symbols of the winning symbol combinations will be removed, a symbol staging area will be selected, and the appropriate supplemental symbols will be shifted into the empty symbol positions.

FIG. 10B illustrates that the symbols of winning symbol combinations 590*a* and 590*b* have been removed from the symbol matrix 570, resulting in four empty symbol positions. Furthermore, the symbol staging area indicator indicates that symbol staging area 556 (and, correspondingly, sub-staging areas 561, 562, and 563) will be utilized for the play of the game. It should be appreciated that in this embodiment (as opposed to the embodiment illustrated above with respect to FIGS. 9A, 9B, 9C, 9D, 9E, 9F, 9G, 9H, and 9I), the same symbol staging area is utilized throughout an entire play of the game. Thus, in the illustrated embodiment of FIG. 10B, the symbol staging area 556 (and associated sub-staging areas 561, 562, and 563) will be utilized to fill each of the empty symbol positions of the symbol matrix 570.

As further illustrated, symbols from sub-staging area 563 will be utilized to fill the two empty symbol positions of row 552*c* of symbol matrix 570, a symbol from sub-staging area 562 will be utilized to fill the empty symbol position of row 552*b* of symbol matrix 570, and a symbol from sub-staging area 561 will be utilized to fill the empty symbol position of row 552*a* of symbol matrix 570. In the illustrated embodiment, dashed arrows indicate which of the symbols of the sub-staging areas will be so utilized. Specifically, the symbol at position 563*f* will be shifted to the empty symbol position at row 552*c* column 554*a*, the symbol at position 563*e* will be shifted to the empty symbol position at row 552*c* column 554*c*, the symbol at position 562*d* will be shifted to the empty symbol position at row 552*b* column 554*b*, and the symbol at position 561*b* will be shifted to the empty symbol position at row 552*a* column 554*c*. It should be further appreciated that for each removed symbol from one of the sub-staging areas of symbol staging area 556, the remaining symbols of that sub-staging area will be shifted downward within the symbol staging area, and new symbols generated, such that each position of each sub-staging area displays a supplemental symbol after shifting. Game information display area 580 indicates that the above-described shifting is occurring at the point in time illustrated by FIG. 10B.

FIG. 10C illustrates one embodiment of the gaming device disclosed herein after the appropriate symbols have been shifted from symbol sub-staging areas 561, 562, and 563 into the empty symbol positions of rows 552*a*, 552*b*, and 552*c*, respectively, of symbol matrix 570. In the illustrated embodiment, it should be appreciated that the gaming device generated a new W symbol at position 561*a* of sub-staging area 561, a new A symbol at position 562*a* of sub-staging area 562, a new J symbol at position 563*b* of sub-staging area 563, and a new 10 symbol at position 563*a* of sub-staging area 563. Moreover, as indicated by the game information display area 580, no further winning symbol combinations are displayed for the play of the game. In one embodiment (not shown), the gaming device provides the player an award for the play of the game, such as an award based on the generation of winning symbol combinations 590*a* and 590*b* for the play of the game.

In various embodiments, the symbol matrix disclosed herein is not arranged as a matrix of rows and columns, but rather includes a plurality of symbol positions having a different geometrical relationship. For example, in one such embodiment, the symbol matrix is displayed as a triangle of symbol positions. It should be appreciated that in this embodiment, three different symbol staging areas could be displayed, such that one symbol staging area is associated with each side or edge of the triangle. It should be further appreciated that other shapes of the symbol matrix enable different numbers and configurations of symbol staging areas to be utilized by the gaming device disclosed herein. In various embodiments, the shape of the symbol matrix for one or more plays of the game disclosed herein is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, for a play of the game, the gaming device randomly generates the plurality of supplemental symbols from a set of symbols, wherein certain of the symbols of the set can be repeated, and certain of the symbols of the set may not be generated at all. In another embodiment, the gaming device disclosed herein displays an entire set of symbols for a play of the game, but randomly generates an order of the symbols of the set for display in the symbol staging areas. In other suitable embodiments, which of the symbols of a set of symbols is displayed in the symbol staging area, as well as how many of each of the symbols of a set of symbols is displayed in the symbol staging area, is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In various embodiments, the subset of symbols of the symbol matrix with which one or more symbol staging areas is associated is not defined as a row of the symbol matrix. In various embodiments, one or more of the symbol staging areas is associated with a quadrant of the symbol matrix, with a column of the symbol matrix, with an x-shaped segment of the symbol matrix, or with some other subset of the symbol matrix. In various embodiments, the subset of the symbol matrix with which one or more of the symbol staging areas is associated is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In various embodiments the gaming device disclosed herein utilizes one or more symbol maps to generate symbols for display in the symbol matrix and/or in the symbol staging areas. In certain such embodiments, a symbol map usable to generate supplemental symbols in the symbol staging areas causes the gaming device to generate designated symbols, such as wild symbols, with relative frequency. For example, the symbol map causes the gaming device to generate blocks of wild symbols, such that the shifting of a first wild symbol from a symbol staging area into the symbol matrix is relatively likely to be followed by a shifting of a second wild symbol from a symbol staging area into the symbol matrix. It should be appreciated that these blocks of designated symbols (such as wild symbols) increase player excitement and enjoyment by resulting in longer plays of the disclosed game, or by resulting in plays of the game wherein higher awards are provided to the player at the end of such plays.

In one embodiment, the symbols generated for the plurality of symbol positions of the symbol matrix are generated based on a first symbol map, wherein the probabilities of generating the symbols are based on the first symbol map. In a further embodiment, the supplemental symbols, displayed in the symbol staging areas, are generated based on different second symbol map, wherein the different second symbol map results in different probabilities of generating symbols. In one such embodiment, the different second symbol map results in higher probabilities of generating relatively higher-value symbols (such as major symbols M1, M2, or M3) or wild symbols (such as W symbols), such that shifting symbols from a symbol staging area to the symbol matrix increases the probability of receiving awards or increases the probability of receiving higher-valued awards. It should be appreciated that in this embodiment, the more symbols that are shifted from a symbol staging area to the symbol matrix, the higher the probability of winning additional awards or additional awards with relatively high values, thus increasing player excitement and enjoyment.

In one embodiment, one or more symbols which is available based on the symbol map associated with the symbol staging areas is unavailable for an initial generation of symbols for the symbol matrix, such that the only way to cause such a symbol to be displayed in the symbol map is for that symbol to be shifted into an empty symbol position from a symbol staging area. In one embodiment, the symbol which is only available as a supplemental symbol has a relatively high value, such that when the gaming device shifts the relatively high value symbol into the symbol matrix, awards with relatively higher values are available to the player. In various embodiments, whether such a high value symbol is generated in one or more of the symbol staging areas is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, a symbol map usable to generate supplemental symbols for displaying in the symbol staging area changes during the course of a play of the disclosed game. For example, for each winning symbol combination generated during a play of the game disclosed herein, the symbol map used to generate supplemental symbols may change, such as by becoming more favorable. In this embodiment, the longer a play of the game lasts (e.g., the more evaluations which result in a finding of a winning symbol combination), the more favorable the symbol map used to generate additional supplemental symbols becomes. In other embodiments, whether the symbol map usable to generate supplemental symbols changes during a play of the game is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria. In another embodiment, the gaming device applies a different symbol map based on the progression of a plurality of plays of a game. For example, if a player wagers on ten plays of a game in a row, the gaming device applies a more favorable symbol map for the eleventh play of the game.

In one embodiment, the gaming device disclosed herein generates the plurality of symbols for display in the plurality of symbol positions of the symbol matrix from a first or standard symbol pool. In this embodiment, the gaming device generates any supplemental symbols for display in the supplemental symbol display area(s) from a second or supplemental symbol pool. In one embodiment, the supplemental symbol pool and the standard symbol pool include at least one of the same symbols. In one embodiment, the supplemental symbol pool includes at least one symbol not included in the standard symbol pool, such as at least one high-value or major symbol usable to generate winning symbol combinations with higher-valued awards. In one embodiment, the standard symbol pool includes at least one symbol not included in the supplemental symbol pool. In one embodiment, the supplemental symbol pool and the standard symbol pool each include a same plurality of symbols, but the probability of generating the symbols differs for the standard symbol pool and the supplemental symbol pool. In various embodiments, which symbols are included in the standard symbol pool and/or the probability of generating such symbols is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria. In various embodiments, which symbols are included in the supplemental symbol pool and/or the probability of generating such symbols is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, the gaming device disclosed herein generates a new set of supplemental symbols in the symbol staging areas for each play of the game. In another embodiment, at least one of the supplemental symbols displayed in a symbol staging area for one or more previous plays of the game persists to a subsequent play of the game, such that it continues to be available to fill an empty symbol position in the subsequent play of the game. In various embodiments, whether one or more supplemental symbols persist for one or more plays of the game disclosed herein is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, for a play of the game, the gaming device selects a single one of a plurality of supplemental symbol staging areas from which to shift supplemental symbols into the symbol matrix for a play of the game. In various such embodiments, which of the plurality of supplemental symbol staging areas is selected is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In another embodiment, the gaming device makes more than one determination of a symbol staging area from which to shift symbols for a play of the game. For example, the gaming device determines one of the plurality of symbol staging areas for each new evaluation of the symbols of the symbol matrix during the play of the game. In this example, it should be appreciated that the symbol staging area utilized to shift supplemental symbols into the symbol matrix could vary during the course of a play of the game disclosed herein. In various embodiments, which of a plurality of symbol staging areas is utilized is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria. In another embodiment, the gaming device determines which symbol staging area to utilize for shifting symbols into empty symbol positions for each empty symbol position. That is, if four empty symbol positions are displayed, the gaming device makes four different determinations as to which symbol staging area from which to shift a supplemental symbol to fill a different empty symbol position.

In one embodiment, the gaming device disclosed herein enables the player to select one of a plurality of symbol staging area for use in filling empty symbol positions for a play of the game. In one such embodiment, the gaming device enables the player to select one of the symbol staging areas prior to a generation of symbols in the plurality of symbol positions of the symbol matrix. In another embodiment, the gaming device enables the player to select one of the symbol staging areas for each empty symbol position generated during a play of the game. In various embodiments, whether the gaming device enables the player to select one of a plurality of symbol staging areas for use in filling empty symbol positions is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, the gaming device displays a symbol staging area indicator for indicating one or more symbol staging areas for a play of a game. In one such embodiment, the symbol staging area indicator is an arrow or other appropriate indicia or symbol. In another embodiment, the gaming device highlights or indicates one or more symbol staging areas for a play of a game with an appropriate audio, visual, or audio-visual indicator.

In one embodiment, for a play of the game, the gaming device disclosed herein makes an initial evaluation of whether a triggering condition occurs before determining whether to remove one or more symbols from the symbol matrix, resulting in one or more empty symbol positions of the symbol matrix. In one embodiment (such as the embodiments described above), the triggering condition occurs when a winning symbol combination is generated for a play of the game. In other embodiments, the triggering condition occurs based on a factor other than whether a winning symbol combination is generated. In such embodiments, whether the triggering condition occurs is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, upon filling each empty symbol position as described above, the gaming device again determines whether the triggering condition has occurred, such as by determining whether any new winning symbols or winning symbol combinations are displayed. In one embodiment, if the triggering condition occurs again, the gaming device repeats the process described above until the triggering condition does not occur.

In one embodiment, such as the embodiments discussed with respect to FIGS. 6A to 6D, 7A to 7F, 8A to 8I, 9A to 9I, and 10A to 10C above, the gaming device fills empty symbol positions of the symbol matrix based on a predetermined order of filling such symbols. For example, the gaming device fills empty symbol positions in each row from the bottom to the top, and within each row from left to right. In other embodiments, the order of filling empty symbol positions is independent of the location of such empty symbol positions within the symbol matrix. In such embodiments, the order in which such empty symbol positions are filled is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In the embodiments described above, the gaming device shifts a plurality of supplemental symbols contained within the symbol staging area downward following each shift of a supplemental symbol into an empty symbol position of the symbol matrix. In one embodiment, such downward shifting does not occur until it is necessary. For example, in an embodiment wherein a plurality of different symbols of a same symbol staging area are each associated with a different subset of the symbol positions of the symbol matrix (e.g., three symbols of the symbol staging area are each associated with one of three rows of the symbol matrix, as in FIGS. 8A and 9A), each of the indicated supplemental symbols is shifted into an appropriate empty symbol position of the symbol matrix before any of the remaining supplemental symbols are shifted downward to fill the symbol staging area. In other embodiments, when the supplemental symbols of the symbol staging area are shifted within the symbol staging area is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, the gaming device displays one or more symbol staging areas on a separate display device from the symbol matrix, such as on secondary display device or a communal display device. In this embodiment, the gaming device shifts one or more symbols from the symbol staging areas to one or more empty symbol positions of the symbol matrix by moving a symbol from one display device to another, thus increasing player excitement and enjoyment. In one embodiment, the gaming device further increases player excitement and enjoyment by appropriately animating the shifting of a symbol from one display device to another.

In one embodiment, a plurality of gaming devices as disclosed herein each utilize one or more communal symbol staging areas, such that a plurality of players can potentially cause supplemental symbols generated and displayed in the communal symbol staging areas to be shifted onto a symbol matrix particular to each player. In this embodiment, player excitement and enjoyment is increased because the players are competing for a common set of symbols amongst a plurality of players, and each time a player successfully sees a favorable symbol shift from a symbol staging area to the player's symbol matrix, the player feels a sense of accomplishment over the other players.

In one embodiment, the symbols displayed in the symbol matrix and the symbol staging areas are standard symbols usable with conventional slot machines. In another embodiment, the symbols correspond with cards from a standard deck of cards. In this embodiment, the gaming device displays one or more of the symbol staging areas as a deck or stack of cards, such that each card from a symbol staging area usable to fill an empty symbol position is drawn or selected from the deck of cards corresponding to that symbol staging area. It should be appreciated that any suitable set of symbols can be used, and as discussed above, in certain embodiments the set of available supplemental symbols can differ from the set of available symbols for generation in the symbol matrix for a play of the game. The flexibility of utilizing different sets of symbols, and of utilizing any appropriate types of symbols, increases player excitement and enjoyment over conventional slot games wherein each symbol for a play of the game is generated from a single, common set of symbols.

Accordingly, the gaming device disclosed herein provides for one or more symbols to be generated in symbol staging areas, and to thereafter be utilized to potentially form winning symbol combinations by filling empty symbol positions of a symbol matrix. That is, this gaming device utilizes a symbol initially generated from a symbol map of the symbol staging areas to determine an award with a plurality of symbols initially generated from another symbol map associated with the symbol matrix. By shifting or transferring a symbol from the symbol staging area to the symbol matrix, the gaming device disclosed herein provides increased volatility over prior, single reel set gaming devices. Such a configuration provides the player with additional opportunities to win awards in association with multiple symbol staging areas.

While the present gaming device is described in connection with what are presently considered to be the most practical and preferred embodiments, it should be appreciated that the gaming device is not limited to the disclosed embodiments, and is intended to cover various modifications and equivalent arrangements included within the spirit and scope of the claims. Modifications and variations in the present gaming device may be made without departing from the novel aspects of the gaming device as defined in the claims, and this application is limited only by the scope of the claims.

The invention is claimed as follows:

1. A gaming system comprising:

a housing;

at least one display device supported by the housing;

a plurality of input devices supported by the housing, said plurality of input devices including:

(i) an acceptor, and (ii) a cashout device;

at least one processor; and at least one memory device which stores a plurality of instructions which, when executed by the at least one processor, cause the at least one processor to operate with the at least one display device and the plurality of input devices to:

(a) if a physical item is received via the acceptor, establish a credit balance based, at least in part, on a monetary value associated with the received physical item, wherein said physical item is selected from the group consisting of: a ticket associated with the monetary value and a unit of currency;

(b) display a symbol matrix including a plurality of symbol positions and at least one symbol staging area including a plurality of supplemental symbol positions;

(c) at each of the plurality of symbol positions of the symbol matrix and at each of the plurality of supplemental symbol positions of each symbol staging area, display a randomly generated symbol selected from a plurality of symbols, wherein the generation of symbols for the symbol matrix is independent of the generation of symbols for the at least one symbol staging area;

(d) determine if the symbols displayed at the plurality of symbol positions of the symbol matrix form any of a plurality of winning symbol combinations;

(e) provide an award to a player based on any generated winning symbol combinations;

(f) for at least one of any winning symbol combinations formed by the symbols displayed at the plurality of symbol positions of the symbol matrix:

(i) remove at least one symbol from the symbol matrix, resulting in at least one empty symbol position, (ii) for each empty symbol position:

(A) shift one of the supplemental symbols of the at least one symbol staging area to cause any empty symbol position to be filled, wherein prior to be shifted from the at least one symbol staging area, no determination occurs of whether said supplemental symbol is part of any winning symbol combination, and (B) generate a new supplemental symbol in the at least one symbol staging area, and (iii) repeat (d) to (f) at least once; and (g) if a cashout input is received via the cashout device, cause an initiation of any payout associated with the credit balance.

2. The gaming system of claim 1, wherein when executed by the at least one processor, the instructions cause the at least one processor to operate with the at least one display device to fill any empty symbol position by:

shifting at least one displayed symbol displayed at at least one of the symbol positions of the symbol matrix into said empty symbol position, said shifting resulting in at least one shift-caused empty symbol position, shifting at least one of the supplemental symbols displayed at at least one of the supplemental symbol positions into the at least one shift-caused empty symbol position, and displaying at least one randomly generated supplemental symbol in the at least one symbol staging area.

3. The gaming system of claim 1, wherein the at least one symbol staging area is associated with an order, and wherein, when executed by the at least one processor, the instructions cause the at least one processor to operate with the at least one display device to shift one of the supplemental symbols of the at least one symbol staging area into the symbol matrix according to an order.

4. The gaming system of claim 1, wherein when executed by the at least one processor, the instructions cause the at least one processor, if a winning symbol combination is displayed in the symbol matrix, to randomly indicate one of at least two symbol staging areas using a symbol staging area indicator.

5. The gaming system of claim 4, wherein when executed by the at least one processor, the instructions cause the at least one processor to randomly indicate one of the at least two symbol staging areas for each winning symbol combination displayed in the symbol matrix.

6. The gaming system of claim 1, wherein each symbol staging area includes at least two sub-staging areas, each sub-staging area associated with one of a plurality of different subsets of the plurality of symbol positions of the symbol matrix, and wherein said supplemental symbols are shifted into each empty symbol position from one of the sub-staging areas associated with the different subset of the plurality of symbol positions which includes that empty symbol position.

7. The gaming system of claim 1, wherein when executed by the at least one processor, the instructions cause the at least one processor to operate with the at least one display device to display a plurality of randomly generated symbols at a plurality of the symbol positions of the symbol matrix based on a first symbol map and to display a plurality of randomly generated symbols at a plurality of the supplemental symbol positions of the at least one symbol staging area based on a different second symbol map.

8. The gaming system of claim 7, wherein when executed by the at least one processor, the instructions cause the at least one processor, for at least one supplemental symbol position of the at least one symbol staging area, to randomly generate at least one symbol based on the second symbol map which is not available based on the first symbol map.

9. A gaming system comprising:

a housing;

at least one display device supported by the housing;

a plurality of input devices supported by the housing, said plurality of input devices including:

(i) an acceptor, and (ii) a cashout device;

at least one processor; and at least one memory device which stores a plurality of instructions which, when executed by the at least one processor, cause the at least one processor to operate with the at least one display device and the plurality of input devices to:

(a) if a physical item is received via the acceptor, establish a credit balance based, at least in part, on a monetary value associated with the received physical item wherein said physical item is selected from the group consisting of: a ticket associated with the monetary value and a unit of currency;

(b) display a symbol matrix, said symbol matrix including a plurality of symbol positions;

(c) display at least one symbol staging area;

(d) for a first play of a game:

(i) display a randomly generated one of a plurality of symbols at each symbol position of the symbol matrix, (ii) display a randomly generated plurality of supplemental symbols in the at least one symbol staging area, (iii) determine if any winning symbol combination is displayed at the symbol positions of the symbol matrix, (iv) if any winning symbol combination is displayed at the symbol positions of in the symbol matrix:

(A) remove at least one symbol from the symbol matrix based on said displayed winning symbol combination, resulting in at least one empty symbol position, and (B) shift at least one supplemental symbol displayed in the at least one symbol staging area to fill the at least one empty symbol position of the symbol matrix, wherein prior to be shifted from the at least one symbol staging area, no determination occurs of whether said supplemental symbol is part of any winning symbol combination, and (v) provide an award for any winning symbol combination displayed during the first play of the game; and (e) for a second, subsequent play of the game:

(i) display a randomly generated one of a plurality of symbols at each symbol position of the symbol matrix, (ii) determine if any winning symbol combination is displayed at the symbol positions of the symbol matrix, (iii) if any winning symbol combination is displayed at the symbol positions of the symbol matrix:

(A) remove at least one symbol from the symbol matrix based on said displayed winning symbol combination, resulting in at least one empty symbol position, and (B) shift at least one supplemental symbol generated and displayed in the at least one symbol staging area for the first play of the game to fill the at least one empty symbol position of the symbol matrix, wherein prior to be shifted from the at least one symbol staging area, no determination occurs of whether said supplemental symbol is part of any winning symbol combination, and (iv) provide an award for any winning symbol combination displayed during the second play of the game; and (f) if a cashout input is received via the cashout device, cause an initiation of any payout associated with the credit balance.

10. The gaming system of claim 9, wherein when executed by the at least one processor, the instructions cause the at least one processor to operate with the at least one display device to:

(a) display a plurality of symbol staging areas;

(b) display at least one symbol staging area indicator;

(c) for the first play of the game:

(i) indicate one of the symbol staging areas with the symbol staging area indicator, and (ii) shift the at least one supplemental symbol from the indicated symbol staging area to the at least one empty symbol position of the symbol matrix; and (d) for the second play of the game, shift the at least one supplemental symbol from the indicated symbol staging area to the at least one empty symbol position of the symbol matrix.

11. The gaming system of claim 10, wherein when executed by the at least one processor, the instructions cause the at least one processor to randomly indicate one of the at least one symbol staging areas.

12. The gaming system of claim 9, wherein, when executed by the at least one processor, the instructions cause the at least one processor to operate with the at least one display device to:

(a) display a plurality of symbol staging areas;

(b) display at least one symbol staging area indicator;

(c) for the first play of the game:

(i) indicate a first one of the symbol staging areas with the symbol staging area indicator, and (ii) shift the at least one supplemental symbol from the first indicated symbol staging area to the at least one empty symbol position of the symbol matrix; and (d) for the second play of the game:

(i) indicate a second one of the symbol staging areas with the symbol staging area indicator, and (ii) shift the at least one supplemental symbol from the second indicated symbol staging area to the at least one empty symbol position of the symbol matrix.

13. The gaming system of claim 12, wherein when executed by the at least one processor, the instructions cause the at least one processor to randomly indicate one of the first one symbol staging area and to randomly indicate the second symbol staging area.

14. The gaming system of claim 12, wherein the first symbol staging area and the second symbol staging area are a same symbol staging area.

15. A gaming system comprising:

a housing;

at least one display device supported by the housing;

a plurality of input device supported by the housing, said plurality of input devices including:

(i) an acceptor, and (ii) a cashout device;

at least one processor; and at least one memory device which stores a plurality of instructions which, when executed by the at least one processor, cause the at least one processor to operate with the at least one display device and the plurality of input devices to:

(a) if a physical item is received via the acceptor, establish a credit balance based, at least in part, on a monetary value associated with the received physical item, wherein said physical item is selected from the group consisting of: a ticket associated with the monetary value and a unit of currency;

(b) display a symbol matrix including a plurality of symbol positions and at least one symbol staging area including a plurality of supplemental symbol positions;

(c) at each of the plurality of symbol positions of the symbol matrix and at each of the plurality of supplemental symbol positions of each symbol staging area, display a randomly generated symbol selected from a plurality of symbols, wherein the generation of symbols for the symbol matrix is independent of the generation of symbols for the at least one symbol staging area;

(d) determine if the displayed-symbols displayed at the plurality of symbol positions of the symbol matrix form any of a plurality of winning symbol combinations;

(e) provide an award to a player based on any formed winning symbol combinations;

(f) for at least one of any winning symbol combinations formed by the symbols displayed at the plurality of symbol positions of the symbol matrix:

(i) remove at least one symbol from the symbol matrix, resulting in at least one empty symbol position, (ii) for each empty symbol position, shift one of the supplemental symbols of the at least one symbol staging area to cause any empty symbol position to be filled, wherein prior to be shifted from the at least one symbol staging area, no determination occurs of whether said supplemental symbol is part of any winning symbol combination, and (g) if a cashout input is received via the cashout device, cause an initiation of any payout associated with the credit balance.

16. The gaming system of claim 15, wherein executed by the at least one processor, the instructions cause the at least one processor to repeat (d) to (f) at least once.

17. The gaming system of claim 15, wherein when executed by the at least one processor, the instructions cause the at least one processor to operate with the at least one display device to fill any empty symbol position by:

shifting at least one symbol displayed at at least one symbol position of the symbol matrix into said empty symbol position, said shifting resulting in at least one shift-caused empty symbol position, and shifting at least one of the supplemental symbols into the at least one shift-caused empty symbol position.

18. The gaming system of claim 15, wherein when executed by the at least one processor, the instructions cause the at least one processor, if a winning symbol combination is displayed in the symbol matrix, to randomly indicate one of at least two symbol staging areas using a symbol staging area indicator.

19. The gaming system of claim 15, wherein each symbol staging area includes at least two sub-staging areas, each sub-staging area associated with one of a plurality of different subsets of the plurality of symbol positions of the symbol matrix, and wherein said supplemental symbols are shifted into each empty symbol position from one of the sub-staging areas associated with the different subset of the plurality of symbol positions which includes that empty symbol position.

20. The gaming system of claim 15, wherein when executed by the at least one processor, the instructions cause the at least one processor to operate with the at least one display device to display a plurality of randomly generated symbols at a plurality of the symbol display positions of the symbol matrix based on a first symbol map and to display a plurality of randomly generated symbols at a plurality of the supplemental symbol positions of the at least one symbol staging area based on a different second symbol map.

* * * * *